US011176877B2

(12) United States Patent
Lee et al.

(10) Patent No.: US 11,176,877 B2
(45) Date of Patent: Nov. 16, 2021

(54) IMAGE DISPLAY APPARATUS

(71) Applicant: LG ELECTRONICS INC., Seoul (KR)

(72) Inventors: Jongmin Lee, Seoul (KR); Myongyoung Lee, Seoul (KR); Kyuyong Chung, Seoul (KR); Sangchul Nam, Seoul (KR); Seokpan Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/005,902

(22) Filed: Aug. 28, 2020

(65) Prior Publication Data

US 2021/0065621 A1 Mar. 4, 2021

(30) Foreign Application Priority Data

Aug. 28, 2019 (KR) ..... 10-2019-0106037

(51) Int. Cl.
*G09G 3/3208* (2016.01)
*G09G 5/10* (2006.01)

(52) U.S. Cl.
CPC ..... *G09G 3/3208* (2013.01); *G09G 5/10* (2013.01); *G09G 2320/064* (2013.01); *G09G 2320/0646* (2013.01)

(58) Field of Classification Search
CPC ..... G09G 2320/0646; G09G 3/3208; G09G 2320/064; G09G 5/10
See application file for complete search history.

(56) References Cited

U.S. PATENT DOCUMENTS

2010/0103089 A1* 4/2010 Yoshida ..... G09G 3/3611 345/102
2011/0316902 A1* 12/2011 Onishi ..... H04N 5/44591 345/690
2013/0076769 A1 3/2013 Park et al.
2014/0139461 A1* 5/2014 Furukawa ..... G09G 3/342 345/173
2020/0135122 A1* 4/2020 Song ..... G09G 3/3426

FOREIGN PATENT DOCUMENTS

KR 1020050074725 7/2005
KR 1020080055415 6/2008
KR 1020180047263 5/2018
KR 1020190082565 7/2019

OTHER PUBLICATIONS

PCT International Application No. PCT/KR2020/011520, International Search Report dated Dec. 21, 2020, 4 pages.

* cited by examiner

*Primary Examiner* — Muhammad N Edun
(74) *Attorney, Agent, or Firm* — Lee, Hong, Degerman, Kang & Waimey

(57) ABSTRACT

An image display apparatus is disclosed. The image display apparatus includes a panel configured to display an image, a backlight including a plurality of light sources configured to output light to the panel, a light source driver configured to drive the plurality of light sources, and a processor configured to control the light source driver, wherein the processor changes the turn on duty of a light source corresponding to a moving object area in an input image and changes the level of current flowing in the light source. Consequently, the definition and luminance of an image including a moving object may be improved.

19 Claims, 35 Drawing Sheets

IMAGE DISPLAY APPARATUS

CROSS-REFERENCE TO RELATED APPLICATION

Pursuant to 35 U.S.C. § 119(a), this application claims the benefit of earlier filing date and right of priority to Korean Patent Application No. 10-2019-0106037, filed on Aug. 28, 2019, the contents of which are hereby incorporated by reference herein in its entirety.

BACKGROUND OF THE INVENTION

1. Field of the Invention

The present disclosure relates to an image display apparatus, and more particularly to an image display apparatus capable of improving the definition and luminance of an image including a moving object.

2. Description of the Related Art

An image display apparatus is an apparatus that displays an image.

In response to recent demand for increasing resolution and definition of an image, signal processing for improving definition is performed at the time of image signal processing.

For example, a scheme for inserting a black frame between image frames in order to prevent a phenomenon in which definition of an image including a moving object is lowered depending on the movement of the object, thereby improving definition, has been proposed.

However, overall luminance of the image is lowered due to insertion of the black frame. That is, the definition of an image is improved due to insertion of the black frame; however, the luminance of the image is lowered.

SUMMARY OF THE INVENTION

An object of the present disclosure is to provide an image display apparatus capable of improving the definition and luminance of an image including a moving object.

In accordance with an aspect of the present disclosure, the above and other objects can be accomplished by the provision of an image display apparatus including a panel configured to display an image, a backlight including a plurality of light sources configured to output light to the panel, a light source driver configured to drive the plurality of light sources, and a processor configured to control the light source driver, wherein the processor changes the turn on duty of a light source corresponding to a moving object area in an input image and changes the level of current flowing in the light source.

Meanwhile, in the case in which the movement of the object area in the input image is equal to or greater than a first reference value, a processor according to an embodiment of the present disclosure may decrease the turn on duty of the light source and may increase the level of current flowing in the light source.

Meanwhile, in the case in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a second duty, which is less than the first duty, and adjust the level of current flowing in the light source as a second level, which is higher than the first level, during a first frame period.

Meanwhile, a processor according to an embodiment of the present disclosure may decrease the second duty and increase the second level as movement of the object in the input image increases.

Meanwhile, in the case in which the turn on duty of a light source corresponding to a background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period.

Meanwhile, in the case in which the movement of the object area in the input image is equal to or greater than a first reference value in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a second duty, which is less than the first duty, and adjust the level of current flowing in the light source as a second level, which is higher than the first level, during the first frame period.

Meanwhile, in the case in which the movement of the object area in the input image is less than a first reference value in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period.

Meanwhile, a processor according to an embodiment of the present disclosure may increase the fifth duty and decrease the fifth level, as the movement of the object in the input image decreases.

Meanwhile, in the case in which the movement of the object area in the input image is less than a first reference value in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period.

Meanwhile, in the case in which the movement of the object area in the input image is equal to or greater than a first reference value and the vertical synchronization frequency is a first frequency in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a second duty, which is less than the first duty, and adjust the level of current flowing in the light source as a second level, which is higher than the first level, during the first frame period.

Meanwhile, in the case in which the movement of the object area in the input image is equal to or greater than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a seventh duty, which is less than the second duty, and adjust the level of current flowing in the light source as a seventh level, which is higher than the second level, during the first frame period.

Meanwhile, in the case in which the movement of the object area in the input image is equal to or greater than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period.

Meanwhile, in the case in which the movement of the object area in the input image is equal to or greater than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as an eighth duty, which is less than the fourth duty, and adjust the level of current flowing in the light source as an eighth level, which is higher than the fourth level, during the first frame period.

Meanwhile, in the case in which the movement of the object area in the input image is less than a first reference value and the vertical synchronization frequency is a first frequency in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period.

Meanwhile, in the case in which the movement of the object area in the input image is less than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a ninth duty, which is less than the fifth duty, and adjust the level of current flowing in the light source as a ninth level, which is higher than the fifth level, during the first frame period.

Meanwhile, in the case in which the movement of the object area in the input image is less than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period.

Meanwhile, in the case in which the movement of the object area in the input image is less than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a tenth duty, which is less than the sixth duty, and adjust the level of current flowing in the light source as a tenth level, which is higher than the sixth level, during the first frame period.

Meanwhile, a processor according to an embodiment of the present disclosure may adjust the turn on duty of the light source corresponding to the background area decreases as the distance from the moving object area in the input image increases.

In accordance with another aspect of the present disclosure, there is provided an image display apparatus including an organic light emitting diode panel including a plurality of light sources, a light source driver configured to drive the organic light emitting diode panel, and a processor configured to control the light source driver, wherein the processor changes the turn on duty of a light source corresponding to a moving object area in an input image and changes the level of current flowing in the light source.

Meanwhile, in the case in which the movement of the object area in the input image is equal to or greater than a first reference value, a processor according to another embodiment of the present disclosure may decrease the turn on duty of the light source and may increase the level of current flowing in the light source.

Meanwhile, in the case in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a second duty, which is less than the first duty, and adjust the level of current flowing in the light source as a second level, which is higher than the first level, during a first frame period.

Meanwhile, a processor according to another embodiment of the present disclosure may perform control such that, as the movement of the object in the input image increases, the second duty decreases and the second level increases.

Meanwhile, in the case in which the turn on duty of a light source corresponding to a background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period.

Meanwhile, in the case in which the movement of the object area in the input image is equal to or greater than a first reference value in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a second duty, which is less than the first duty, and adjust the level of current flowing in the light source as a second level, which is higher than the first level, during the first frame period.

Meanwhile, in the case in which the movement of the object area in the input image is less than a first reference value in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period.

Meanwhile, a processor according to another embodiment of the present disclosure may increase the fifth duty and decrease the fifth level as the movement of the object in the input image decreases.

Meanwhile, in the case in which the movement of the object area in the input image is less than a first reference value in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period.

Meanwhile, in the case in which the movement of the object area in the input image is equal to or greater than a first reference value and the vertical synchronization frequency is a first frequency in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a second duty, which is less than the first duty, and adjust the level of current flowing in the light source as a second level, which is higher than the first level, during the first frame period.

Meanwhile, in the case in which the movement of the object area in the input image is equal to or greater than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a seventh duty, which is less than the second duty, and adjust the level of current flowing in the light source as a seventh level, which is higher than the second level, during the first frame period.

Meanwhile, in the case in which the movement of the object area in the input image is equal to or greater than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period.

Meanwhile, in the case in which the movement of the object area in the input image is equal to or greater than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as an eighth duty, which is less than the fourth duty, and adjust the level of current flowing in the light source as an eighth level, which is higher than the fourth level, during the first frame period.

Meanwhile, in the case in which the movement of the object area in the input image is less than a first reference value and the vertical synchronization frequency is a first frequency in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period.

Meanwhile, in the case in which the movement of the object area in the input image is less than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a ninth duty, which is less than the fifth duty, and adjust the level of current flowing in the light source as a ninth level, which is higher than the fifth level, during the first frame period.

Meanwhile, in the case in which the movement of the object area in the input image is less than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period.

Meanwhile, in the case in which the movement of the object area in the input image is less than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a tenth duty, which is less than the sixth duty, and adjust the level of current flowing in the light source as a tenth level, which is higher than the sixth level, during the first frame period.

Meanwhile, a processor according to another embodiment of the present disclosure may adjust the turn on duty of the light source corresponding to the background area decreases as the distance from the moving object area in the input image increases.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Hereinafter, the present disclosure will be described in detail with reference to the accompanying drawings.

With respect to constituent elements used in the following description, suffixes "module" and "unit" are given only in consideration of ease in preparation of the specification, and do not have or serve different meanings. Accordingly, the suffixes "module" and "unit" may be used interchangeably.

Figure 1:
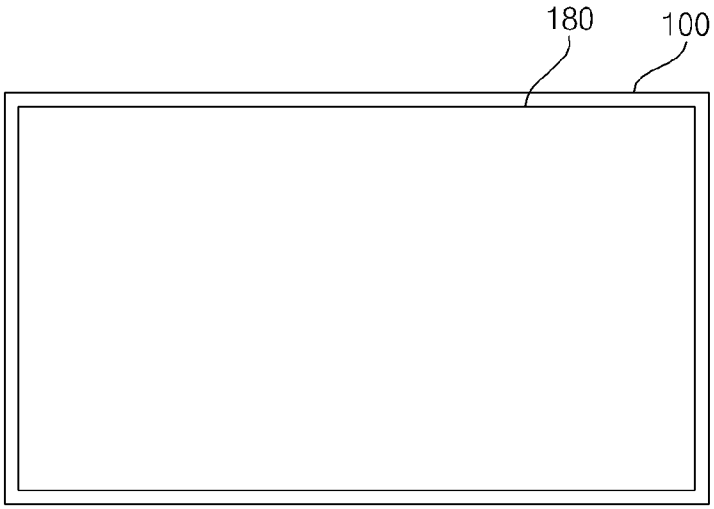
FIG. 1 is a diagram showing an image display apparatus according to an embodiment of the present disclosure.

FIG. 1 is a diagram showing an image display apparatus according to an embodiment of the present disclosure.

Referring to the figure, the image display apparatus 100 may include a display 180.

Meanwhile, the display 180 may be implemented with any one of various panels. For example, the display 180 may be any one of a liquid crystal display panel (LCD panel), an organic light emitting diode panel (OLED panel), and an inorganic light emitting diode panel (LED panel).

Meanwhile, in the case in which an image including a moving object is displayed, a phenomenon in which definition of the image is lowered depending on the movement of the object occurs.

In order to prevent this, conventionally, a black frame is inserted between image frames to improve definition of the image. In this scheme, however, overall luminance of the image is lowered.

In order to improve this, therefore, the present disclosure proposes a scheme for improving definition and luminance when displaying an image including a moving object.

To this end, in the case in which the display 180 includes a liquid crystal panel 210, an image display apparatus 100 according to an embodiment of the present disclosure includes a light source driver 256 configured to drive a plurality of light sources and a processor 1130 configured to control the light source driver 256 wherein the processor

1130 changes the turn on duty of a light source 252 corresponding to a moving object area Ara1 in an input image 910 and changes the level of current flowing in the light source. Consequently, the definition and luminance of an image including a moving object may be improved.

Meanwhile, in the light source in the case in which the movement of the object area Ara1 in the input image 910 is equal to or greater than a first reference value, a processor 1130 according to an embodiment of the present disclosure may decrease the turn on duty of the light source and may increase the level of current that flows. In particular, definition is improved due to a decrease in turn on duty, and luminance is improved due to an increase in the level of current.

Meanwhile, in the case in which the display 180 includes an organic light emitting diode panel 210*b*, which is a self-emissive panel, an image display apparatus 100 according to another embodiment of the present disclosure includes a light source driver 256 configured to drive the organic light emitting diode panel 210*b* and a processor 1130 configured to control the light source driver 256, wherein the processor 1130 may change the turn on duty of a light source corresponding to a moving object area Ara1 in an input image 910 and may change the level of current flowing in the light source. Consequently, the definition and luminance of an image including a moving object may be improved.

Meanwhile, in the case in which the movement of the object area Ara1 in the input image 910 is equal to or greater than a first reference value, a processor 1130 according to another embodiment of the present disclosure may decrease the turn on duty of the light source and may increase the level of current flowing in the light source. In particular, definition is improved due to a decrease in turn on duty, and luminance is improved due to an increase in the level of current.

Meanwhile, the image display apparatus 100 in FIG. 1 may be a TV, a monitor, a tablet PC, a mobile terminal, etc.

Figure 2:
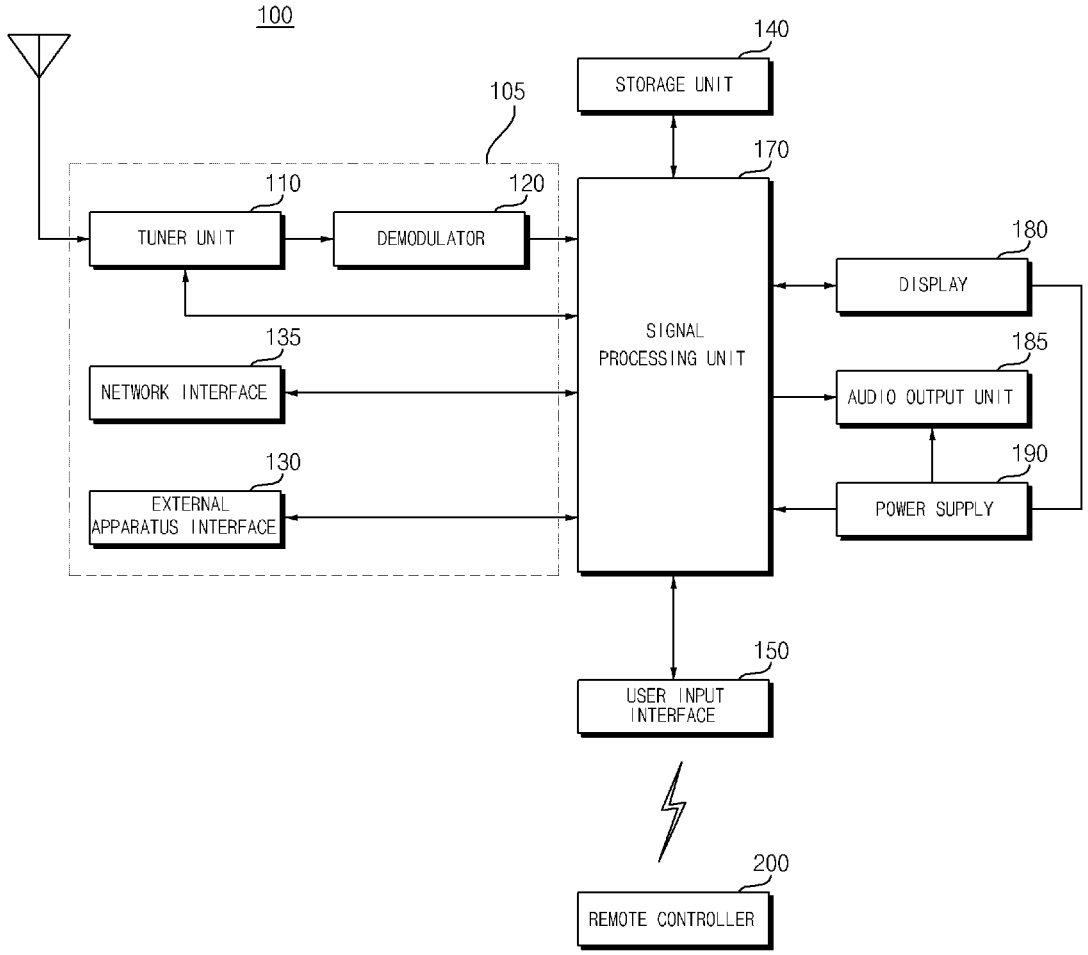
FIG. 2 is an example of an internal block diagram of the image display apparatus of FIG. 1.

FIG. 2 is an example of an internal block diagram of the image display apparatus of FIG. 1.

Referring to FIG. 2, an image display apparatus 100 according to an embodiment of the present disclosure includes an image receiving unit 105, an external apparatus interface 130, a storage unit 140, a user input interface 150, a sensor unit (not shown), a signal processor 170, a display 180, and an audio output unit 185.

The image receiving unit 105 may include a tuner unit 110, a demodulator 120, a network interface 135, and an external apparatus interface 130.

Meanwhile, unlike the drawing, the image receiving unit 105 may include only the tuner unit 110, the demodulator 120, and the external apparatus interface 130. That is, the network interface 135 may not be included.

The tuner unit 110 selects an RF broadcast signal corresponding to a channel selected by a user or all pre-stored channels among radio frequency (RF) broadcast signals received through an antenna (not shown). In addition, the selected RF broadcast signal is converted into an intermediate frequency signal, a baseband image, or an audio signal.

For example, if the selected RF broadcast signal is a digital broadcast signal, it is converted into a digital IF signal (DIF). If the selected RF broadcast signal is an analog broadcast signal, it is converted into an analog baseband image or audio signal (CVBS/SIF). That is, the tuner unit 110 can process a digital broadcast signal or an analog broadcast signal. The analog baseband image or audio signal (CVBS/SIF) output from the tuner unit 110 may be directly input to the signal processor 170.

Meanwhile, the tuner unit 110 can include a plurality of tuners for receiving broadcast signals of a plurality of channels. Alternatively, a single tuner that simultaneously receives broadcast signals of a plurality of channels is also available.

The demodulator 120 receives the converted digital IF signal DIF from the tuner unit 110 and performs a demodulation operation.

The demodulator 120 may perform demodulation and channel decoding and then output a stream signal TS. At this time, the stream signal may be a multiplexed signal of an image signal, an audio signal, or a data signal.

The stream signal output from the demodulator 120 may be input to the signal processor 170. The signal processor 170 performs demultiplexing, image/audio signal processing, and the like, and then outputs an image to the display 180 and outputs audio to the audio output unit 185.

The external apparatus interface 130 may transmit or receive data with a connected external apparatus (not shown), e.g., a set-top box 50. To this end, the external apparatus interface 130 may include an A/V input and output unit (not shown).

The external apparatus interface 130 may be connected in wired or wirelessly to an external apparatus such as a digital versatile disk (DVD), a Blu ray, a game equipment, a camera, a camcorder, a computer (note book), and a set-top box, and may perform an input/output operation with an external apparatus.

The A/V input and output unit may receive image and audio signals from an external apparatus. Meanwhile, a wireless communicator (not shown) may perform short-range wireless communication with other electronic apparatus.

Through the wireless communicator (not shown), the external apparatus interface 130 may exchange data with an adjacent mobile terminal 600. In particular, in a mirroring mode, the external apparatus interface 130 may receive device information, executed application information, application image, and the like from the mobile terminal 600.

The network interface 135 provides an interface for connecting the image display apparatus 100 to a wired/wireless network including the Internet network. For example, the network interface 135 may receive, via the network, content or data provided by the Internet, a content provider, or a network operator.

Meanwhile, the network interface 135 may include a wireless communicator (not shown).

The storage unit 140 may store a program for each signal processing and control in the signal processor 170, and may store signal-processed image, audio, or data signal.

In addition, the storage unit 140 may serve to temporarily store image, audio, or data signal input to the external apparatus interface 130. In addition, the storage unit 140 may store information on a certain broadcast channel through a channel memory function such as a channel map.

Although FIG. 2 illustrates that the storage unit is provided separately from the signal processor 170, the scope of the present disclosure is not limited thereto. The storage unit 140 may be included in the signal processor 170.

The user input interface 150 transmits a signal input by the user to the signal processor 170 or transmits a signal from the signal processor 170 to the user.

For example, it may transmit/receive a user input signal such as power on/off, channel selection, screen setting, etc., from a remote controller 200, may transfer a user input signal input from a local key (not shown) such as a power key, a channel key, a volume key, a set value, etc., to the signal processor 170, may transfer a user input signal input from a sensor unit (not shown) that senses a user's gesture to the signal processor 170, or may transmit a signal from the signal processor 170 to the sensor unit (not shown).

The signal processor 170 may demultiplex the input stream through the tuner unit 110, the demodulator 120, the network interface 135, or the external apparatus interface 130, or process the demultiplexed signals to generate and output a signal for image or audio output.

For example, the signal processor 170 receives a broadcast signal received by the image receiving unit 105 or an HDMI signal, and performs signal processing based on the received broadcast signal or the HDMI signal to thereby output a processed image signal.

The image signal processed by the signal processor 170 is input to the display 180, and may be displayed as an image corresponding to the image signal. In addition, the image signal processed by the signal processor 170 may be input to the external output apparatus through the external apparatus interface 130.

The audio signal processed by the signal processor 170 may be output to the audio output unit 185 as an audio signal. In addition, audio signal processed by the signal processor 170 may be input to the external output apparatus through the external apparatus interface 130.

Although not shown in FIG. 2, the signal processor 170 may include a demultiplexer, an image processor, and the like. That is, the signal processor 170 may perform a variety of signal processing and thus it may be implemented in the form of a system on chip (SOC). This will be described later with reference to FIG. 3.

In addition, the signal processor 170 can control the overall operation of the image display apparatus 100. For example, the signal processor 170 may control the tuner unit 110 to control the tuning of the RF broadcast corresponding to the channel selected by the user or the previously stored channel.

In addition, the signal processor 170 may control the image display apparatus 100 according to a user command input through the user input interface 150 or an internal program.

Meanwhile, the signal processor 170 may control the display 180 to display an image. At this time, the image displayed on the display 180 may be a still image or a moving image, and may be a 2D image or a 3D image.

Meanwhile, the signal processor 170 may display a certain object in an image displayed on the display 180. For example, the object may be at least one of a connected web screen (newspaper, magazine, etc.), an electronic program guide (EPG), various menus, a widget, an icon, a still image, a moving image, and a text.

Meanwhile, the signal processor 170 may recognize the position of the user based on the image photographed by a photographing unit (not shown). For example, the distance (z-axis coordinate) between a user and the image display apparatus 100 can be determined. In addition, the x-axis coordinate and the y-axis coordinate in the display 180 corresponding to a user position can be determined.

The display 180 generates a driving signal by converting an image signal, a data signal, an OSD signal, a control signal processed by the signal processor 170, an image signal, a data signal, a control signal, and the like received from the external apparatus interface 130.

Meanwhile, the display 180 may be configured as a touch screen and used as an input device in addition to an output device.

The audio output unit 185 receives a signal processed by the signal processor 170 and outputs it as an audio.

The photographing unit (not shown) photographs a user. The photographing unit (not shown) may be implemented by a single camera, but the present disclosure is not limited thereto and may be implemented by a plurality of cameras. Image information photographed by the photographing unit (not shown) may be input to the signal processor 170.

The signal processor 170 may sense a gesture of the user based on each of the images photographed by the photographing unit (not shown), the signals detected from the sensor unit (not shown), or a combination thereof.

The power supply 190 supplies corresponding power to the image display apparatus 100. Particularly, the power may be supplied to a controller 170 which can be implemented in the form of a system on chip (SOC), a display 180 for displaying an image, and an audio output unit 185 for outputting an audio.

Specifically, the power supply 190 may include a converter for converting an AC power into a DC power, and a DC/DC converter for converting the level of the DC power.

The remote controller 200 transmits the user input to the user input interface 150. To this end, the remote controller 200 may use Bluetooth, a radio frequency (RF) communication, an infrared (IR) communication, an Ultra Wideband (UWB), ZigBee, or the like. In addition, the remote controller 200 may receive the image, audio, or data signal output from the user input interface 150, and display it on the remote controller 200 or output it as an audio.

Meanwhile, the image display apparatus 100 may be a fixed or mobile digital broadcasting receiver capable of receiving digital broadcasting.

Meanwhile, a block diagram of the image display apparatus 100 shown in FIG. 2 is a block diagram for an embodiment of the present disclosure. Each component of the block diagram may be integrated, added, or omitted according to a specification of the image display apparatus 100 actually implemented. That is, two or more components may be combined into a single component as needed, or a single component may be divided into two or more components. The function performed in each block is described for the purpose of illustrating embodiments of the present disclosure, and specific operation and apparatus do not limit the scope of the present disclosure.

Figure 3:
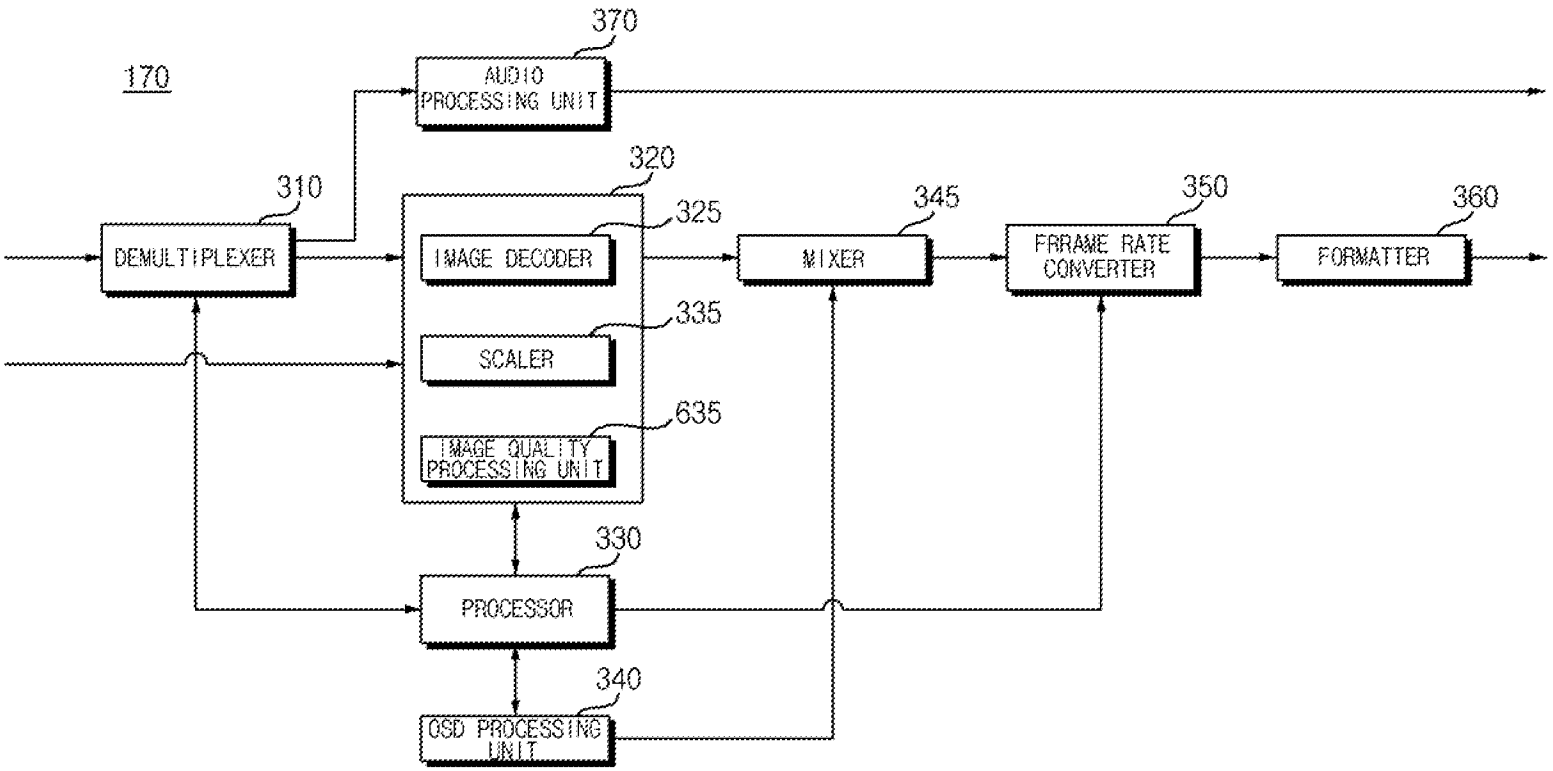
FIG. 3 is an example of an internal block diagram of a signal processor of FIG. 2.

FIG. 3 is an example of an internal block diagram of the signal processor of FIG. 2.

Referring to the figure, a signal processor 170 according to an embodiment of the present disclosure may include a demultiplexer 310, an image processor 320, a processor 330, and an audio processor 370. In addition, the signal processor 170 may further include and a data processor (not shown).

The demultiplexer 310 demultiplexes the input stream. For example, when an MPEG-2 TS is input, it can be demultiplexed into image, audio, and data signal, respectively. Here, the stream signal input to the demultiplexer 310 may be a stream signal output from the tuner unit 110, the demodulator 120, or the external apparatus interface 130.

The image processor 320 may perform signal processing on an input image. For example, the image processor 320 may perform image processing on an image signal demultiplexed by the demultiplexer 310.

To this end, the image processor 320 may include an image decoder 325, a scaler 335, an image quality processor 635, an image encoder (not shown), an OSD processor 340, a frame rate converter 350, a formatter 360, etc.

The image decoder 325 decodes a demultiplexed image signal, and the scaler 335 performs scaling so that the resolution of the decoded image signal can be output from the display 180.

The image decoder 325 can include a decoder of various standards. For example, a 3D image decoder for MPEG-2, H.264 decoder, a color image, and a depth image, and a decoder for a multiple view image may be provided.

The scaler 335 may scale an input image signal decoded by the image decoder 325 or the like.

For example, if the size or resolution of an input image signal is small, the scaler 335 may upscale the input image signal, and, if the size or resolution of the input image signal is great, the scaler 335 may downscale the input image signal.

The image quality processor 635 may perform image quality processing on an input image signal decoded by the image decoder 325 or the like.

For example, the image quality processor 625 may perform noise reduction processing on an input image signal, extend a resolution of high gray level of the input image signal, perform image resolution enhancement, perform high dynamic range (HDR)-based signal processing, change a frame rate, perform image quality processing suitable for properties of a panel, especially an OLED panel, etc.

The OSD processor 340 generates an OSD signal according to a user input or by itself. For example, based on a user input signal, the OSD processor 340 may generate a signal for displaying various information as a graphic or a text on the screen of the display 180. The generated OSD signal may include various data such as a user interface screen of the image display apparatus 100, various menu screens, a widget, and an icon. In addition, the generated OSD signal may include a 2D object or a 3D object.

In addition, the OSD processor 340 may generate a pointer that can be displayed on the display, based on a pointing signal input from the remote controller 200. In particular, such a pointer may be generated by a pointing signal processor, and the OSD processor 340 may include such a pointing signal processor (not shown). Obviously, the pointing signal processor (not shown) may be provided separately from the OSD processor 340.

The frame rate converter (FRC) 350 may convert the frame rate of an input image. Meanwhile, the frame rate converter 350 can also directly output the frame rate without any additional frame rate conversion.

Meanwhile, the formatter 360 may change a format of an input image signal into a format suitable for displaying the image signal on a display and output the image signal in the changed format.

In particular, the formatter 360 may change a format of an image signal to correspond to a display panel.

Meanwhile, the formatter 360 may change the format of the image signal. For example, it may change the format of the 3D image signal into any one of various 3D formats such as a side by side format, a top/down format, a frame sequential format, an interlaced format, a checker box format, and the like.

The processor 330 may control overall operations of the image display apparatus 100 or the signal processor 170.

For example, the processor 330 may control the tuner unit 110 to control the tuning of an RF broadcast corresponding to a channel selected by a user or a previously stored channel.

In addition, the processor 330 may control the image display apparatus 100 according to a user command input through the user input interface 150 or an internal program.

In addition, the processor 330 may transmit data to the network interface 135 or to the external apparatus interface 130.

In addition, the processor 330 may control the demultiplexer 310, the image processor 320, and the like in the signal processor 170.

Meanwhile, the audio processor 370 in the signal processor 170 may perform the audio processing of the demultiplexed audio signal. To this end, the audio processor 370 may include various decoders.

In addition, the audio processor 370 in the signal processor 170 may process a base, a treble, a volume control, and the like.

The data processor (not shown) in the signal processor 170 may perform data processing of the demultiplexed data signal. For example, when the demultiplexed data signal is a coded data signal, it can be decoded. The encoded data signal may be electronic program guide information including broadcast information such as a start time and an end time of a broadcast program broadcasted on each channel.

Meanwhile, a block diagram of the signal processor 170 shown in FIG. 3 is a block diagram for an embodiment of the present disclosure. Each component of the block diagram may be integrated, added, or omitted according to a specification of the signal processor 170 actually implemented.

In particular, the frame rate converter 350 and the formatter 360 may be provided separately in addition to the image processor 320.

Figure 4A:
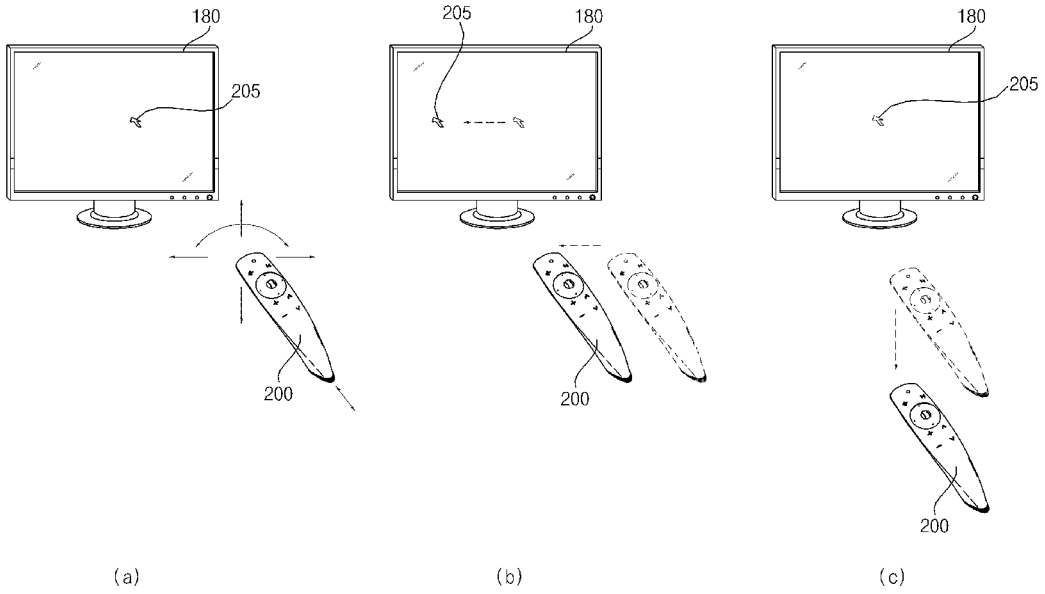
FIG. 4A is a diagram showing a control method of a remote controller of FIG. 2.

FIG. 4A is a diagram illustrating a control method of the remote controller of FIG. 2.

As shown in FIG. 4A(a), it is illustrated that a pointer 205 corresponding to the remote controller 200 is displayed on the display 180.

The user may move or rotate the remote controller 200 up and down, left and right (FIG. 4A(b)), and back and forth (FIG. 4A(c)). The pointer 205 displayed on the display 180 of the image display apparatus corresponds to the motion of the remote controller 200. Such a remote controller 200 may be referred to as a space remote controller or a 3D pointing apparatus, because the pointer 205 is moved and displayed according to the movement in a 3D space, as shown in the drawing.

FIG. 4A(b) illustrates that when the user moves the remote controller 200 to the left, the pointer 205 displayed on the display 180 of the image display apparatus also moves to the left correspondingly.

Information on the motion of the remote controller 200 detected through a sensor of the remote controller 200 is transmitted to the image display apparatus. The image display apparatus may calculate the coordinate of the pointer 205 from the information on the motion of the remote controller 200. The image display apparatus may display the pointer 205 to correspond to the calculated coordinate.

FIG. 4A(c) illustrates a case where the user moves the remote controller 200 away from the display 180 while pressing a specific button of the remote controller 200. Thus, a selection area within the display 180 corresponding to the pointer 205 may be zoomed in so that it can be displayed to be enlarged. On the other hand, when the user moves the remote controller 200 close to the display 180, the selection area within the display 180 corresponding to the pointer 205 may be zoomed out so that it can be displayed to be reduced. Meanwhile, when the remote controller 200 moves away from the display 180, the selection area may be zoomed out, and when the remote controller 200 approaches the display 180, the selection area may be zoomed in.

Meanwhile, when the specific button of the remote controller 200 is pressed, it is possible to exclude the recognition of vertical and lateral movement. That is, when the remote controller 200 moves away from or approaches the display 180, the up, down, left, and right movements are not recognized, and only the forward and backward movements are recognized. Only the pointer 205 is moved according to the up, down, left, and right movements of the remote controller 200 in a state where the specific button of the remote controller 200 is not pressed.

Meanwhile, the moving speed or the moving direction of the pointer 205 may correspond to the moving speed or the moving direction of the remote controller 200.

Figure 4B:
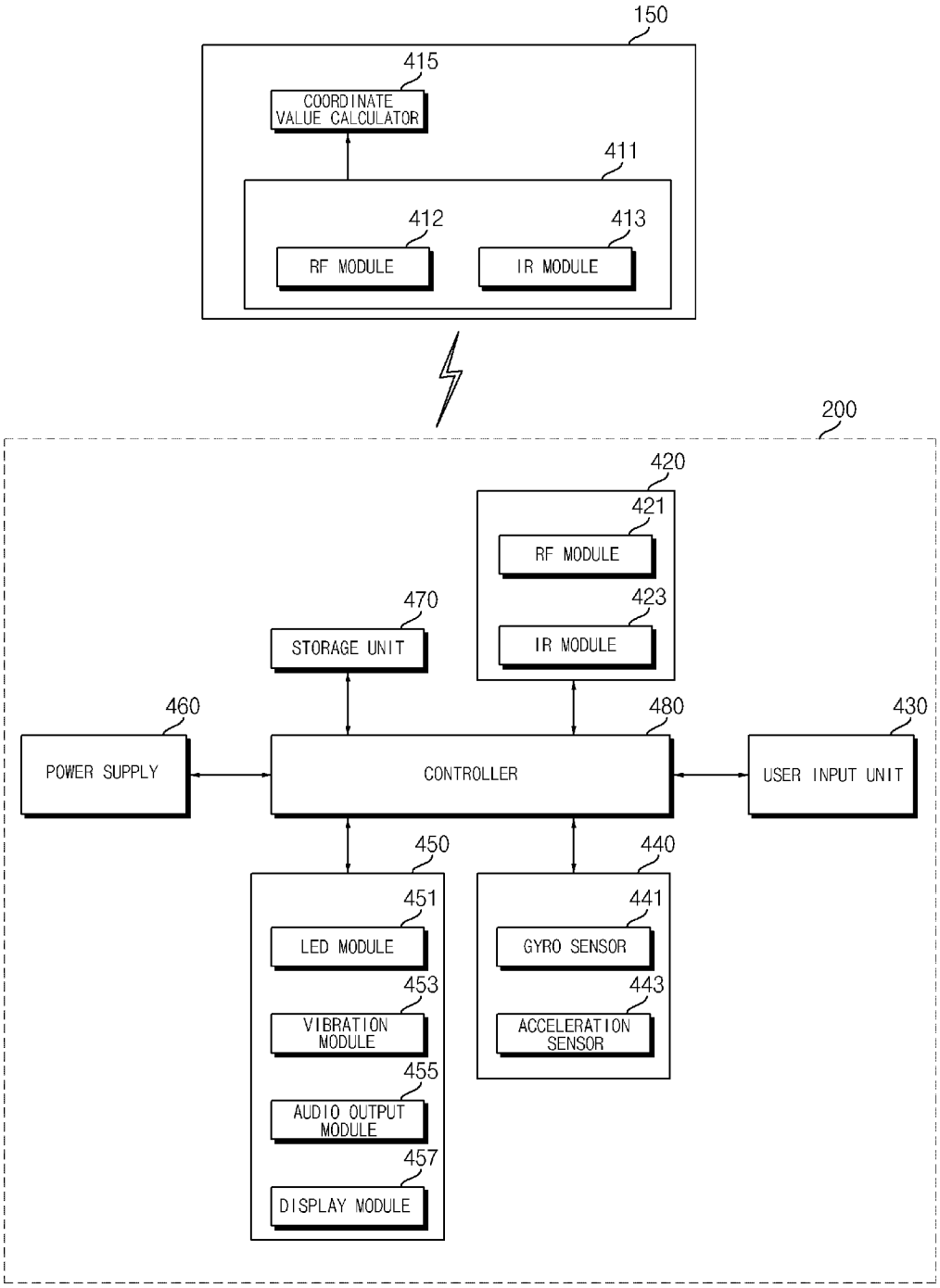
FIG. 4B is an internal block diagram of the remote controller of FIG. 2.

FIG. 4B is an internal block diagram of the remote controller of FIG. 2.

Referring to the figure, the remote controller 200 includes a wireless communicator 425, a user input unit 435, a sensor unit 440, an output unit 450, a power supply 460, a storage unit 470, and a controller 480.

The wireless communicator 425 transmits/receives a signal to/from any one of the image display apparatuses according to the embodiments of the present disclosure described above. Among the image display apparatuses according to the embodiments of the present disclosure, one image display apparatus 100 will be described as an example.

In the present embodiment, the remote controller 200 may include an RF module 421 for transmitting and receiving signals to and from the image display apparatus 100 according to a RF communication standard. In addition, the remote controller 200 may include an IR module 423 for transmitting and receiving signals to and from the image display apparatus 100 according to a IR communication standard.

In the present embodiment, the remote controller 200 transmits a signal containing information on the motion of the remote controller 200 to the image display apparatus 100 through the RF module 421.

In addition, the remote controller 200 may receive the signal transmitted by the image display apparatus 100 through the RF module 421. In addition, if necessary, the remote controller 200 may transmit a command related to power on/off, channel change, volume change, and the like to the image display apparatus 100 through the IR module 423.

The user input unit 435 may be implemented by a keypad, a button, a touch pad, a touch screen, or the like. The user may operate the user input unit 435 to input a command related to the image display apparatus 100 to the remote controller 200. When the user input unit 435 includes a hard key button, the user can input a command related to the image display apparatus 100 to the remote controller 200 through a push operation of the hard key button. When the user input unit 435 includes a touch screen, the user may touch a soft key of the touch screen to input the command related to the image display apparatus 100 to the remote controller 200. In addition, the user input unit 435 may include various types of input means such as a scroll key, a jog key, etc., which can be operated by the user, and the present disclosure does not limit the scope of the present disclosure.

The sensor unit 440 may include a gyro sensor 441 or an acceleration sensor 443. The gyro sensor 441 may sense information about the motion of the remote controller 200.

For example, the gyro sensor 441 may sense information on the operation of the remote controller 200 based on the x, y, and z axes. The acceleration sensor 443 may sense information on the moving speed of the remote controller 200. Meanwhile, a distance measuring sensor may be further provided, and thus, the distance to the display 180 may be sensed.

The output unit 450 may output an image or an audio signal corresponding to the operation of the user input unit 435 or a signal transmitted from the image display apparatus 100. Through the output unit 450, the user may recognize whether the user input unit 435 is operated or whether the image display apparatus 100 is controlled.

For example, the output unit 450 may include an LED module 451 that is turned on when the user input unit 435 is operated or a signal is transmitted/received to/from the image display apparatus 100 through the wireless communicator 425, a vibration module 453 for generating a vibration, an audio output module 455 for outputting an audio, or a display module 457 for outputting an image.

The power supply 460 supplies power to the remote controller 200. When the remote controller 200 is not moved for a certain time, the power supply 460 may stop the supply of power to reduce a power waste. The power supply 460 may resume power supply when a certain key provided in the remote controller 200 is operated.

The storage unit 470 may store various types of programs, application data, and the like necessary for the control or operation of the remote controller 200. If the remote controller 200 wirelessly transmits and receives a signal to/from the image display apparatus 100 through the RF module 421, the remote controller 200 and the image display apparatus 100 transmit and receive a signal through a certain frequency band. The controller 480 of the remote controller 200 may store information about a frequency band or the like for wirelessly transmitting and receiving a signal to/from the image display apparatus 100 paired with the remote controller 200 in the storage unit 470 and may refer to the stored information.

The controller 480 controls various matters related to the control of the remote controller 200. The controller 480 may transmit a signal corresponding to a certain key operation of the user input unit 435 or a signal corresponding to the motion of the remote controller 200 sensed by the sensor unit 440 to the image display apparatus 100 through the wireless communicator 425.

The user input interface 150 of the image display apparatus 100 includes a wireless communicator 151 that can wirelessly transmit and receive a signal to and from the remote controller 200 and a coordinate value calculator 415 that can calculate the coordinate value of a pointer corresponding to the operation of the remote controller 200.

The user input interface 150 may wirelessly transmit and receive a signal to and from the remote controller 200 through the RF module 412. In addition, the user input interface 150 may receive a signal transmitted by the remote controller 200 through the IR module 413 according to a IR communication standard.

The coordinate value calculator 415 may correct a hand shake or an error from a signal corresponding to the operation of the remote controller 200 received through the wireless communicator 151 and calculate the coordinate value (x, y) of the pointer 205 to be displayed on the display 180.

The transmission signal of the remote controller 200 inputted to the image display apparatus 100 through the user input interface 150 is transmitted to the controller 180 of the image display apparatus 100. The controller 180 may determine the information on the operation of the remote controller 200 and the key operation from the signal transmitted from the remote controller 200, and, correspondingly, control the image display apparatus 100.

For another example, the remote controller 200 may calculate the pointer coordinate value corresponding to the operation and output it to the user input interface 150 of the image display apparatus 100. In this case, the user input interface 150 of the image display apparatus 100 may transmit information on the received pointer coordinate value to the controller 180 without a separate correction process of hand shake or error.

For another example, unlike the drawing, the coordinate value calculator 415 may be provided in the signal processor 170, not in the user input interface 150.

Figure 5:
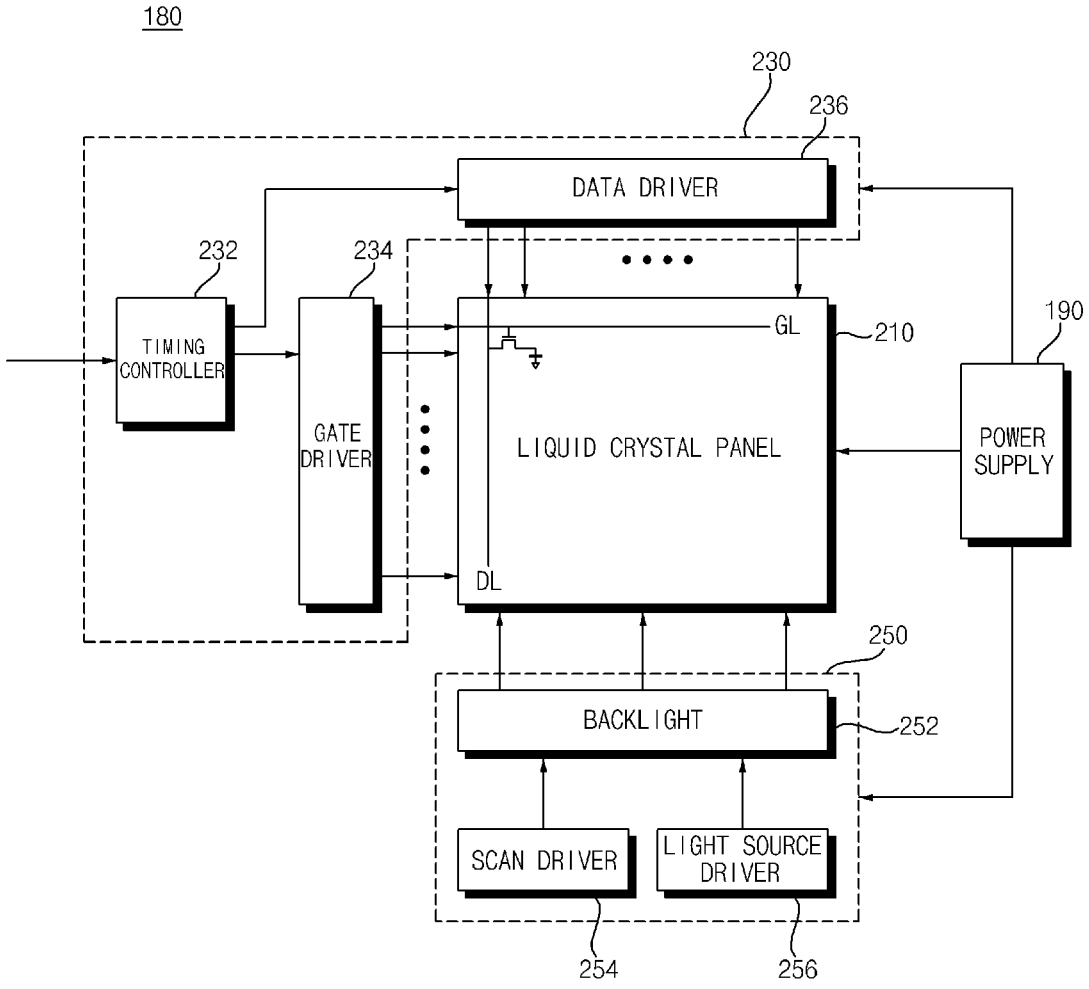
FIG. 5 is an example of an internal block diagram of a display of FIG. 2.

FIG. 5 is an example of an internal block diagram of the display of FIG. 2.

Referring to the figure, a liquid crystal display panel (LCD panel)-based display 180 may include a liquid crystal panel 210, a driving circuit unit 230, and a backlight unit 250.

The liquid crystal panel 210 includes a first substrate in which a plurality of gate lines GL and a plurality of data lines DL are disposed so as to intersect each other in a matrix form and a thin film transistor and a pixel electrode connected thereto are formed at each intersection, a second substrate having a common electrode, and a liquid crystal layer formed between the first substrate and the second substrate.

The driving circuit unit 230 drives the liquid crystal panel 210 based on a control signal and a data signal supplied from a second controller 175 of FIG. 2. To this end, the driving circuit unit 230 includes a timing controller 232, a gate driver 234, and a data driver 236.

Upon receiving a control signal, RGB data signals, and a vertical synchronization signal Vsync from the second controller 175, the timing controller 232 controls the gate driver 234 and the data driver 236 in response to the control signal, relocates the RGB data signals, and provides the relocated RGB data signals to the data driver 236.

Under control of and the timing controller 232, the gate driver 234 and the data driver 236 supply a scanning signal and an image signal to the liquid crystal panel 210 via the gate lines GL and the data line DL.

The backlight unit 250 supplies light to the liquid crystal panel 210. To this end, the backlight unit 250 may include a backlight 252 including a plurality of light sources, a scan driver 254 configured to control scanning driving of the backlight 252, and a light source driver 256 configured to turn the backlight 252 on/off.

A predetermined image is displayed using light emitted from the backlight unit 250 in the state in which light transmittance of the liquid crystal layer is adjusted due to an electric field formed between the pixel electrodes of the liquid crystal panel 210 and the common electrode.

The power supply 190 may supply common electrode voltage Vcom to the liquid crystal panel 210 and may supply gamma voltage to the data driver 236. In addition, the power supply 190 may supply driving power for driving the backlight 252 to the backlight unit 250.

Figure 6A:
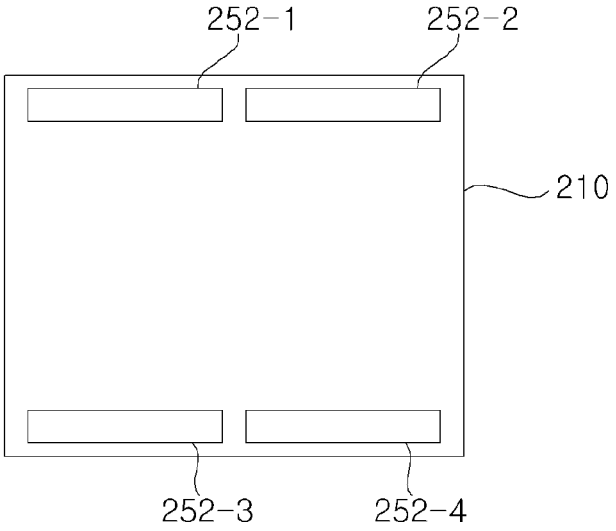
FIGS. 6A to 6C are diagrams illustrating various examples of the arrangement of a backlight of FIG. 5.
Figure 6B:
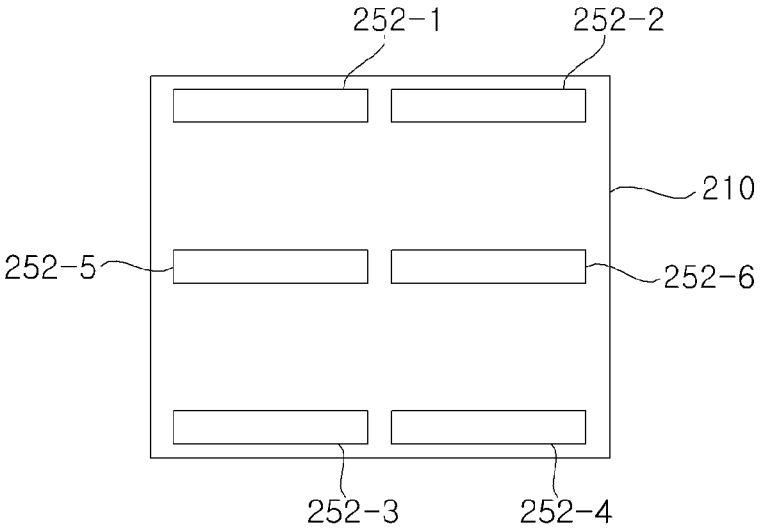
Figure 6C:
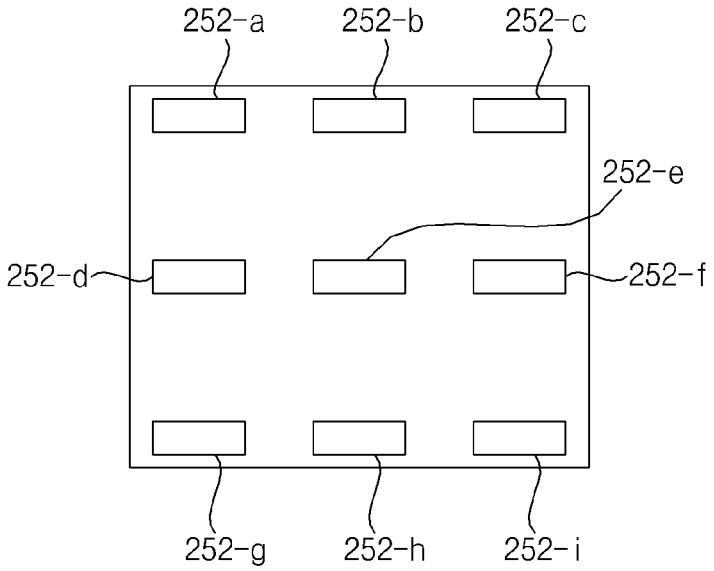

FIGS. 6A to 6C are diagrams illustrating various examples of the arrangement of the backlight of FIG. 5.

First, FIG. 6A illustrates a plurality of light sources 252-1, 252-2, 252-3, and 252-4 disposed at the upper side and the lower side of the rear surface of the liquid crystal panel 210. Each of the plurality of light sources 252-1, 252-2, 252-3, and 252-4 may include a plurality of light emitting diodes (LEDs).

Next, FIG. 6B illustrates a plurality of light sources 252-1, 252-2, 252-3, 252-4, 252-5, and 252-6 disposed at the upper side, the lower side, and the middle of the rear surface of the liquid crystal panel 210. Each of the plurality of light sources 252-1, 252-2, 252-3, 252-4, 252-5, and 252-6 may include a plurality of light emitting diodes (LEDs).

Next, FIG. 6C illustrates a plurality of light sources **252-*a*, 252-*b*, and 252-*c* disposed at the upper side, a plurality of light sources 252-*g*, 252-*h*, and 252-*i* disposed at the lower side, and a plurality of light sources 252-*d*, 252-*e*, and 252-*f* disposed at the middle of the rear surface of the liquid crystal panel 210**. Each light source may include a plurality of light emitting diodes (LEDs).

Figure 7:
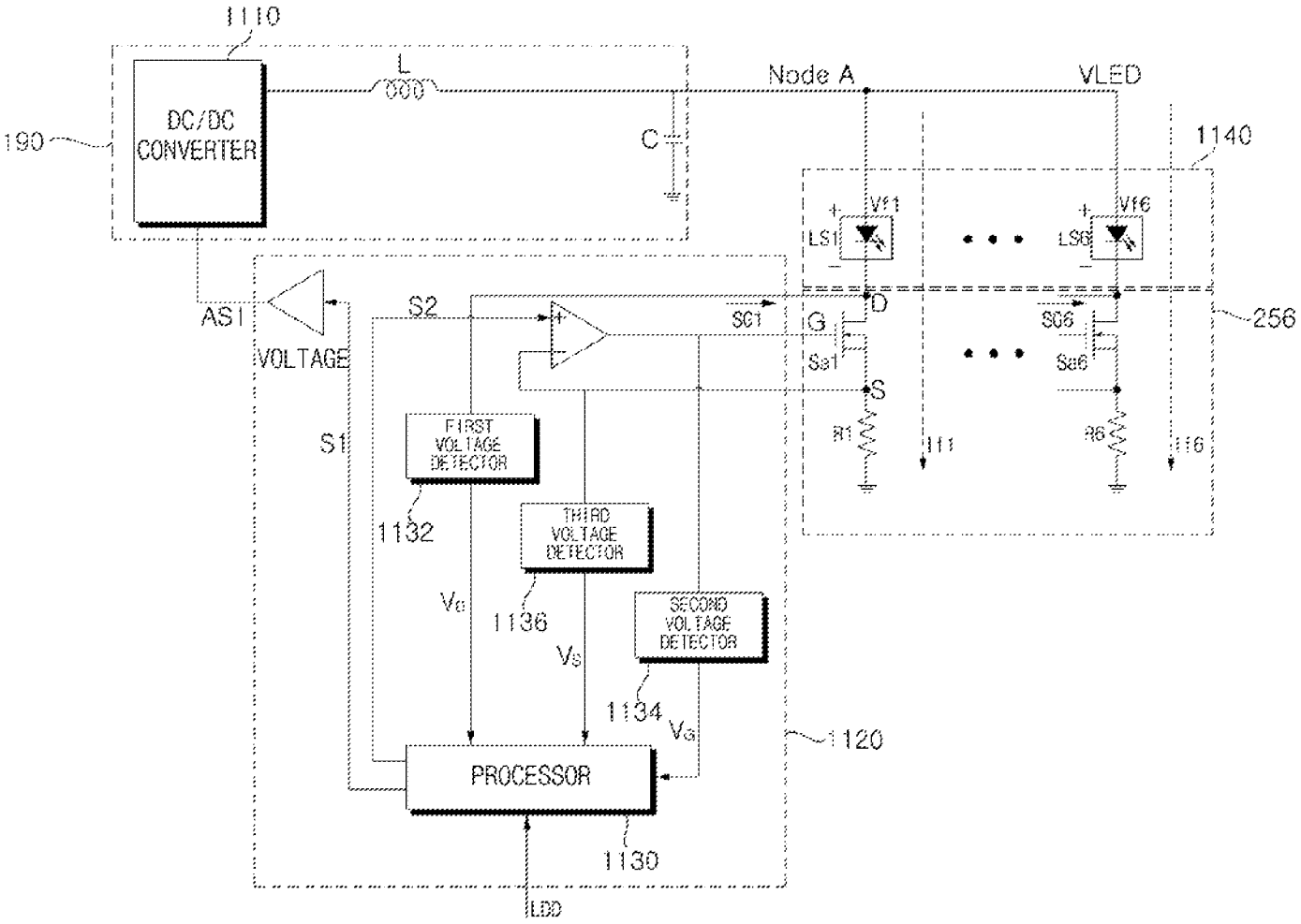
FIG. 7 is an example of a circuit diagram of a backlight unit of FIG. 5.

FIG. 7 is an example of a circuit diagram of the backlight unit of FIG. 5.

Referring to the figure, the backlight unit 250 may include a plurality of light sources LS1 to LS6 (1140) connected to each other in parallel, a light source driver 256 configured to drive the plurality of plurality of light sources LS1 to LS6 (1140), and a processor 1120 configured to control the light source driver 256.

Meanwhile, the backlight unit 250 may further include a power supply 190 configured to supply common power VLED to the plurality of light sources LS1 to LS6 (1140).

Here, each of the light sources LS1 to LS6 may include a plurality of LEDs connected to each other in series, in parallel, or in series and parallel.

As described above, as the resolution of the image display apparatus 100 increases to high definition (HD), full HD, ultra-high definition (UHD), 4K, and 8K, the number of LEDs may be increased.

Meanwhile, in the case in which a high-resolution panel 210 is used, control may be performed such that current If having a changed level flows to each of the light source strings 252-1 to 252-5, among the plurality of light sources 252, based on local dimming data in order to improve contrast or definition.

According to this, current If having a changed level flows in proportion to the local dimming data, whereby light having different luminance is output for each of the light source strings 252-1 to 252-5 based on the local dimming data.

Consequently, luminance in a bright portion is brighter and luminance in a dark portion is darker due to current If having an increased level. As a result, contrast or definition may be improved at the time of displaying an image.

The power supply 190 outputs common voltage VLED to the plurality of light sources. To this end, the power supply 190 may include a DC/DC converter 1110 configured to convert the level of DC power and to output DC power having the converted level, an inductor L configured to remove harmonics, etc., and a capacitor C configured to store the DC power.

Voltage at the opposite ends of the capacitor C corresponds to voltage supplied between node A and a ground terminal, which may correspond to voltage applied to the plurality of light sources LS1 to LS6 (1140), a plurality of switching devices Sa1 to Sa6, and resistors R1 to R6. That is, voltage at node A is common voltage that is supplied to the plurality of light sources LS1 to LS6, and may be referred to as voltage VLED, as shown in the figure.

Voltage VLED is equal to the sum of driving voltage Vf1 of the first light source string LS1, voltage at opposite ends of the first switching device Sa1, and voltage consumed by the first resistor R1.

Alternatively, voltage VLED is equal to the sum of driving voltage Vf1 of the second light source string LS2, voltage at opposite ends of the second switching device Sa2, and voltage consumed by the second resistor R2. Alternatively, voltage VLED is equal to the sum of driving voltage Vf1 of the sixth light source string LS6, voltage at opposite ends of the sixth switching device Sa6, and voltage consumed by the n-th resistor Rn.

Meanwhile, as the resolution of the panel 210 increases, backlight driving voltages Vf1 to Vf6 increase, whereby driving currents If1 to If6 that flow in the backlight increase. Consequently, power consumed by the plurality of switching devices Sa1 to Sa6 and the resistors R1 to R6 increases, whereby stress of the plurality of switching devices Sa1 to Sa6 and the resistors R1 to R6 also increases.

In order to reduce power consumption at the time of driving the backlight, the driving currents If1 to If6 that flow in the plurality of switching devices Sa1 to Sa6 and the resistors R1 to R6 may be reduced. At this time, it is assumed that the backlight driving voltages Vf1 to Vf6 are uniform.

To this end, the driving controller 1120 includes a first voltage detector 1132 configured to detect voltage VD of a drain terminal D of each of the plurality of switching devices Sa1 to Sa6, each of which is implemented with an FET. The driving controller 1120 may further include a second voltage detector 1134 configured to detect voltage VG of each gate terminal G and a third voltage detector 1136 configured to detect voltage VS of each source terminal S.

The driving controller 1120 may compare the drain terminal voltages VD detected at the drain terminals D of the plurality of switching devices Sa1 to Sa6, may generate a target driving current flowing in the plurality of light sources 1140 based on the lowest drain terminal voltage, and may output a switching control signal SG corresponding to the generated target driving current.

The switching control signal SG is input to a comparator, and, when greater than the voltage VD of a detected source terminal, is output from the comparator and is input to the gate terminal G. As a result, the switching device is driven based on the switching control signal SG.

Meanwhile, in order to generate such a switching control signal, the driving controller 1120 may include a processor 1130 configured to generate a switching control signal for driving the gate electrode of each of the plurality of switching devices Sa1 to Sa6 based on the drain terminal voltage of each of the plurality of switching devices Sa1 to Sa6.

Meanwhile, the processor 1130 may control the light source driver 256. Specifically, the processor 1130 may change the turn on duty of each of the plurality of switching devices Sa1 to Sa6 or the level of current flowing in each of the plurality of switching devices Sa1 to Sa6.

In particular, the processor 1130 may adjust the turn on duty of each of the plurality of light sources LS1 to LS6 or the level of current flowing in each of the plurality of light sources LS1 to LS6 is changed.

For example, the processor 1130 may change the level of the switching control signal SG based on the magnitude of the drain terminal voltage VD of each of the plurality of switching devices Sa1 to Sa6.

Meanwhile, the processor 1130 may change the level of the switching control signal SG or the duty of the switching control signal SG based on the magnitude of the drain terminal voltage VD of each of the plurality of switching devices Sa1 to Sa6.

Meanwhile, the processor 1130 may perform control such that current If having a changed level sequentially flows to each of the plurality of light sources 252-1 to 252-6, among the plurality of light sources 252, based on local dimming data.

Meanwhile, the processor 1130 may perform increase the level of current If flowing to each of the light sources 252-1 to 252-6, as the level of local dimming data increases, and decrease the level of current If flowing to each of the light sources 252-1 to 252-6, as the level of local dimming data decreases.

Meanwhile, the processor 1130 may perform control such that the level of common voltage output from the power supply is uniform for each frame.

FIGS. 8A to 8D are diagrams referred to in the description of image display by black frame insertion.

Figure 8A:
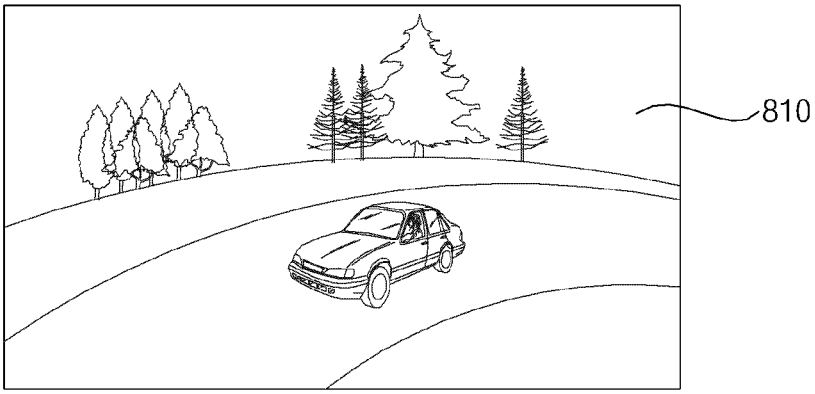
FIGS. 8A to 8D are diagrams referred to in the description of image display by black frame insertion.

First, FIG. 8A illustrates an example of an input image 810 in which a vehicle moves.

Figure 8B:
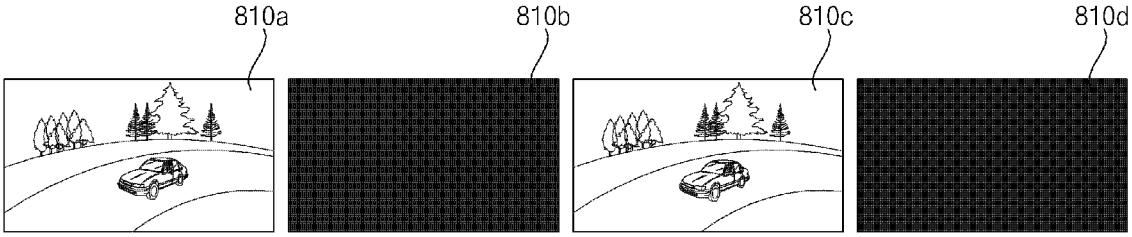

In order to prevent a phenomenon in which definition is lowered depending on the movement of the vehicle at the time of displaying the input image 810 in which the vehicle moves, as shown in FIG. 8A, a black frame may be inserted between image frames, as shown in FIG. 8B.

FIG. 8B illustrates that a second image frame 810*b* following a first image frame 810*a* is set as a black frame and a fourth image frame 810*d* following a third image frame 810*c* is set as a black frame.

Meanwhile, 8D illustrates the plurality of image frames 810*a* to 810*d* and the turn on duty of the light source in response to a vertical synchronization frequency of 120 Hz.

The turn on duty of the light source may be Wa1 in order to display the first image frame 810*a* and the third image frame 810*c*, and the turn on duty of the light source may be Wa2, which is much smaller than Wa1, in order to display the second image frame 810*b* and the fourth image frame 810*d*, which are black frames.

Figure 8C:
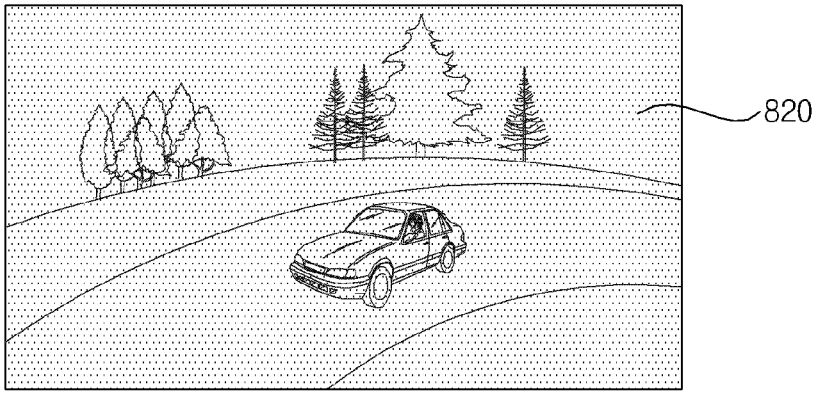
Figure 8D:
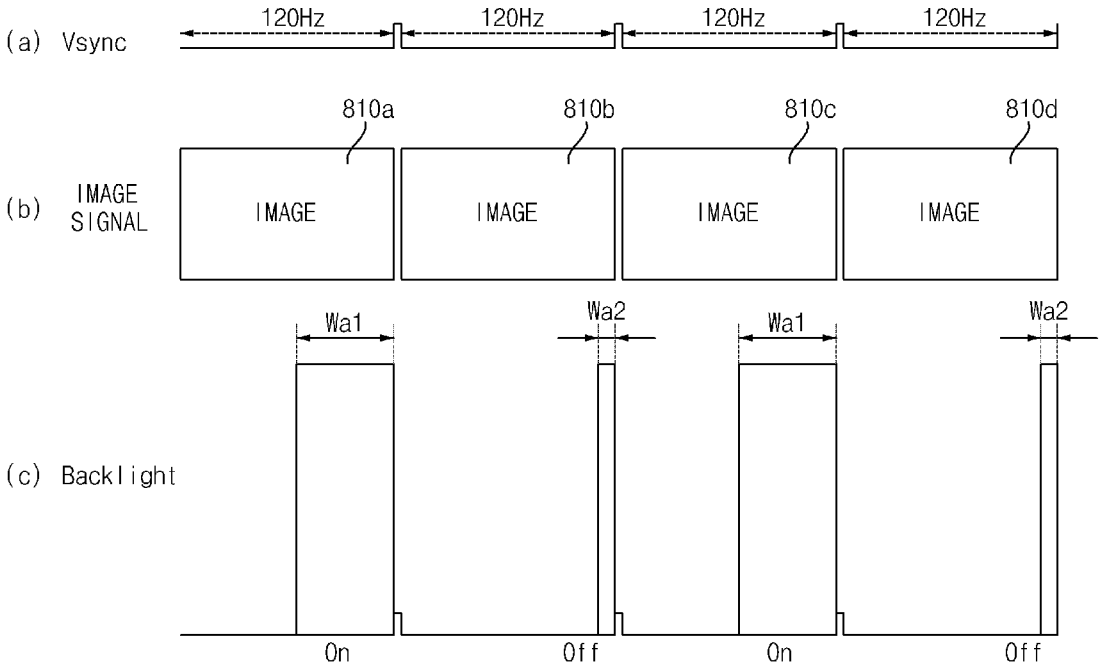

In the case in which image signal processing is performed, as described above, luminance of an image displayed on the image display apparatus may be lowered due to addition of the black frames, as shown in FIG. 8C. In addition, a black frame must be added between respective image frames.

In order to improve this, the present disclosure proposes a scheme for improving definition and luminance at the time of displaying an image including a moving object. This will be described hereinafter with reference to FIG. 9A and subsequent figures.

Figure 9A:
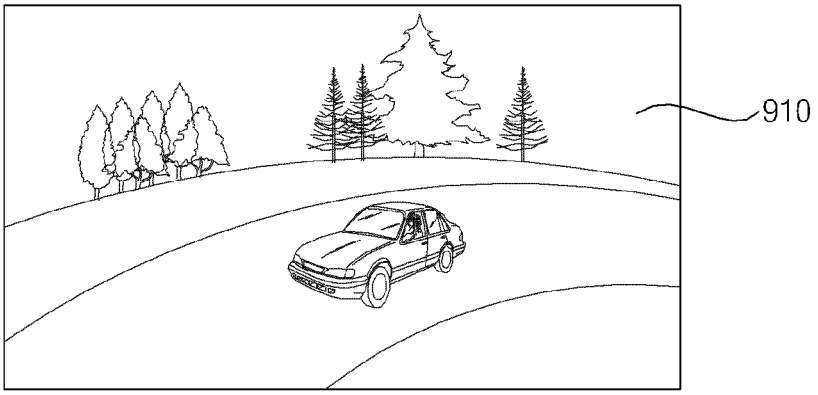
FIGS. 9A to 9F are diagrams referred to in the description of image display according to an embodiment of the present disclosure.

FIGS. 9A to 9F are diagrams referred to in the description of image display according to an embodiment of the present disclosure First, FIG. 9A illustrates an input image 910 including a moving object.

Figure 9B:
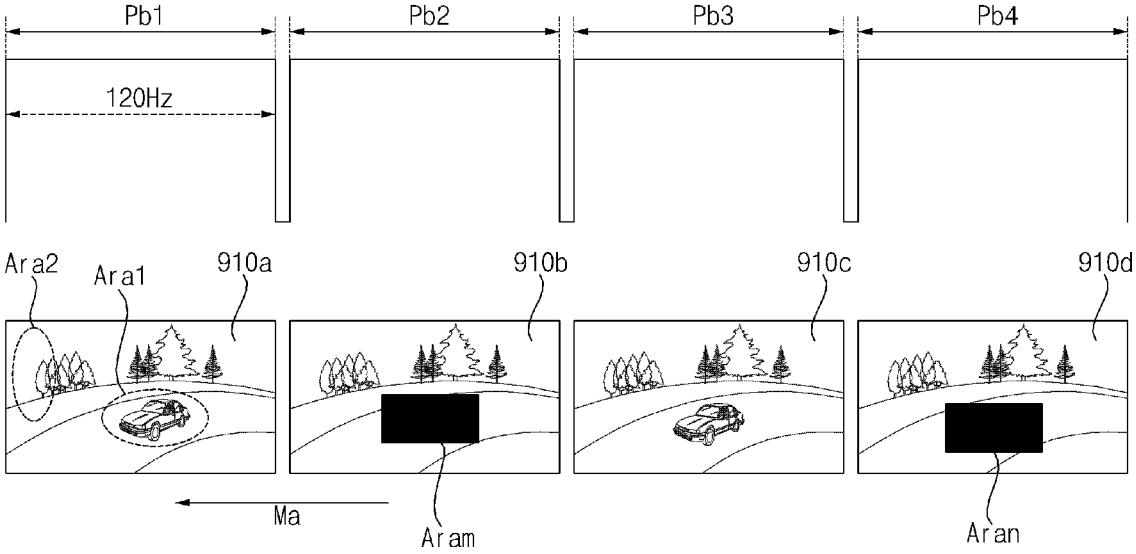

FIG. 9B illustrates a plurality of image frames 910*a*, 910*b*, 910*c*, and 910*d* for displaying the input image 910 including the moving object.

FIG. 9B illustrates that the movement Ma of an object Ara1 between the first image frame 910*a* and the second image frame 910*b* is equal to or greater than a reference value.

The object Ara1 in the first to fourth image frames 910*a*, 910*b*, 910*c*, and 910*d* may sequentially move to the left, and the first to fourth image frames 910*a*, 910*b*, 910*c*, and 910*d* may be sequentially displayed.

Particularly, in the case in which the vertical synchronization frequency is 120 Hz, each of the first to fourth image frames 910*a*, 910*b*, 910*c*, and 910*d* may be displayed in response to a vertical synchronization frequency of 120 Hz.

For example, the first image 910*a* is displayed during a first frame period Pb1, the second image 910*b* is displayed during a second frame period Pb2, the third image 910*c* is displayed during a third frame period Pb3, and the fourth image 910*d* is displayed during a fourth frame period Pb4.

At this time, a vehicle, which is the moving object in the first to fourth image frames 910*a*, 910*b*, 910*c*, and 910*d*, may be displayed without change in the image output to and displayed on the panel 210, unlike FIG. 9B.

Also, in order to improve definition, the light source located at the position corresponding to the moving object Ara1, i.e. the vehicle, among the plurality of light sources that output light to the panel 210, may be turned off.

In particular, the light source located at the position corresponding to the moving object Ara1, i.e. the vehicle, may be alternately turned off.

Figure 9C:
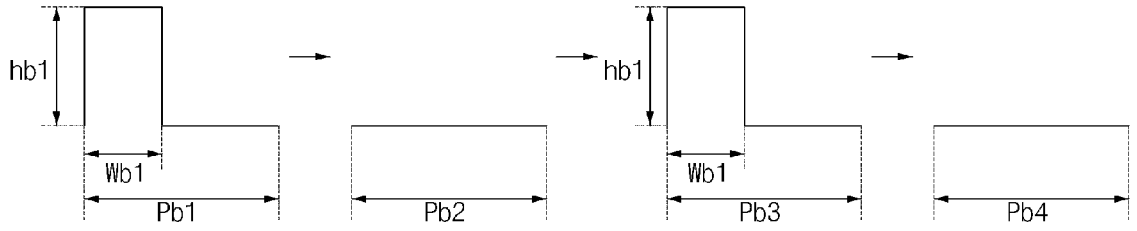

FIG. 9C illustrates that the light source located at the position corresponding to the moving object Ara1, i.e. the vehicle, is turned on during the first frame period Pb1 and the third frame period Pb3 but is turned off during the second frame period Pb2 and the fourth frame period Pb4, which follow the first frame period Pb1 and the third frame period Pb3, respectively.

In particular, FIG. 9C illustrates that the turn on duty of the light source located at the position corresponding to the moving object Ara1, i.e. the vehicle, is a first duty Wb1 and the level of current flowing in the light source is a first level hb1 during the first frame period Pb1 and the third frame period Pb3.

As shown in FIG. 9B, therefore, the moving object Ara1, i.e. the vehicle, is displayed properly during the first frame period Pb1 and the third frame period Pb3, and the moving object Ara1, i.e. the vehicle, is displayed as a black area during the second frame period Pb2 and the fourth frame period Pb4.

Even in the method of FIG. 9C, however, overall luminance of the image may be lowered due to turn off of the light source during the second frame period Pb2 and the fourth frame period Pb4. That is, luminance is higher than FIG. 8C, but overall luminance of the image may be lowered.

In the present disclosure, therefore, the turn on duty of the light source located at the position corresponding to the moving object Ara1, i.e. the vehicle, and the level of current flowing in the light source are changed during the first frame period Pb1 and the third frame period Pb3 in consideration of turn off of the light source during second frame period Pb2 and the fourth frame period Pb4.

For example, in the case in which the movement of the object area Ara1 in the input image is equal to or greater than a first reference value, a processor 1130 according to an embodiment of the present disclosure may decrease the turn on duty of the light source and may increase the level of current flowing in the light source. In particular, definition is improved due to a decrease in turn on duty, and luminance is improved due to an increase in the level of current.

Figure 9D:
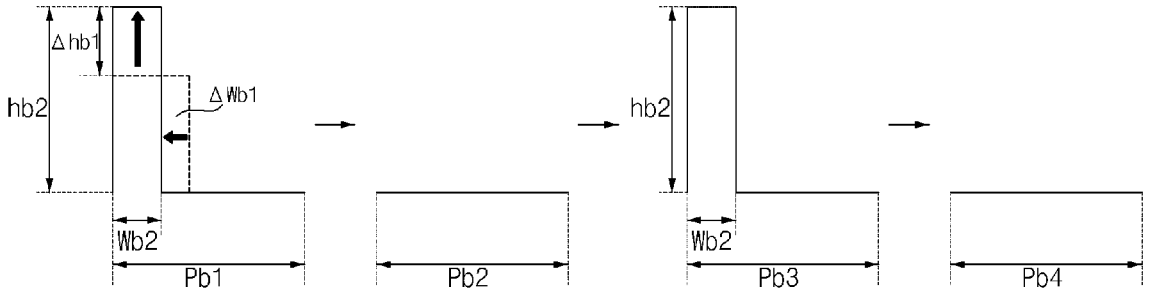

Specifically, in the case in which the turn on duty of the light source corresponding to the object area Ara1 in the input image is set to a first duty Wb1 and the level of current flowing in the light source is set to a first level hb1, a processor 1130 according to an embodiment of the present disclosure may adjust the turn on duty of the light source corresponding to the object area Ara1 in the input image as a second duty Wb2, which is less than the first duty Wb1, and adjust the level of current flowing in the light source as a second level hb2, which is higher than the first level hb1, during the first frame period Pb1 and the third frame period Pb3, as shown in FIG. 9D. Consequently, the definition and luminance of an image including a moving object may be improved.

More specifically, in the case in which the movement Ma of the object area Ara1 in the input image is equal to or greater than a first reference value in the state in which the turn on duty of the light source corresponding to the object area Ara1 in the input image is set to a first duty Wb1 and the level of current flowing in the light source is set to a first level hb1, a processor 1130 according to an embodiment of the present disclosure may adjust the turn on duty of the light source corresponding to the object area Ara1 in the input image as a second duty Wb2, which is less than the first duty Wb1, and adjust the level of current flowing in the light source as a second level hb2, which is higher than the first level hb1, during the first frame period Pb1 and the third frame period Pb3, as shown in FIG. 9D. Consequently, the definition and luminance of an image including a moving object may be improved.

FIG. 9D illustrates adjusting the turn on duty of the light source corresponding to the object area Ara1 is a second duty Wb2, which is less than the first duty Wb1, and adjusting the level of current flowing in the light source as a second level hb2, which is higher than the first level hb1, during the first frame period Pb1 and the third frame period Pb3.

At this time, the difference between the first duty Wb1 and the second duty Wb2 is ΔWb1, and the difference between the second level hb2 and the first level hb1 is Δhb1.

Meanwhile, a processor 1130 according to an embodiment of the present disclosure may decrease the second duty Wb2 and increase the second level hb2, as the movement of the object in the input image increases. That is, definition and luminance may be improved depending on the extent of movement of the object.

Meanwhile, the processor 1130 may adjust the turn on duty of the light source corresponding to the object area Ara1 in the input image as zero or as a value equal to or less than the lowest limit value and adjust the level of current flowing in the light source as zero or as a value equal to or less than the lowest limit value during the second frame period Pb2 and the fourth frame period Pb4, which follow the first frame period Pb1 and the third frame period Pb3, respectively, as shown in FIG. 9D.

Figure 9E:
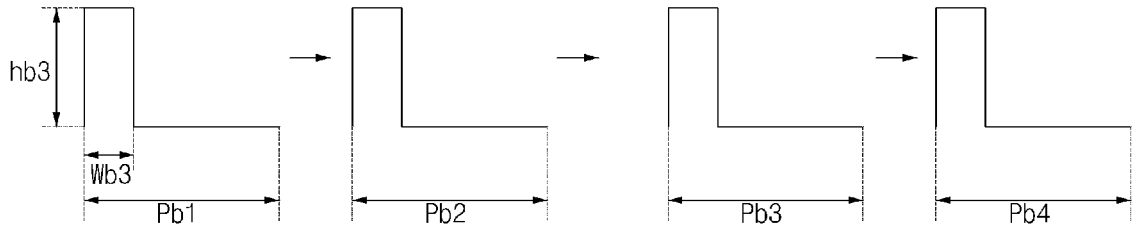

FIG. 9E illustrates that the light source located at the position corresponding to a background area Ara2 is continuously turned on during the first frame period Pb1 to the fourth frame period Pb4.

In particular, the light source is also turned on during the second frame period Pb2 and the fourth frame period Pb4, unlike FIG. 9C.

Meanwhile, FIG. 9E illustrates that the turn on duty of the light source located at the position corresponding to the background area Ara2 is a third duty Wb3, which is less than the first duty Wb1, and the level of current flowing in the light source located at the position corresponding to the background area Ara2 is a third level hb3, which is lower than the first level hb1.

Meanwhile, since the turn on duty of the light source corresponding to the object area Ara1 in the input image and the level of current flowing in the light source are changed in order to improve the definition and luminance of the image, as shown in FIG. 9D, the turn on duty of the light source located at the position corresponding to the background area Ara2 and the level of current flowing in the light source may be changed.

The turn on duty of the light source located at the position corresponding to the background area Ara2 may be adjusted in response to a variation in turn on duty of the light source corresponding to the object area Ara1 in the input image, and the level of current flowing in the light source located at the position corresponding to the background area Ara2 may be adjusted in response to a variation in the current flowing in the light source corresponding to the object area Ara1 in the input image.

Figure 9F:
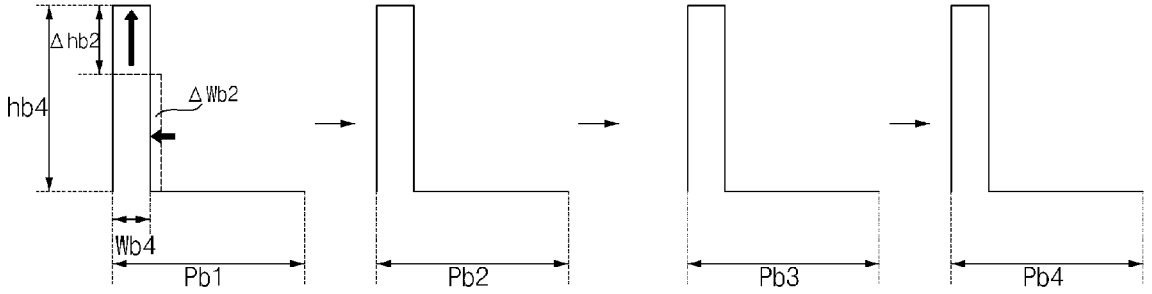

FIG. 9F illustrates that the turn on duty of the light source corresponding to the background area Ara2 is a fourth duty Wb4, which is less than the third duty Wb3, and adjust the level of current flowing in the light source as a fourth level hb4, which is higher than the third level hb3, during the first frame period Pb1 to the fourth frame period Pb4.

In the case in which the turn on duty of the light source corresponding to the background area Ara2 in the input image is set to a third duty Wb3, which is less than the first duty Wb1, and the level of current flowing in the light source is set to a third level hb3, which is lower than the first level hb1, a processor 1130 according to an embodiment of the present disclosure may adjust the turn on duty of the light source corresponding to the background area Ara2 in the input image as a fourth duty Wb4, which is less than the third duty Wb3, and adjust the level of current flowing in the light source as a fourth level hb4, which is higher than the third level hb3, during the first frame period Pb1. Consequently, the definition and luminance of the background area Ara2 may be improved in a manner similar to the object.

At this time, the difference between the third duty Wb3 and the fourth duty Wb4 is ΔWb2, and the difference between the third level hb3 and the fourth level hb4 is Δhb2.

Meanwhile, a processor 1130 according to an embodiment of the present disclosure may perform control such that, as the movement of the object in the input image increases, the fourth duty Wb4 decreases and the fourth level hb4 increases. That is, definition and luminance may be improved depending on the extent of movement of the object.

Figure 10A:
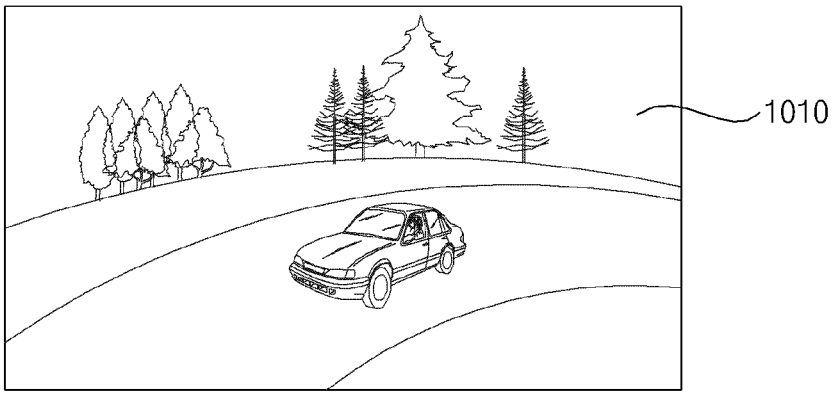
FIGS. 10A to 10F are diagrams referred to in the description of image display according to another embodiment of the present disclosure.

FIGS. 10A to 10F are diagrams referred to in the description of image display according to another embodiment of the present disclosure First, FIG. 10A illustrates an input image 1010 including a moving object.

Figure 10B:
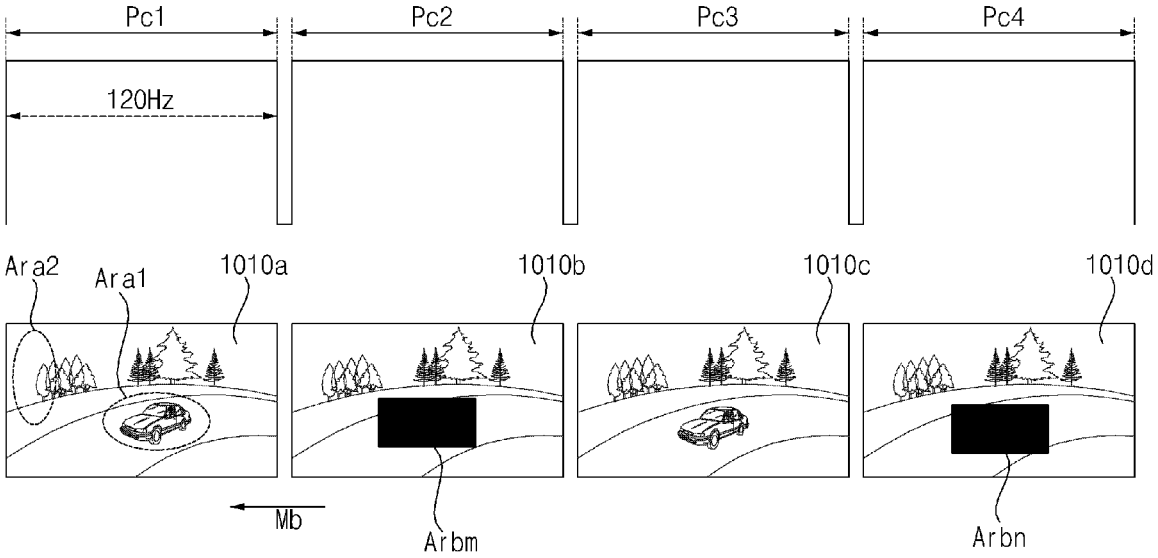

FIG. 10B illustrates a plurality of image frames 1010*a*, 1010*b*, 1010*c*, and 1010*d* for displaying the input image including the moving object.

FIG. 10B illustrates that the movement Mb of an object Arb1 between the first image frame 1010*a* and the second image frame 1010*b* is less than a reference value.

The object Arb1 in the first to fourth image frames 1010*a*, 1010*b*, 1010*c*, and 1010*d* may sequentially move to the left, and the first to fourth image frames 1010*a*, 1010*b*, 1010*c*, and 1010*d* may be sequentially displayed.

Particularly, in the case in which the vertical synchronization frequency is 120 Hz, each of the first to fourth image frames 1010*a*, 1010*b*, 1010*c*, and 1010*d* may be displayed in response to a vertical synchronization frequency of 120 Hz.

For example, the first image 1010*a* is displayed during a first frame period Pc1, the second image 1010*b* is displayed during a second frame period Pc2, the third image 1010*c* is displayed during a third frame period Pc3, and the fourth image 1010*d* is displayed during a fourth frame period Pc4.

At this time, a vehicle, which is the moving object in the first to fourth image frames 1010*a*, 1010*b*, 1010*c*, and 1010*d*, may be displayed without change in the image output to and displayed on the panel 210, unlike FIG. 10B.

Also, in order to improve definition, the light source located at the position corresponding to the moving object Arb1, i.e. the vehicle, among the plurality of light sources that output light to the panel 210, may be turned off.

In particular, the light source located at the position corresponding to the moving object Arb1, i.e. the vehicle, may be alternately turned off.

Figure 10C:
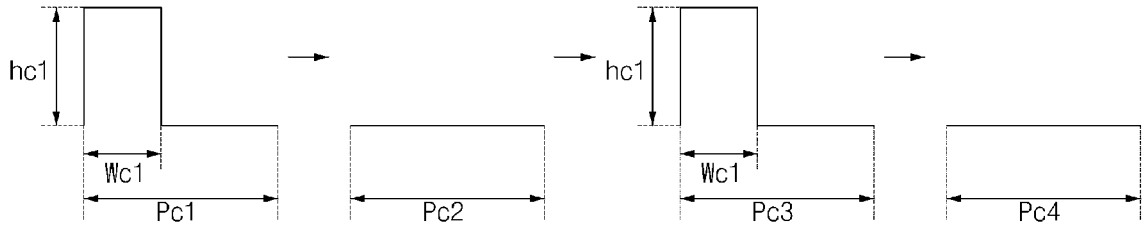

FIG. 10C illustrates that the light source located at the position corresponding to the moving object Arb1, i.e. the vehicle, is turned on during the first frame period Pc1 and the third frame period Pc3 but is turned off during the second frame period Pc2 and the fourth frame period Pc4, which follow the first frame period Pc1 and the third frame period Pc3, respectively.

In particular, FIG. 10C illustrates that the turn on duty of the light source located at the position corresponding to the moving object Arb1, i.e. the vehicle, is a first duty Wc1 and the level of current flowing in the light source is a first level hc1 during the first frame period Pc1 and the third frame period Pc3.

As shown in FIG. 10B, therefore, the moving object Arb1, i.e. the vehicle, is displayed properly during the first frame period Pc1 and the third frame period Pc3, and the moving object Arb1, i.e. the vehicle, is displayed as a black area during the second frame period Pc2 and the fourth frame period Pc4.

Even in the method of FIG. 10C, however, overall luminance of the image may be lowered due to turn off of the light source during the second frame period Pc2 and the fourth frame period Pc4. That is, luminance is higher than FIG. 8C, but overall luminance of the image may be lowered.

In the present disclosure, therefore, the turn on duty of the light source located at the position corresponding to the moving object Arb1, i.e. the vehicle, and the level of current flowing in the light source are changed during the first frame period Pc1 and the third frame period Pc3 in consideration of turn off of the light source during second frame period Pc2 and the fourth frame period Pc4.

For example, in the case in which the movement of the object area Arb1 in the input image is less than a first reference value, a processor 1130 according to an embodiment of the present disclosure may increase the turn on duty of the light source and may decrease the level of current flowing in the light source. In particular, definition is improved due to an increase in turn on duty, and luminance is improved due to a decrease in the level of current.

Figure 10D:
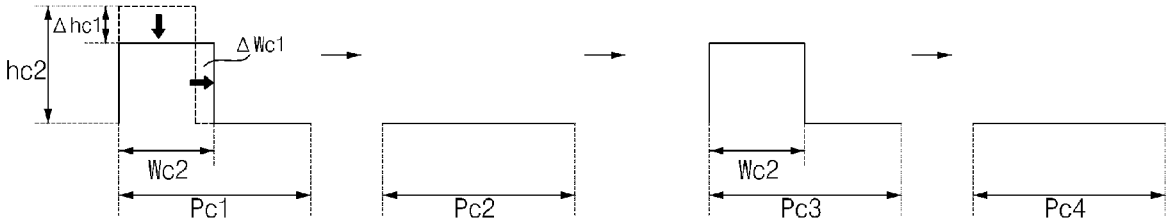

Specifically, in the case in which the turn on duty of the light source corresponding to the object area Arb1 in the input image is set to a first duty Wc1 and the level of current flowing in the light source is set to a first level hc1, a processor 1130 according to an embodiment of the present disclosure may adjust the turn on duty of the light source corresponding to the object area Arb1 in the input image as a fifth duty Wc2, which is greater than the first duty Wc1, and adjust the level of current flowing in the light source as a fifth level hc2, which is lower than the first level hc1, during the first frame period Pc1 and the third frame period Pc3, as shown in FIG. 10D. Consequently, the definition and luminance of an image including a moving object may be improved.

More specifically, in the case in which the movement Ma of the object area Arb1 in the input image is less than a first reference value in the state in which the turn on duty of the light source corresponding to the object area Arb1 in the input image is set to a first duty Wc1 and the level of current flowing in the light source is set to a first level hc1, a processor 1130 according to an embodiment of the present disclosure may adjust the turn on duty of the light source corresponding to the object area Arb1 in the input image as a fifth duty Wc2, which is greater than the first duty Wc1, and adjust the level of current flowing in the light source as a fifth level hc2, which is lower than the first level hc1, during the first frame period Pc1 and the third frame period Pc3, as shown in FIG. 10D. Consequently, the definition and luminance of an image including a moving object may be improved.

FIG. 10D illustrates adjusting the turn on duty of the light source corresponding to the object area Arb1 as a fifth duty Wc2, which is greater than the first duty Wc1, and adjusting the level of current flowing in the light source as a fifth level hc2, which is lower than the first level hc1, during the first frame period Pc1 and the third frame period Pc3.

At this time, the difference between the first duty Wc1 and the fifth duty Wc2 is ΔWc1, and the difference between the fifth level hc2 and the first level hc1 is Δhc1.

Meanwhile, a processor 1130 according to an embodiment of the present disclosure may increase the fifth duty Wc2 and decrease the fifth level hc2, as the movement of the object in the input image decreases. That is, definition and luminance may be improved depending on the extent of movement of the object.

Meanwhile, the processor 1130 may adjust the turn on duty of the light source corresponding to the object area Arb1 in the input image as zero or as a value equal to or less than the lowest limit value and adjust the level of current flowing in the light source as zero or as a value equal to or less than the lowest limit value during the second frame period Pc2 and the fourth frame period Pc4, which follow the first frame period Pc1 and the third frame period Pc3, respectively, as shown in FIG. 10D.

Figure 10E:
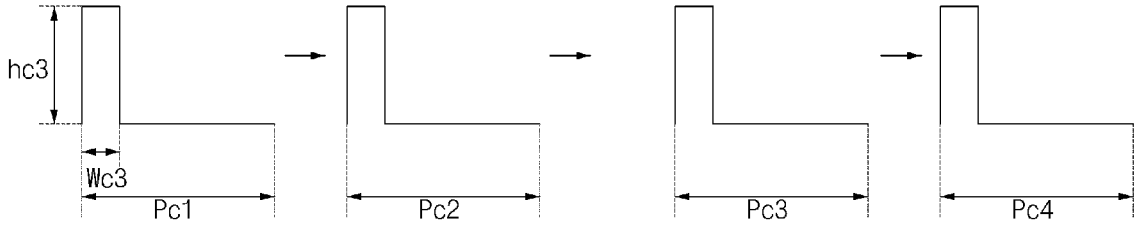

FIG. 10E illustrates that the light source located at the position corresponding to a background area Arb2 is continuously turned on during the first frame period Pc1 to the fourth frame period Pc4.

In particular, the light source is also turned on during the second frame period Pc2 and the fourth frame period Pc4, unlike FIG. 10C.

Meanwhile, FIG. 10E illustrates that the turn on duty of the light source located at the position corresponding to the background area Arb2 is a third duty Wc3, which is less than the first duty Wc1, and the level of current flowing in the light source located at the position corresponding to the background area Arb2 is a third level hc3, which is lower than the first level hc1.

Meanwhile, since the turn on duty of the light source corresponding to the object area Arb1 in the input image and the level of current flowing in the light source are changed in order to improve the definition and luminance of the image, as shown in FIG. 10D, control may be performed such that the turn on duty of the light source located at the position corresponding to the background area Arb2 and the level of current flowing in the light source are changed.

The turn on duty of the light source located at the position corresponding to the background area Arb2 may be adjusted in response to a variation in turn on duty of the light source corresponding to the object area Arb1 in the input image, and the level of current flowing in the light source located at the position corresponding to the background area Arb2 may be adjusted in response to a variation in the current flowing in the light source corresponding to the object area Arb1 in the input image.

Figure 10F:
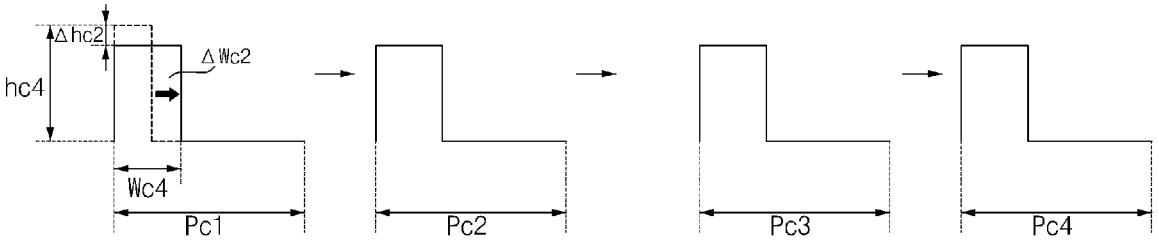

FIG. 10F illustrates that the turn on duty of the light source corresponding to the background area Arb2 is a sixth duty Wc4, which is greater than the third duty Wc3, and the level of current flowing in the light source is a sixth level hc4, which is higher than the third level hc3, during the first frame period Pc1 to the fourth frame period Pc4.

In the case in which the movement of the object area Arb1 in the input image is less than a first reference value in the state in which the turn on duty of the light source corresponding to the background area Arb2 in the input image is set to a third duty Wc3, which is less than the first duty Wc1, and the level of current flowing in the light source is set to a third level hc3, which is lower than the first level hc1, a processor 1130 according to an embodiment of the present disclosure may adjust the turn on duty of the light source corresponding to the background area Arb2 in the input image as a sixth duty Wc4, which is greater than the third duty Wc3, and adjust the level of current flowing in the light source as a sixth level hc4, which is lower than the third level hc3, during the first frame period.

Consequently, the definition and luminance of the background area Arb2 may be improved in a manner similar to the object area Arb1.

At this time, the difference between the third duty Wc3 and the sixth duty Wc4 is ΔWc2, and the difference between the third level hc3 and the sixth level hc4 is Δhc2.

Meanwhile, a processor 1130 according to an embodiment of the present disclosure may increase the sixth duty Wc4 and increase the sixth level hc4, as the movement of the object in the input image decreases. That is, definition and luminance may be improved depending on the extent of movement of the object.

FIGS. 11A to 11F are diagrams referred to in the description of image display according to another embodiment of the present disclosure.

FIGS. 11A to 11F illustrate that the movement Ma of an object Arch in an input image 1110*m* is equal to or greater than a first reference value, in a manner similar to FIGS. 9A to 9F.

Consequently, the processor 1130 may decrease the turn on duty of the light source located at the position corresponding to the object Arc1 in the image and may increase the level of current flowing in the light source.

However, FIGS. 11A to 11F are different from FIGS. 9A to 9F in that the vertical synchronization frequency is 240 Hz, rather than 120 Hz.

When comparing FIGS. 11A to 11F and FIGS. 9A to 9F, as the switching frequency increases in the state in which the movement Ma of the object Arc1 in the input image 1110*m* is equal to or greater than a first reference value, the turn on duty of the light source located at the position corresponding to the object Arc1 may decrease and the level of current flowing in the light source may increase.

Consequently, definition and luminance may be improved depending on the extent of movement of the object.

Figure 11A:
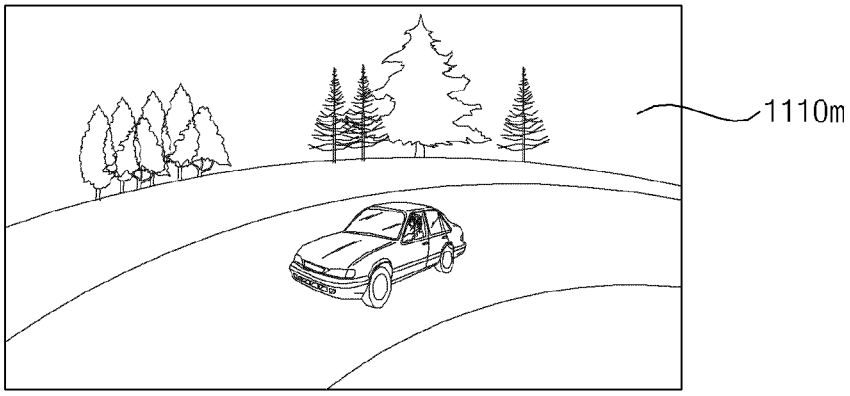
FIGS. 11A to 11F are diagrams referred to in the description of image display according to another embodiment of the present disclosure.
Figure 11B:
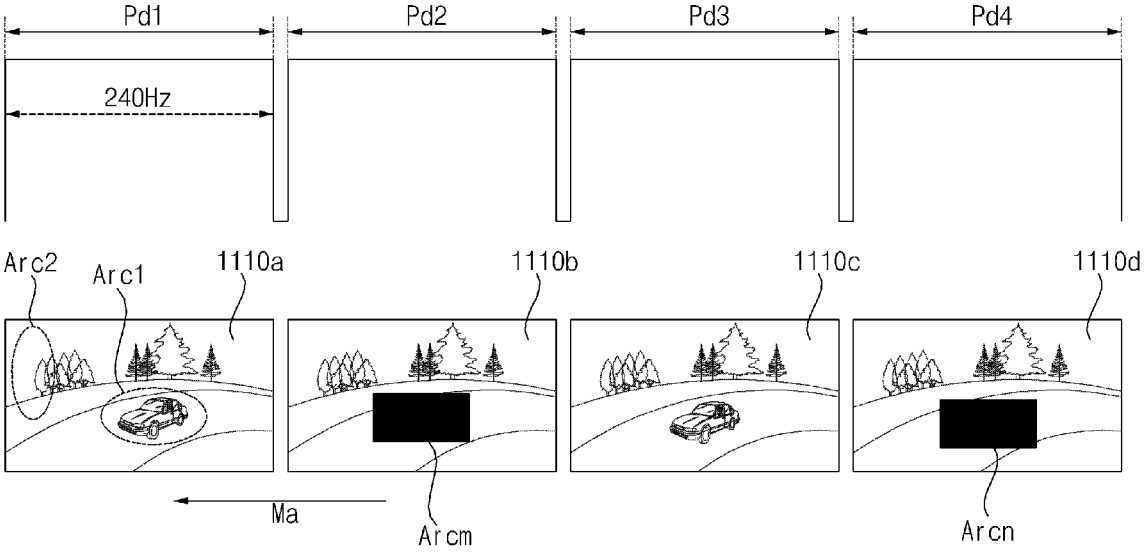
Figure 11C:
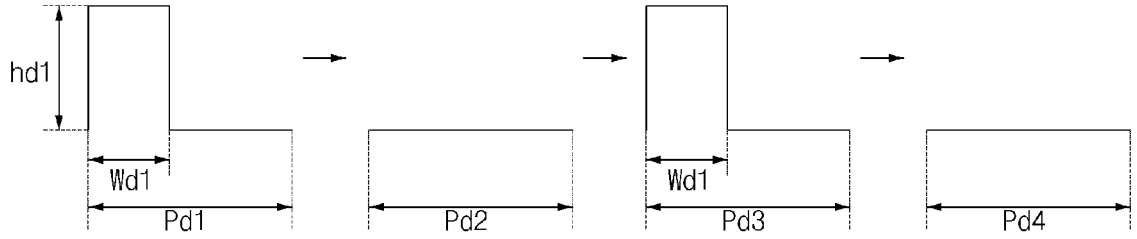
Figure 11D:
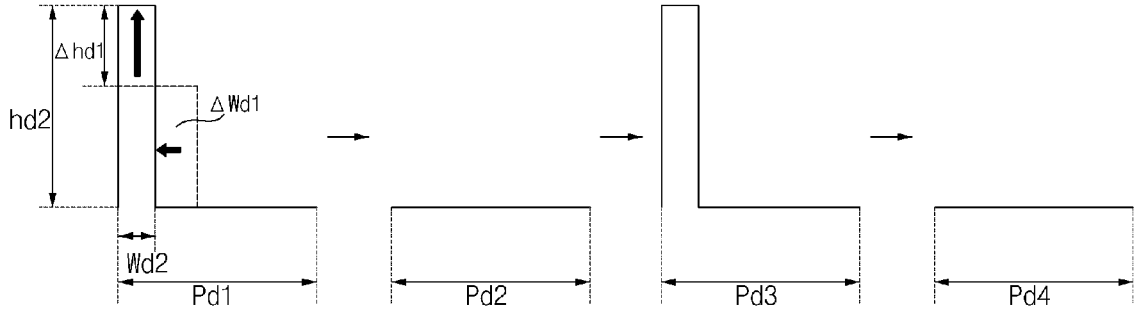

In particular, FIG. 11D illustrates that the turn on duty of the light source corresponding to the object area Arc1 is a seventh duty Wd2, which is less than a first duty Wd1, and the level of current flowing in the light source is a seventh level hd2, which is higher than a first level hd1, during a first frame period Pd1 and a third frame period Pd3.

At this time, the difference between the first duty Wd1 and the seventh duty Wd2 is ΔWd1, and the difference between the seventh level hd2 and the first level hd1 is Δhd1.

Meanwhile, when comparing FIGS. 9D and 11D, in the case in which the movement Ma of the object area Arc1 in the input image is equal to or greater than a first reference value and the vertical synchronization frequency is a second frequency f2, which is higher than a first frequency f1, in the state in which the turn on duty of the light source corresponding to the object area Arc1 in the input image is set to a first duty Wb1 and the level of current flowing in the light source is set to a first level hb1, a processor 1130 according to an embodiment of the present disclosure may adjust the turn on duty of the light source corresponding to the object area Arc1 in the input image as a seventh duty Wd2, which is less than the second duty Wb2, and adjust the level of current flowing in the light source as a seventh level hd2, which is higher than the second level hb2, during the first frame period Pd1. Consequently, the definition and luminance of an image including a moving object may be improved while the vertical synchronization frequency of the image is increased.

Meanwhile, a processor 1130 according to an embodiment of the present disclosure may perform control such that, as the movement of the object in the input image increases, the seventh duty Wd2 decreases and the seventh level hd2 increases. That is, definition and luminance may be improved depending on the extent of movement of the object.

Meanwhile, the processor 1130 may adjust the turn on duty of the light source corresponding to the object area Arc1 in the input image as zero or as a value equal to or less than the lowest limit value and adjust the level of current flowing in the light source as zero or as a value equal to or less than the lowest limit value during a second frame period Pd2 and a fourth frame period Pd4, which follow the first frame period Pd1 and the third frame period Pd3, respectively, as shown in FIG. 11D.

Figure 11E:
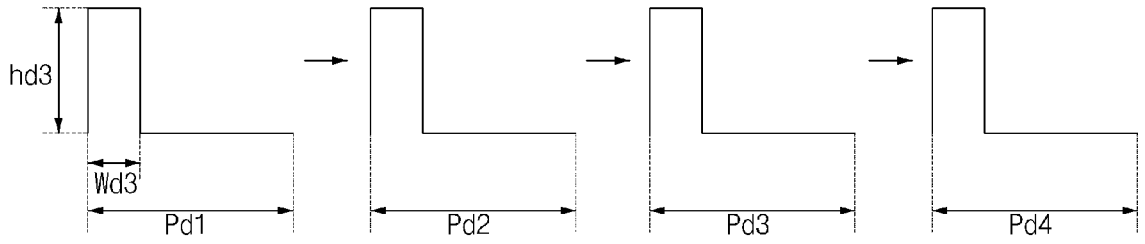

FIG. 11E illustrates that the light source located at the position corresponding to a background area Arc2 is continuously turned on during the first frame period Pd1 to the fourth frame period Pd4.

Figure 11F:
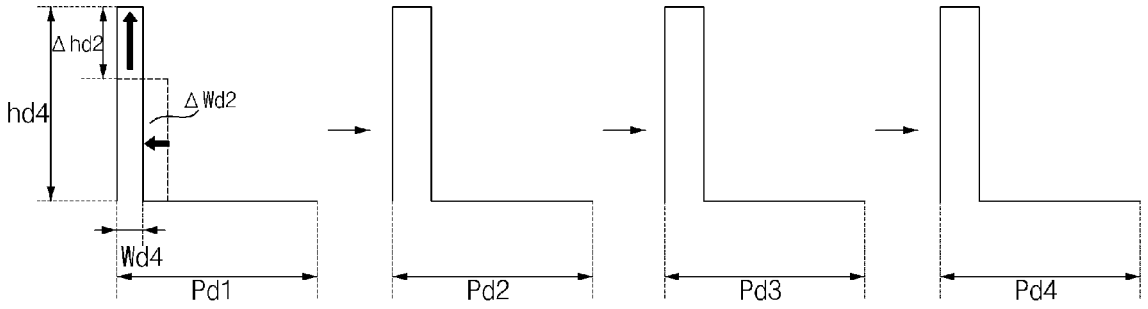

FIG. 11F illustrates that the turn on duty of the light source corresponding to the background area Arc2 is an eighth duty Wd4, which is less than a third duty Wd3, and the level of current flowing in the light source is an eighth level hd4, which is higher than a third level hd3, during the first frame period Pd1 to the fourth frame period Pd4.

At this time, the difference between the third duty Wd3 and the eighth duty Wd4 is ΔWd2, and the difference between the third level hd3 and the eighth level hd4 is Δhd2.

Meanwhile, a processor 1130 according to an embodiment of the present disclosure may perform control such that, as the movement of the object in the input image increases, the eighth duty Wd4 decreases and the eighth level hd4 increases. That is, definition and luminance may be improved depending on the extent of movement of the object.

Meanwhile, when comparing FIGS. 9E and 11E, in the case in which the movement of the object area Arch in the input image is less than a first reference value and the vertical synchronization frequency is a second frequency f2, which is higher than the first frequency f1, in the state in which the turn on duty of the light source corresponding to the object area Arc1 in the input image is set to a first duty Wb1 and the level of current flowing in the light source is set to a first level hb1, a processor 1130 according to an embodiment of the present disclosure may adjust the turn on duty of the light source corresponding to the background area Arc2 in the input image as an eighth duty Wd4, which is less than the fourth duty Wb4, and adjust the level of current flowing in the light source as an eighth level hd4, which is higher than the fourth level hb4. Consequently, the definition and luminance of an image including a moving object may be improved while the vertical synchronization frequency of the image is increased.

FIGS. 12A to 12F are diagrams referred to in the description of image display according to another embodiment of the present disclosure.

FIGS. 12A to 12F illustrate that the movement Mc of an object Ard1 in an input image 1210 is less than a first reference value, in a manner similar to FIGS. 10A to 10F.

Consequently, the processor 1130 may increase the turn on duty of the light source located at the position corresponding to the object Ard1 in the image and may decrease the level of current flowing in the light source.

However, FIGS. 12A to 12F are different from FIGS. 10A to 10F in that the vertical synchronization frequency is 240 Hz, rather than 120 Hz.

When comparing FIGS. 12A to 12F and FIGS. 10A to 10F, as the switching frequency increases in the state in which the movement Mc of the object Ard1 in the input image 1210 is less than a first reference value, the turn on duty of the light source located at the position corresponding to the object Ard1 may increase and the level of current flowing in the light source may decrease. Consequently, definition and luminance may be improved depending on the extent of movement of the object.

Figure 12A:
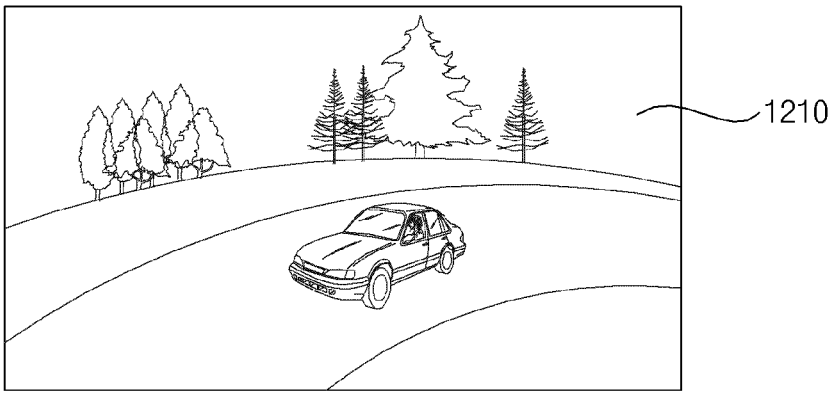
FIGS. 12A to 12F are diagrams referred to in the description of image display according to another embodiment of the present disclosure.
Figure 12B:
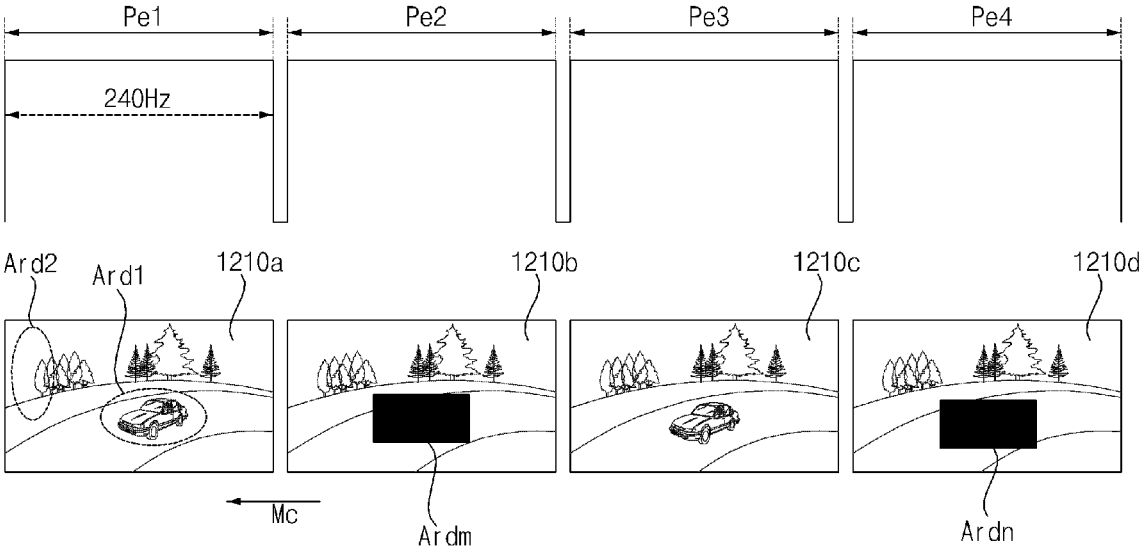
Figure 12C:
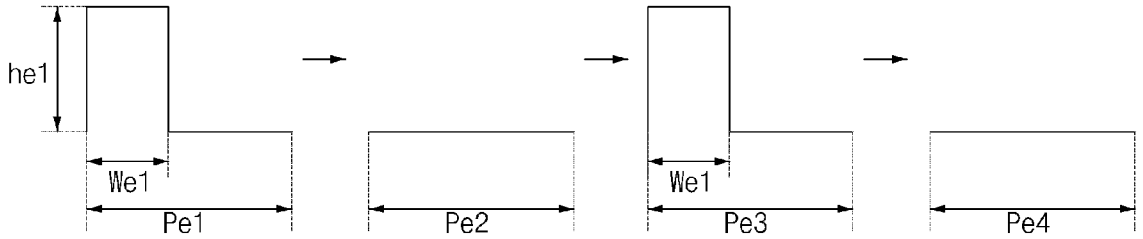
Figure 12D:
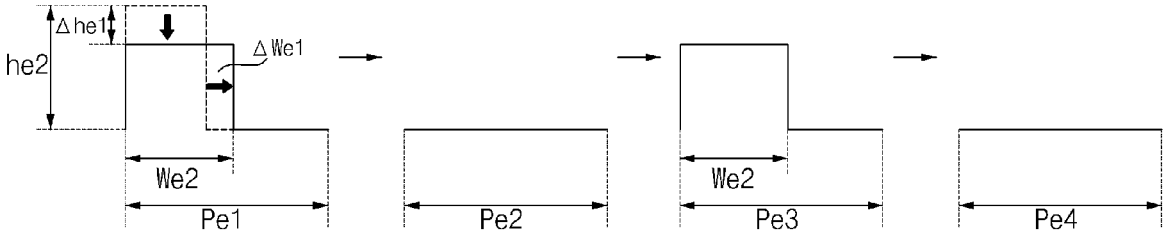

In particular, FIG. 12D illustrates that the turn on duty of the light source corresponding to the object area Ard1 is a ninth duty We2, which is less than a first duty We1, and the level of current flowing in the light source is a ninth level he2, which is higher than a first level he1, during a first frame period Pe1 and a third frame period Pe3.

At this time, the difference between the first duty We1 and the ninth duty We2 is ΔWe1, and the difference between the ninth level he2 and the first level he1 is Δhe1.

Meanwhile, comparing FIGS. 10D and 12D, in the case in which the movement of the object area Ard1 in the input image is less than a first reference value and the vertical synchronization frequency is a second frequency f2, which is higher than the first frequency f1, in the state in which the turn on duty of the light source corresponding to the object area Ard1 in the input image is set to a first duty Wb1 and the level of current flowing in the light source is set to a first level hb1, a processor 1130 according to an embodiment of the present disclosure may adjust the turn on duty of the light source corresponding to the object area Ard1 in the input image as a ninth duty We2, which is less than the fifth duty Wc2, and adjust the level of current flowing in the light source as a ninth level he2, which is higher than the fifth level hc2, during the first frame period. Consequently, the definition and luminance of an image including a slightly moving object may be improved while the vertical synchronization frequency of the image is increased.

Meanwhile, a processor 1130 according to an embodiment of the present disclosure may perform control such that, as the movement of the object in the input image increases, the ninth duty We2 increases and the ninth level he2 decreases. That is, definition and luminance may be improved depending on the extent of movement of the object.

Meanwhile, the processor 1130 may adjust the turn on duty of the light source corresponding to the object area Ard1 in the input image as zero or as a value equal to or less than the lowest limit value and adjust the level of current flowing in the light source as zero or as a value equal to or less than the lowest limit value during a second frame period Pe2 and a fourth frame period Pe4, which follow the first frame period Pe1 and the third frame period Pe3, respectively, as shown in FIG. 12D.

Figure 12E:
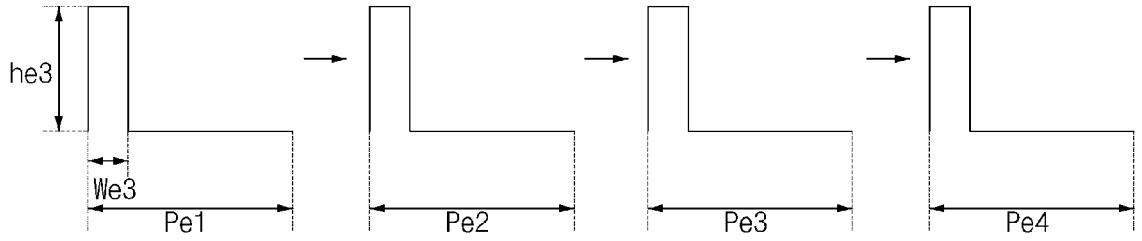

FIG. 12E illustrates that the light source located at the position corresponding to a background area Ard2 is continuously turned on during the first frame period Pe1 to the fourth frame period Pe4.

Figure 12F:
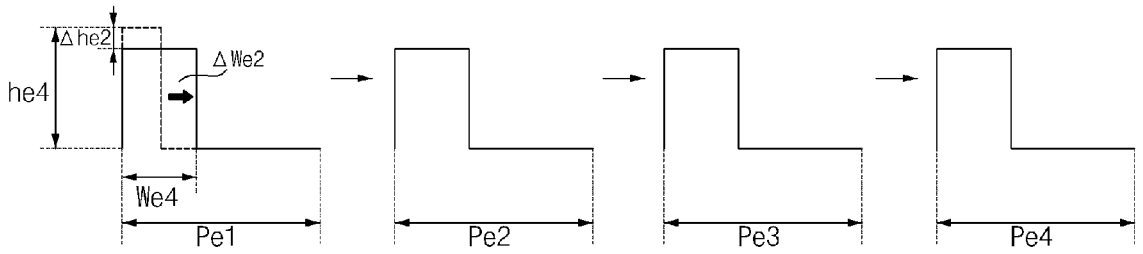

FIG. 12F illustrates that the turn on duty of the light source corresponding to the background area Ard2 is a tenth duty We4, which is greater than a third duty We3, and the level of current flowing in the light source is a tenth level he4, which is lower than a third level he3, during the first frame period Pe1 to the fourth frame period Pe4.

At this time, the difference between the third duty We3 and the tenth duty We4 is ΔWe2, and the difference between the third level he3 and the tenth level he4 is Δhe2.

Meanwhile, a processor 1130 according to an embodiment of the present disclosure may increase the tenth duty We4 and decrease the tenth level he4, as the movement of the object in the input image decreases. That is, definition and luminance may be improved depending on the extent of movement of the object.

Meanwhile, comparing FIGS. 10E and 12E, in the case in which the movement of the object area Ara1 in the input image is less than a first reference value and the vertical synchronization frequency is a second frequency f2, which is higher than the first frequency f1, in the state in which the turn on duty of the light source corresponding to the background area Ard2 in the input image is set to a third duty Wb3, which is less than the first duty Wb1, and the level of current flowing in the light source is set to a third level hb3, which is lower than the first level hb1, a processor 1130 according to an embodiment of the present disclosure may adjust the turn on duty of the light source corresponding to the background area Ara2 in the input image as a tenth duty We4, which is less than the sixth duty Wc4, and adjust the level of current flowing in the light source as a tenth level he4, which is higher than the sixth level hc4, during the first frame period. Consequently, the definition and luminance of an image including a moving object may be improved while the vertical synchronization frequency of the image is increased.

Figure 13A:
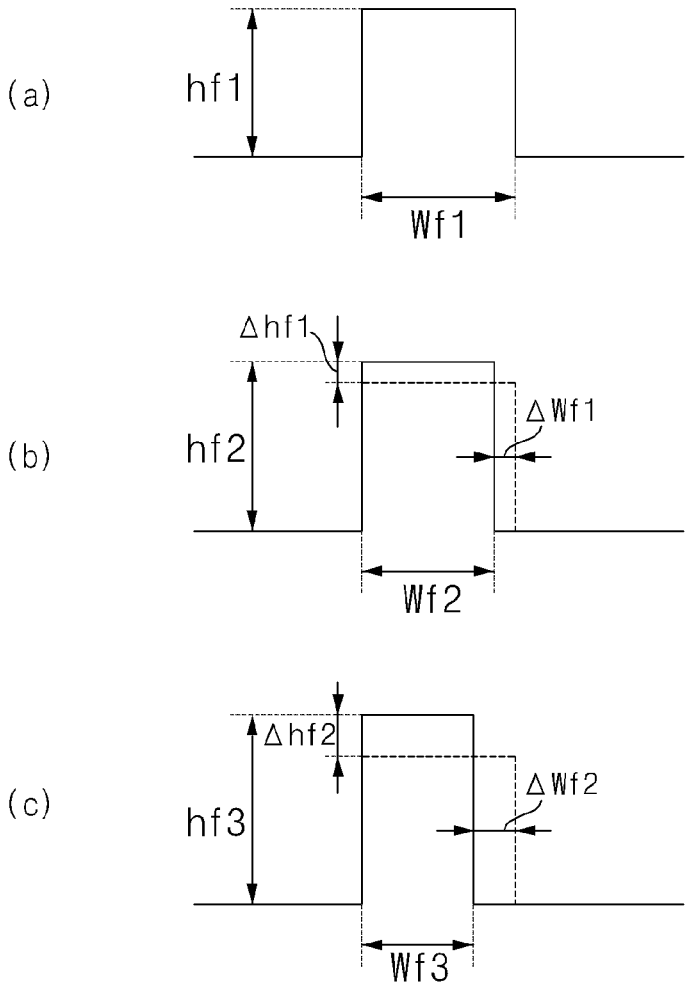
FIGS. 13A to 13B are diagrams illustrating various pulse width modulation signals for light source driving.
Figure 13B:
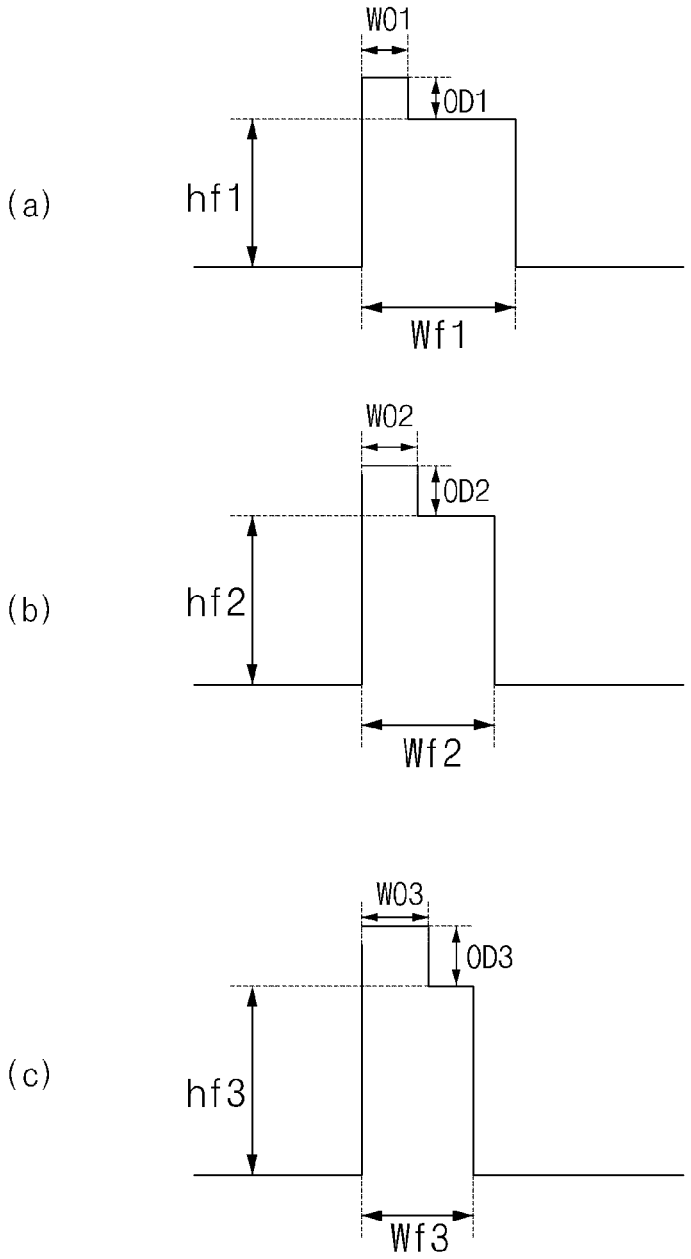

FIGS. 13A to 13B are diagrams illustrating various pulse width modulation signals for light source driving.

First, FIG. 13A is a diagram showing various examples of a pulse width modulation signal applied to a light source without overdriving.

Referring to the figure, FIG. 13A(a) illustrates an example of a pulse that flows in a light source.

As shown in the figure, a pulse width of Wf1 and a current level of hf1 may be set.

Meanwhile, an image includes a moving object, and in the case in which the movement of the moving object is equal to or greater than a first reference level, the pulse of FIG. 13A(a) may not be changed.

For example, as shown in FIG. 13A(b), a pulse width of Wf2 and a current level of hf2 may be set. Compared to FIG. 13A(a), the pulse width may be decreased by ΔWf1, and the current level may be increased by Δhf1.

As another example, as shown in FIG. 13A(c), a pulse width of Wf3 and a current level of hf3 may be set. Compared to FIG. 13A(a), the pulse width may be decreased by ΔWf2, and the current level may be increased by Δhf2.

Meanwhile, the processor 1130 may perform control such that, as the movement of the moving object increases, the turn on duty of the light source decreases and the level of current flowing in the light source increases, as shown in FIG. 13A(c), rather than FIG. 13A(b).

As another example, in the case in which the movement of the moving object is uniform, the processor 1130 may sequentially decrease the turn on duty of the light source and sequentially increase the level of current flowing in the light source. That is, the processor 1130 may perform control such that the pulse shown in FIG. 13A(b) is driven during a first frame period and the pulse shown in FIG. 13A(c) is driven during a third frame period.

Next, FIG. 13B is a diagram showing various examples of a pulse width modulation signal applied to a light source to which overdriving technology is applied.

FIG. 13B is different from FIG. 13A in that a peak value corresponding to overdriving is further applied depending on overdriving technology.

Referring to the figure, FIG. 13B(a) illustrates an example of a pulse that flows in a light source.

As shown in the figure, a pulse width of Wf1 and a current level of hf1 may be set, and the width and level of an overdriving pulse may be WO1 and OD1, respectively.

Meanwhile, an image includes a moving object, and in the case in which the movement of the moving object is equal to or greater than a first reference level, the pulse of FIG. 13B(a) may not be changed.

For example, as shown in FIG. 13B(b), a pulse width of Wf2 and a current level of hf2 may be set, and the width and level of an overdriving pulse may be WO2 and OD2, respectively.

Compared to FIG. 13B(a), the pulse width may be decreased by ΔWf1, and the current level may be increased by Δhf1.

Meanwhile, compared to FIG. 13B(a), the width and level of the overdriving pulse may be further increased.

As another example, as shown in FIG. 13B(c), a pulse width of Wf3 and a current level of hf3 may be set, and the width and level of an overdriving pulse may be WO3 and OD3, respectively.

Compared to FIG. 13B(a), the pulse width may be decreased by ΔWf2, and the current level may be increased by Δhf2.

Meanwhile, compared to FIG. 13B(a), the width and level of the overdriving pulse may be further increased.

Meanwhile, the processor 1130 may perform control such that, as the movement of the moving object increases, the turn on duty of the light source decreases and the level of current flowing in the light source increases, as shown in FIG. 13B(c), rather than FIG. 13B(b).

As another example, in the case in which the movement of the moving object is uniform, the processor 1130 may sequentially decrease the turn on duty of the light source and sequentially increase the level of current flowing in the light source. That is, the processor 1130 may perform control such that the pulse shown in FIG. 13B(b) is driven during a first frame period and the pulse shown in FIG. 13B(c) is driven during a third frame period.

Figure 14:
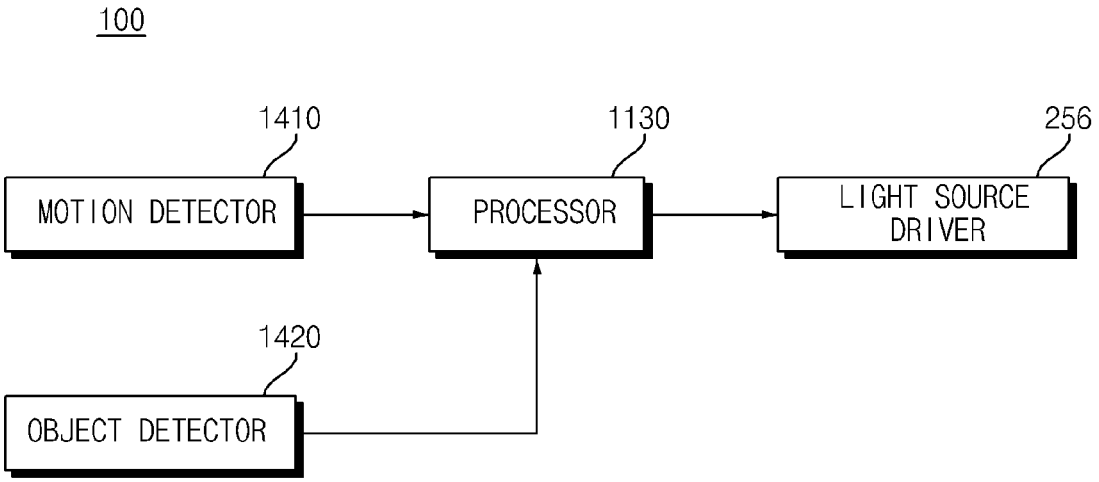
FIG. 14 is an example of a block diagram of an image display apparatus according to an embodiment of the present disclosure.

FIG. 14 is an example of a block diagram of an image display apparatus according to an embodiment of the present disclosure.

Referring to the figure, the image display apparatus 100 may include a motion detector 1410 configured to detect motion in an image and an object detector 1420 configured to detect an object in the image.

In particular, the signal processor 170 may include a motion detector 1410 and an object detector 1420.

Meanwhile, the motion detector 1410 and the object detector 1420 may not be separately provided but may be integrated.

Meanwhile, in the case in which the motion detector 1410 and the object detector 1420 detect a moving object, the signal processor 170 may increase a vertical synchronization frequency, for example, from 120 Hz to 240 Hz.

Meanwhile, motion and object information detected by the motion detector 1410 and the object detector 1420 may be transmitted to the processor 1130.

The processor 1130 may be a processor in the driving controller 1120 of FIG. 7.

The processor 1130 may control the light source driver 256.

Meanwhile, the processor 1130 may change the turn on duty of a light source corresponding to a moving object area Ara1 in an input image and may change the level of current flowing in the light source.

Meanwhile, in the case in which the movement of the object area Ara1 in the input image is equal to or greater than a first reference value, the processor 1130 may decrease the turn on duty of the light source and may increase the level of current flowing in the light source.

Meanwhile, in the case in which the turn on duty of the light source corresponding to the object area Ara1 in the input image is set to a first duty Wb1 and the level of current flowing in the light source is set to a first level hb1, the processor 1130 may adjust the turn on duty of the light source corresponding to the object area Ara1 in the input image as a second duty Wb2, which is less than the first duty Wb1, and adjust the level of current flowing in the light source as a second level hb2, which is higher than the first level hb1, during a first frame period.

Meanwhile, the processor 1130 may perform control such that, as the movement of the object in the input image increases, the second duty Wb2 decreases and the second level hb2 increases.

Meanwhile, in the case in which the turn on duty of a light source corresponding to a background area Ara2 in the input image is set to a third duty Wb3, which is less than the first duty Wb1, and the level of current flowing in the light source is set to a third level hb3, which is lower than the first level hb1, the processor 1130 may adjust the turn on duty of the light source corresponding to the background area Ara2 in the input image as a fourth duty Wb4, which is less than the third duty Wb3, and adjust the level of current flowing in the light source as a fourth level hb4, which is higher than the third level hb3, during the first frame period.

Meanwhile, in the case in which the movement of the object area Arc1 in the input image is equal to or greater than a first reference value and the vertical synchronization frequency is a second frequency f2, which is higher than a first frequency f1, in the state in which the turn on duty of the light source corresponding to the object area Arc1 in the input image is set to a first duty Wb1 and the level of current flowing in the light source is set to a first level hb1, the processor 1130 may adjust the turn on duty of the light source corresponding to the object area Arc1 in the input image is a seventh duty Wd2, which is less than the second duty Wb2, and adjust the level of current flowing in the light source as a seventh level hd2, which is higher than the second level hb2, during the first frame period.

Meanwhile, in the case in which the movement of the object area Arc1 in the input image is equal to or greater than a first reference value and the vertical synchronization frequency is a second frequency f2, which is higher than the first frequency f1, in the state in which the turn on duty of the light source corresponding to the background area Ara2 in the input image is set to a third duty Wb3, which is less than the first duty Wb1, and the level of current flowing in the light source is set to a third level hb3, which is lower than the first level hb1, the processor 1130 may adjust the turn on duty of the light source corresponding to the background area Ara2 in the input image as an eighth duty Wd4, which is less than the fourth duty Wb4, and adjust the level of current flowing in the light source as an eighth level hd4, which is higher than the fourth level hb4, during the first frame period.

Figure 15A:
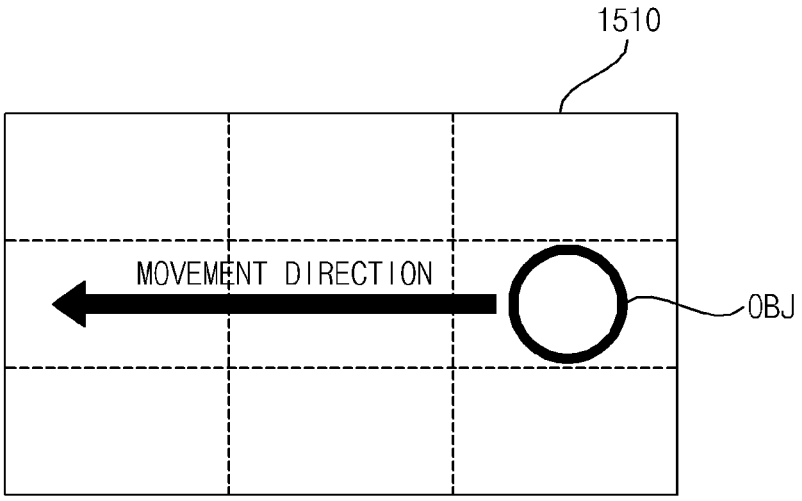
FIGS. 15A to 15C are diagrams referred to in the description of operation of an image display apparatus according to an embodiment of the present disclosure.
Figure 15B:
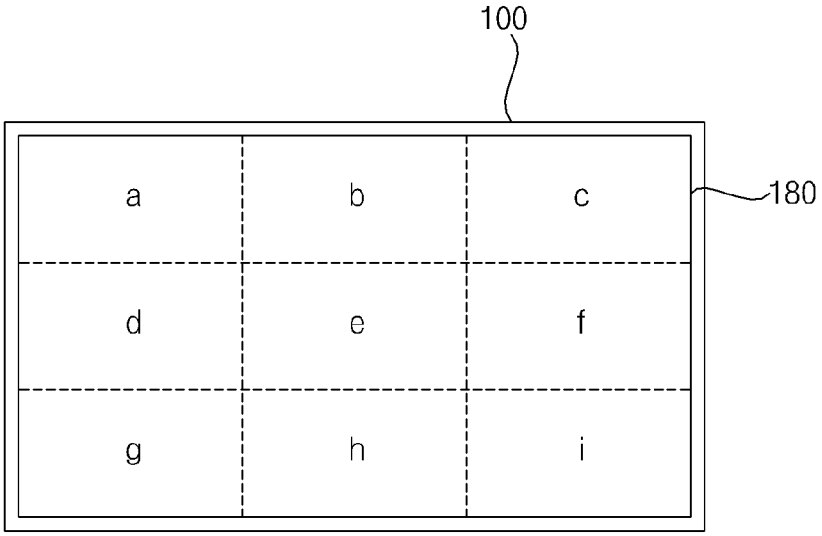
Figure 15C:
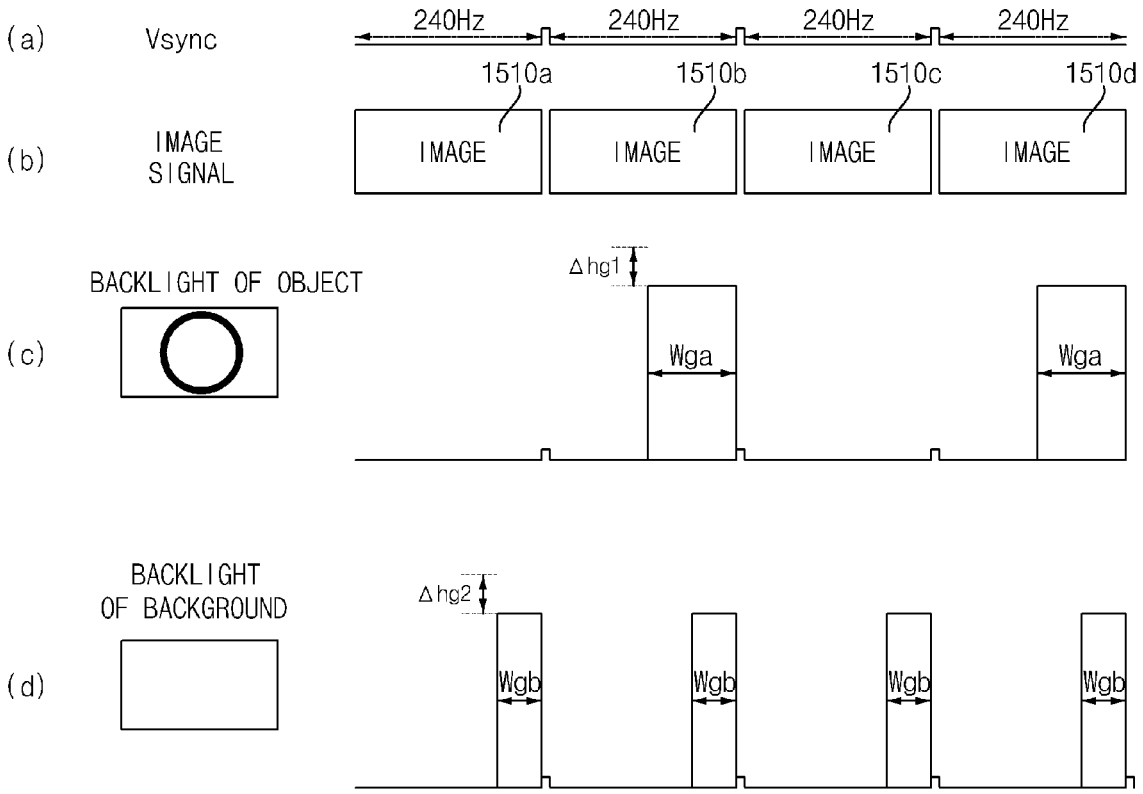

FIGS. 15A to 15C are diagrams referred to in the description of operation of an image display apparatus according to an embodiment of the present disclosure.

FIG. 15A is a diagram illustrating that an object OBJ in an input image 1510 moves to the left.

FIG. 15B illustrates that a backlight is disposed in the state in which a display 180 is divided into nine areas a to i (3×3).

In the case in which the panel 250 is a liquid crystal display panel, as described above, the liquid crystal display panel is divided into nine areas a to I, and light from the backlight is transmitted to the liquid crystal display panel.

Meanwhile, in the present disclosure, in order to improve definition and luminance of an image including a moving object, a light source located at the position corresponding to the object area is turned off in some frames while performing local dimming, and the turn on duty of the light source located at the position corresponding to the object area and the level of current flowing in the light source are changed in some other frames.

FIG. 15C illustrates that a plurality of image frames 1510*a* to 1510*d* is displayed in response to a vertical synchronization frequency of 240 Hz and illustrates that a backlight corresponding to the moving object is turned on in some frames 1510*b* and 1510*d* and the pulse width and current level thereof are changed. Consequently, the definition and luminance of an image including a moving object may be improved.

Meanwhile, FIG. 15C illustrates that a backlight corresponding to a background area is turned on during the plurality of image frames 1510*a* to 1510*d* and the pulse width and current level thereof are changed in response to the backlight corresponding to the moving object.

Figure 16:
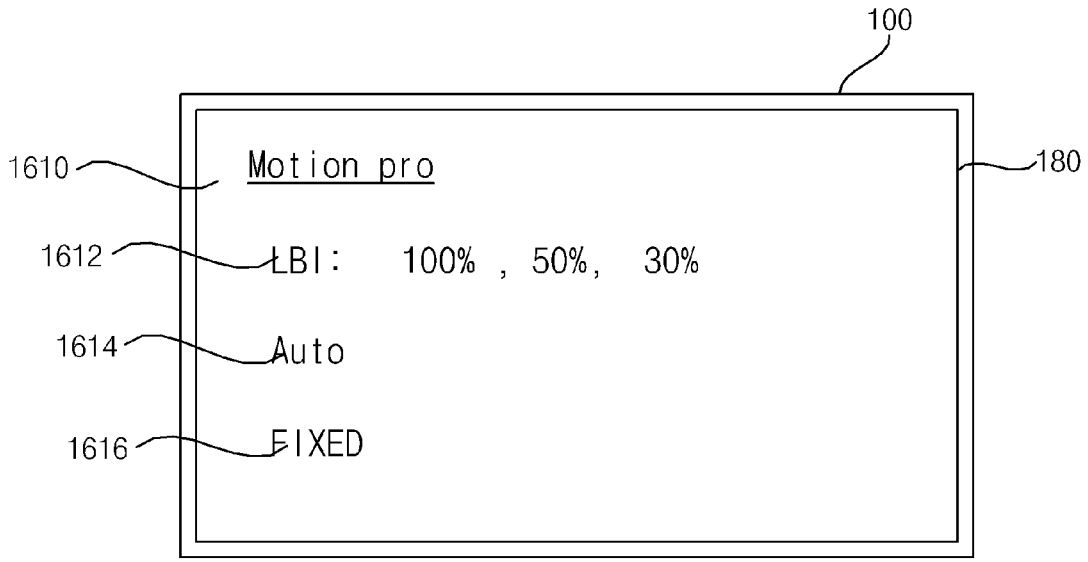
FIG. 16 is a diagram showing a user interface screen according to an embodiment of the present disclosure.

FIG. 16 is a diagram showing a user interface screen according to an embodiment of the present disclosure Referring to the figure, the image display apparatus 100 according to the present disclosure may provide a user interface screen 1610 configured to change the turn on duty and luminance level of the backlight, described with reference to FIGS. 9A to 15C, in order to improve the definition and luminance of an image.

The user interface screen 1610 may include a rate item 1612 configured to set a change in turn on duty and luminance level at various rates, an automatic item 1614 configured to perform automatic setting, and a fixed item 1616 configured to perform fixed setting.

In particular, the rate of a change in change in turn on duty and luminance level may be set according to various rate settings in the rate item 1612.

Figure 17:
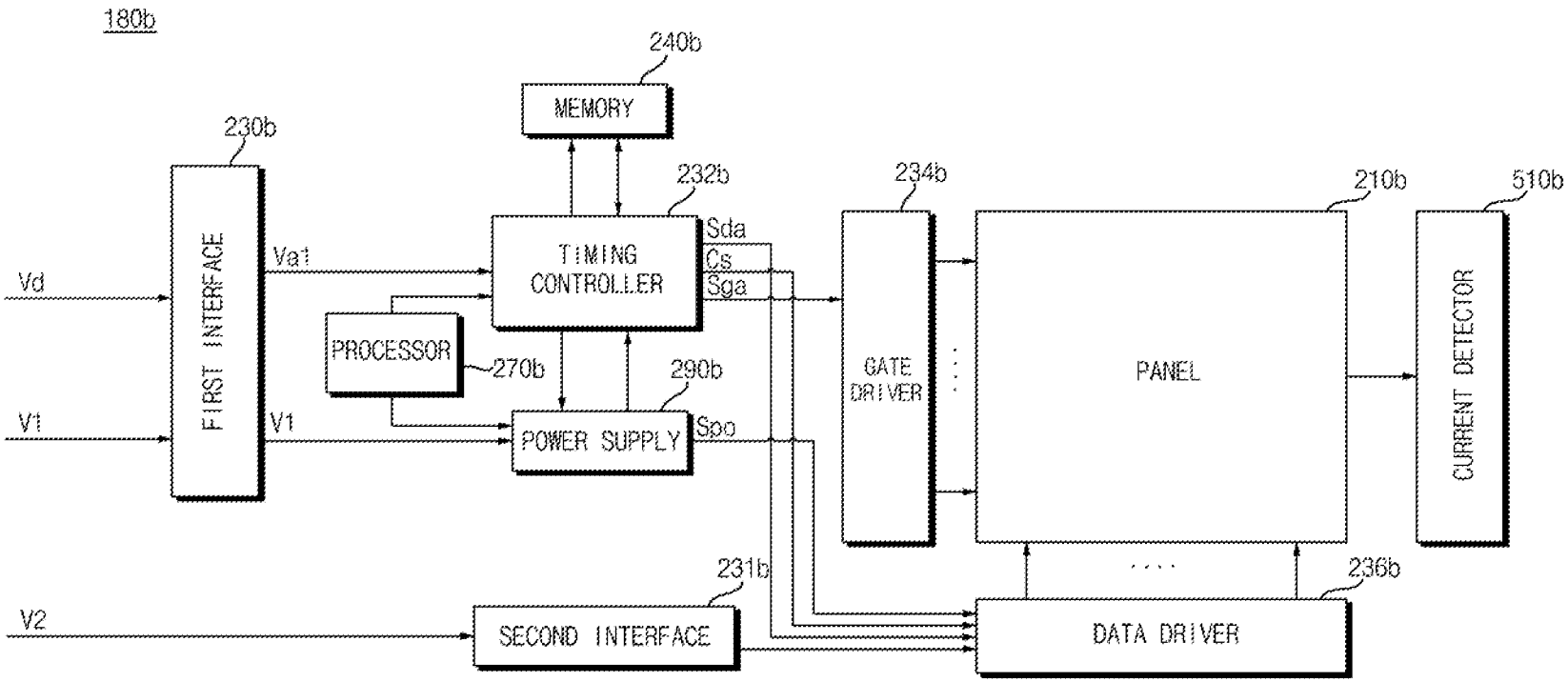
FIG. 17 is another example of an internal block diagram of a display of FIG. 2.

FIG. 17 is another example of an internal block diagram of the display of FIG. 2.

Referring to the figure, an organic light emitting diode panel-based display 180*b* may include an organic light emitting diode panel 210*b*, a first interface 230*b*, a second interface 231*b*, a timing controller 232*b*, a gate driver 234*b*, a data driver 236*b*, a memory 240*b*, a processor 270*b*, a power supply 290*b*, and a current detector 510*b*.

The display 180*b* receives an image signal Vdb, a first DC power V1*b*, and a second DC power V2*b*, and may display a predetermined image based on the image signal Vdb.

Meanwhile, the first interface 230*b* in the display 180*b* may receive the image signal Vdb and the first DC power V1*b* from the signal processor 170*b*.

Here, the first DC power V1*b* may be used for the operation of the power supply 290*b* and the timing controller 232*b* in the display 180*b*.

Next, the second interface 231*b* may receive a second DC power V2*b* from an external power supply 190*b*. Meanwhile, the second DC power V2*b* may be input to the data driver 236*b* in the display 180*b*.

The timing controller 232*b* may output a data driving signal Sdab and a gate driving signal Sgab based on the image signal Vdb.

For example, when the first interface 230*b* converts the input image signal Vdb and outputs the converted image signal va1*b*, the timing controller 232*b* may output the data driving signal Sdab and the gate driving signal Sgab based on the converted image signal va1*b*.

The timing controller 232*b* may further receive a control signal, a vertical synchronization signal Vsyncb, and the like, in addition to the image signal Vdb from the signal processor 170*b*.

The timing controller 232*b* generates a gate driving signal Sgab for the operation of the gate driver 234*b* and a data driving signal Sdab for the operation of the data driver 236*b* based on the control signal, the vertical synchronization signal Vsyncb, and the like, in addition to the image signal Vdb.

At this time, when the panel 210*b* includes RGBW subpixels, the data driving signal Sdab may be a data driving signal for driving of the RGBW subpixels.

Meanwhile, the timing controller 232*b* may further output a control signal Csb to the gate driver 234*b*.

The gate driver 234*b* and the data driver 236*b* supply a scan signal and an image signal to the organic light emitting diode panel 210*b* through gate lines GLb and data lines DLb, respectively, according to the gate driving signal Sgab and the data driving signal Sdab from the timing controller 232*b*. Accordingly, the organic light emitting diode panel 210*b* displays a predetermined image.

Meanwhile, the organic light emitting diode panel 210*b* may include an organic light emitting layer. In order to display an image, a plurality of gate lines GL and data lines DL may be disposed so as to intersect each other in a matrix form at each pixel corresponding to the organic light emitting layer.

Meanwhile, the data driver 236*b* may output a data signal to the organic light emitting diode panel 210*b* based on a second DC power V2*b* from the second interface 231*b*.

The power supply 290*b* may supply various kinds of power to the gate driver 234*b*, the data driver 236*b*, the timing controller 232*b*, and the like.

The current detector 510*b* may detect the current flowing in a sub-pixel of the organic light emitting diode panel 210*b*. The detected current may be input to the processor 270*b* or the like for cumulative current calculation.

The processor 270*b* may perform various kinds of control in the display 180*b*. For example, the processor 270*b* may control the gate driver 234*b*, the data driver 236*b*, the timing controller 232*b*, and the like.

Meanwhile, the processor 270*b* may receive current information flowing in a sub-pixel of the organic light emitting diode panel 210*b* from the current detector 510*b*.

Meanwhile, the processor 270*b* may perform the operation of the processor 1130 described with reference to FIGS. 9A to 16.

The processor 270*b* may change the turn on duty of a light source corresponding to a moving object area Ara1 in an input image and may change the level of current flowing in the light source. Consequently, the definition and luminance of an image including a moving object may be improved.

Meanwhile, in the case in which the movement of the object area Ara1 in the input image is equal to or greater than a first reference value, a processor 270*b* according to another embodiment of the present disclosure may decrease the turn on duty of the light source and may increase the level of current flowing in the light source. In particular, definition is improved due to a decrease in turn on duty, and luminance is improved due to an increase in the level of current.

Meanwhile, in the case in which the turn on duty of the light source corresponding to the object area Ara1 in the input image is set to a first duty Wb1 and the level of current flowing in the light source is set to a first level hb1, a processor 270*b* according to another embodiment of the present disclosure may adjust the turn on duty of the light source corresponding to the object area Ara1 in the input image as a second duty Wb2, which is less than the first duty Wb1, and adjust the level of current flowing in the light source as a second level hb2, which is higher than the first level hb1, during a first frame period. Consequently, the definition and luminance of an image including a moving object may be improved.

Meanwhile, a processor 270*b* according to another embodiment of the present disclosure may perform control such that, as the movement of the object in the input image increases, the second duty Wb2 decreases and the second level hb2 increases. That is, definition and luminance may be improved depending on the extent of movement of the object.

Meanwhile, in the case in which the turn on duty of a light source corresponding to a background area Ara2 in the input image is set to a third duty Wb3, which is less than the first duty Wb1, and the level of current flowing in the light source is set to a third level hb3, which is lower than the first level hb1, a processor 270*b* according to another embodiment of the present disclosure may adjust the turn on duty of the light source corresponding to the background area Ara2 in the input image as a fourth duty Wb4, which is less than the third duty Wb3, and adjust the level of current flowing in the light source as a fourth level hb4, which is higher than the third level hb3, during the first frame period. Consequently, the definition and luminance of the background area Ara2 may be improved in a manner similar to the object.

Meanwhile, in the case in which the movement of the object area Ara1 in the input image is equal to or greater than a first reference value in the state in which the turn on duty of the light source corresponding to the object area Ara1 in the input image is set to a first duty Wb1 and the level of current flowing in the light source is set to a first level hb1, a processor 270*b* according to another embodiment of the present disclosure may adjust the turn on duty of the light source corresponding to the object area Ara1 in the input image as a second duty Wb2, which is less than the first duty Wb1, and adjust the level of current flowing in the light source as a second level hb2, which is higher than the first level hb1, during the first frame period. Consequently, the definition and luminance of an image including a greatly moving object may be improved.

Meanwhile, in the case in which the movement of the object area Ara1 in the input image is less than a first reference value in the state in which the turn on duty of the light source corresponding to the object area Ara1 in the input image is set to a first duty Wb1 and the level of current flowing in the light source is set to a first level hb1, a processor 270*b* according to another embodiment of the present disclosure may adjust the turn on duty of the light source corresponding to the object area Ara1 in the input image as a fifth duty Wc2, which is greater than the first duty Wb1, and adjust the level of current flowing in the light source as a fifth level hc2, which is lower than the first level hb1, during the first frame period. Consequently, the definition and luminance of an image including a slightly moving object may be improved.

Meanwhile, a processor 270*b* according to another embodiment of the present disclosure may increase the fifth duty Wc2 and decrease the fifth level hc2, as the movement of the object in the input image decreases. Consequently, the definition and luminance of an image including a slightly moving object may be improved.

Meanwhile, in the case in which the movement of the object area Ara1 in the input image is less than a first reference value in the state in which the turn on duty of the light source corresponding to the background area Ara2 in the input image is set to a third duty Wb3, which is less than the first duty Wb1, and the level of current flowing in the light source is set to a third level hb3, which is lower than the first level hb1, a processor 270*b* according to another embodiment of the present disclosure may adjust the turn on duty of the light source corresponding to the background area Ara2 in the input image as a sixth duty Wc4, which is greater than the third duty Wb3, and adjust the level of current flowing in the light source as a sixth level hc4, which is lower than the third level hb3, during the first frame period. Consequently, the definition and luminance of an image including a slightly moving object may be improved.

Meanwhile, in the case in which the movement of the object area Ara1 in the input image is equal to or greater than a first reference value and the vertical synchronization frequency is a first frequency f1 in the state in which the turn on duty of the light source corresponding to the object area Ara1 in the input image is set to a first duty Wb1 and the level of current flowing in the light source is set to a first level hb1, a processor 270*b* according to another embodiment of the present disclosure may adjust the turn on duty of the light source corresponding to the object area Ara1 in the input image as a second duty Wb2, which is less than the first duty Wb1, and adjust the level of current flowing in the light source as a second level hb2, which is higher than the first level hb1, during the first frame period. Consequently, the definition and luminance of an image including a moving object may be improved.

Meanwhile, in the case in which the movement of the object area Ara1 in the input image is equal to or greater than a first reference value and the vertical synchronization frequency is a second frequency f2, which is higher than the first frequency f1, in the state in which the turn on duty of the light source corresponding to the object area Ara1 in the input image is set to a first duty Wb1 and the level of current flowing in the light source is set to a first level hb1, a processor 270*b* according to another embodiment of the present disclosure may adjust the turn on duty of the light source corresponding to the object area Ara1 in the input image is a seventh duty Wd2, which is less than the second duty Wb2, and adjust the level of current flowing in the light source as a seventh level hd2, which is higher than the second level hb2, during the first frame period. Consequently, the definition and luminance of an image including a moving object may be improved while the vertical synchronization frequency of the image is increased.

Meanwhile, in the case in which the movement of the object area Ara1 in the input image is equal to or greater than a first reference value and the vertical synchronization frequency is a first frequency f1 in the state in which the turn on duty of the light source corresponding to the background area Ara2 in the input image is set to a third duty Wb3, which is less than the first duty Wb1, and the level of current flowing in the light source is set to a third level hb3, which is lower than the first level hb1, a processor 270*b* according to another embodiment of the present disclosure may adjust the turn on duty of the light source corresponding to the background area Ara2 in the input image as a fourth duty Wb4, which is less than the third duty Wb3, and adjust the level of current flowing in the light source as a fourth level hb4, which is higher than the third level hb3, during the first frame period. Consequently, the definition and luminance of the background area Ara2 may be improved in a manner similar to the object.

Meanwhile, in the case in which the movement of the object area Ara1 in the input image is equal to or greater than a first reference value and the vertical synchronization frequency is a second frequency f2, which is higher than the first frequency f1, in the state in which the turn on duty of the light source corresponding to the background area Ara2 in the input image is set to a third duty Wb3, which is less than the first duty Wb1, and the level of current flowing in the light source is set to a third level hb3, which is lower than the first level hb1, a processor 270*b* according to another embodiment of the present disclosure may adjust the turn on duty of the light source corresponding to the background area Ara2 in the input image as an eighth duty Wd4, which is less than the fourth duty Wb4, and adjust the level of current flowing in the light source as an eighth level hd4, which is higher than the fourth level hb4, during the first frame period. Consequently, the definition and luminance of an image including a moving object may be improved while the vertical synchronization frequency of the image is increased.

Meanwhile, in the case in which the movement of the object area Ara1 in the input image is less than a first reference value and the vertical synchronization frequency is a first frequency f1 in the state in which the turn on duty of the light source corresponding to the object area Ara1 in the input image is set to a first duty Wb1 and the level of current flowing in the light source is set to a first level hb1, a processor 270*b* according to another embodiment of the present disclosure may adjust the turn on duty of the light source corresponding to the object area Ara1 in the input image as a fifth duty Wc2, which is greater than the first duty Wb1, and adjust the level of current flowing in the light source as a fifth level hc2, which is lower than the first level hb1, during the first frame period. Consequently, the definition and luminance of an image including a slightly moving object may be improved.

Meanwhile, in the case in which the movement of the object area Ara1 in the input image is less than a first reference value and the vertical synchronization frequency is a second frequency f2, which is higher than the first frequency f1, in the state in which the turn on duty of the light source corresponding to the object area Ara1 in the input image is set to a first duty Wb1 and the level of current flowing in the light source is set to a first level hb1, a processor 270*b* according to another embodiment of the present disclosure may adjust the turn on duty of the light source corresponding to the object area Ara1 in the input image as a ninth duty We2, which is less than the fifth duty Wc2, and adjust the level of current flowing in the light source as a ninth level he2, which is higher than the fifth level hc2, during the first frame period. Consequently, the definition and luminance of an image including a slightly moving object may be improved while the vertical synchronization frequency of the image is increased.

Meanwhile, in the case in which the movement of the object area Ara1 in the input image is less than a first reference value and the vertical synchronization frequency is a first frequency f1 in the state in which the turn on duty of the light source corresponding to the background area Ara2 in the input image is set to a third duty Wb3, which is less than the first duty Wb1, and the level of current flowing in the light source is set to a third level hb3, which is lower than the first level hb1, a processor 270*b* according to another embodiment of the present disclosure may adjust the turn on duty of the light source corresponding to the background area Ara2 in the input image is a sixth duty Wc4, which is greater than the third duty Wb3, and adjust the level of current flowing in the light source as a sixth level hc4, which is lower than the third level hb3, during the first frame period. Consequently, the definition and luminance of a background area Ara2 of an image including a slightly moving object may be improved in a manner similar to the object.

Meanwhile, in the case in which the movement of the object area Ara1 in the input image is less than a first reference value and the vertical synchronization frequency is a second frequency f2, which is higher than the first frequency f1, in the state in which the turn on duty of the light source corresponding to the background area Ara2 in the input image is set to a third duty Wb3, which is less than the first duty Wb1, and the level of current flowing in the light source is set to a third level hb3, which is lower than the first level hb1, a processor 270*b* according to another embodiment of the present disclosure may adjust the turn on duty of the light source corresponding to the background area Ara2 in the input image as a tenth duty We4, which is less than the sixth duty Wc4, and adjust the level of current flowing in the light source as a tenth level he4, which is higher than the sixth level hc4, during the first frame period. Consequently, the definition and luminance of an image including a moving object may be improved while the vertical synchronization frequency of the image is increased.

Meanwhile, a processor 270*b* according to another embodiment of the present disclosure may adjust the turn on duty of the light source corresponding to the background area Ara2 decreases as the distance from the moving object area Ara1 in the input image increases. Consequently, the definition and luminance of the background area Ara2 may be improved.

Figure 18A:
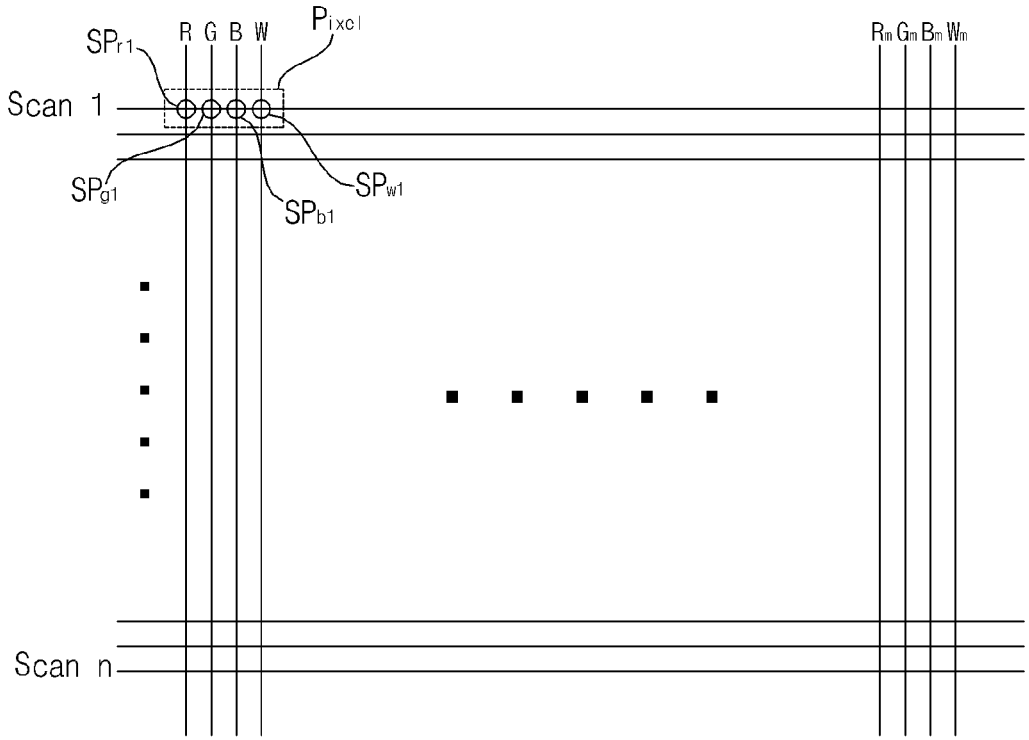
FIGS. 18A and 18B are diagrams referred to in the description of an organic light emitting diode panel of FIG. 17.
Figure 18B:
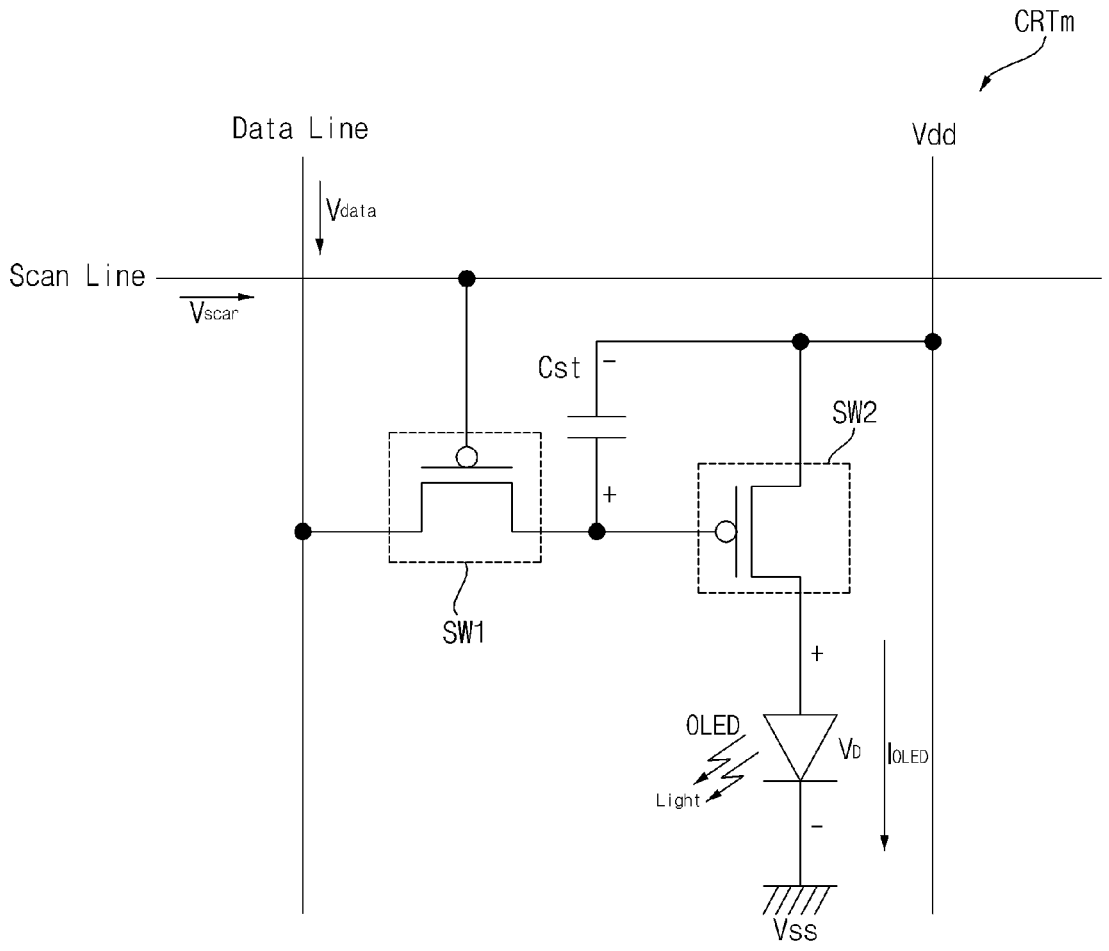

FIGS. 18A and 18B are diagrams referred to in the description of the organic light emitting diode panel of FIG. 17.

First, FIG. 18A is a diagram illustrating a pixel in the organic light emitting diode panel 210.

Referring to the figure, the organic light emitting diode panel 210 may include a plurality of scan lines Scan1 to Scann and a plurality of data lines R1, G1, B1, and W1 to Rm, Gm, Bm, and Wm intersecting the scan lines.

Meanwhile, a pixel (subpixel) is defined in an intersecting area of the scan line and the data line in the organic light emitting diode panel 210. In the drawing, a pixel including sub-pixels SR1, SG1, SB1 and SW1 of RGBW is shown.

FIG. 18B illustrates a circuit of any one sub-pixel in the pixel of the organic light emitting diode panel of FIG. 18A.

Referring to the figure, an organic light emitting sub pixel circuit (CRTm) may include, as an active type, a scan switching element SW1, a storage capacitor Cst, a drive switching element SW2, and an organic light emitting layer (OLED).

The scan switching element SW1 is turned on according to the input scan signal Vdscan, as a scan line is connected to a gate terminal. When it is turned on, the input data signal Vdata is transferred to the gate terminal of a drive switching element SW2 or one end of the storage capacitor Cst.

The storage capacitor Cst is formed between the gate terminal and the source terminal of the drive switching element SW2, and stores a certain difference between a data signal level transmitted to one end of the storage capacitor Cst and a DC power (VDD) level transmitted to the other terminal of the storage capacitor Cst.

For example, when the data signal has a different level according to a Plume Amplitude Modulation (PAM) method, the power level stored in the storage capacitor Cst varies according to the level difference of the data signal Vdata.

For another example, when the data signal has a different pulse width according to a Pluse Width Modulation (PWM) method, the power level stored in the storage capacitor Cst varies according to the pulse width difference of the data signal Vdata.

The drive switching element SW2 is turned on according to the power level stored in the storage capacitor Cst. When the drive switching element SW2 is turned on, the driving current (IOLED), which is proportional to the stored power level, flows in the organic light emitting layer (OLED). Accordingly, the organic light emitting layer OLED performs a light emitting operation.

The organic light emitting layer OLED may include a light emitting layer (EML) of RGBW corresponding to a subpixel, and may include at least one of a hole injecting layer (HIL), a hole transporting layer (HTL), an electron transporting layer (ETL), and an electron injecting layer (EIL). In addition, it may include a hole blocking layer, and the like.

Meanwhile, all the subpixels emit a white light in the organic light emitting layer OLED. However, in the case of green, red, and blue subpixels, a subpixel is provided with a separate color filter for color implementation. That is, in the case of green, red, and blue subpixels, each of the subpixels further includes green, red, and blue color filters. Meanwhile, since a white subpixel outputs a white light, a separate color filter is not required.

Meanwhile, in the drawing, it is illustrated that a p-type MOSFET is used for a scan switching element SW1 and a drive switching element SW2, but an n-type MOSFET or other switching element such as a JFET, IGBT, SIC, or the like are also available.

Meanwhile, the pixel is a hold-type element that continuously emits light in the organic light emitting layer (OLED), after a scan signal is applied, during a unit display period, specifically, during a unit frame.

FIGS. 19A to 19F are diagrams referred to in the description of image display according to another embodiment of the present disclosure.

Figure 19A:
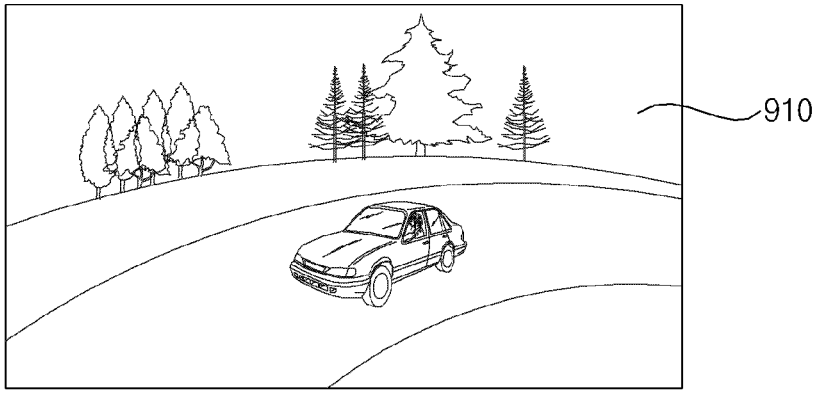
FIGS. 19A to 19F are diagrams referred to in the description of image display according to another embodiment of the present disclosure.

First, FIG. 19A illustrates an input image 910 including a moving object.

Figure 19B:
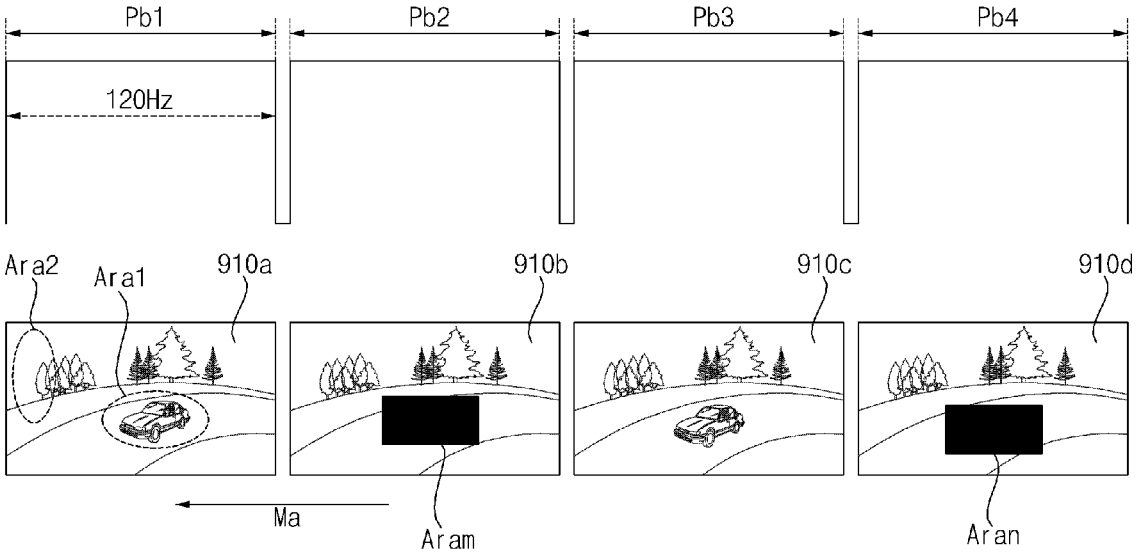

FIG. 19B illustrates a plurality of image frames 910*a*, 910*b*, 910*c*, and 910*d* for displaying the input image including the moving object.

FIG. 19B illustrates that the movement Ma of an object Ara1 between the first image frame 910*a* and the second image frame 910*b* is equal to or greater than a reference value.

The object Ara1 in the first to fourth image frames 910*a*, 910*b*, 910*c*, and 910*d* may sequentially move to the left, and the first to fourth image frames 910*a*, 910*b*, 910*c*, and 910*d* may be sequentially displayed.

Particularly, in the case in which the vertical synchronization frequency is 120 Hz, each of the first to fourth image frames 910*a*, 910*b*, 910*c*, and 910*d* may be displayed in response to a vertical synchronization frequency of 120 Hz.

For example, the first image 910*a* is displayed during a first frame period Pb1, the second image 910*b* is displayed during a second frame period Pb2, the third image 910*c* is displayed during a third frame period Pb3, and the fourth image 910*d* is displayed during a fourth frame period Pb4.

At this time, a vehicle, which is the moving object in the first to fourth image frames 910*a*, 910*b*, 910*c*, and 910*d*, may be displayed without change in the image output to and displayed on the panel 210, unlike FIG. 19B.

Also, in order to improve definition, the light source located at the position corresponding to the moving object Ara1, i.e. the vehicle, among the plurality of light sources that output light to the panel 210, may be turned off.

In particular, the light source located at the position corresponding to the moving object Ara1, i.e. the vehicle, may be alternately turned off.

Figure 19C:
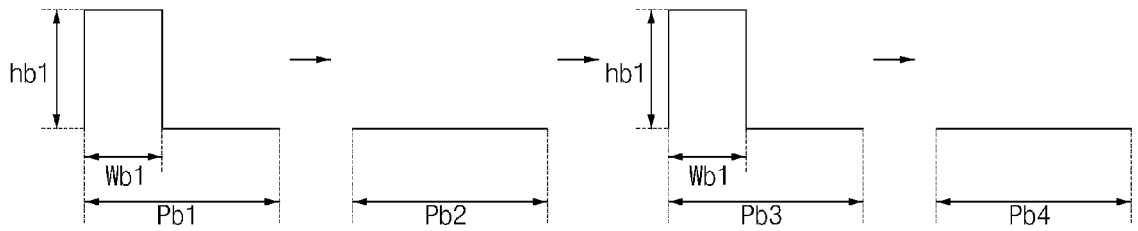

FIG. 19C illustrates that the light source located at the position corresponding to the moving object Ara1, i.e. the vehicle, is turned on during the first frame period Pb1 and the third frame period Pb3 but is turned off during the second frame period Pb2 and the fourth frame period Pb4, which follow the first frame period Pb1 and the third frame period Pb3, respectively.

In particular, FIG. 19C illustrates that the turn on duty of the light source located at the position corresponding to the moving object Ara1, i.e. the vehicle, is a first duty Wb1 and the level of current flowing in the light source is a first level hb1 during the first frame period Pb1 and the third frame period Pb3.

As shown in FIG. 19B, therefore, the moving object Ara1, i.e. the vehicle, is displayed properly during the first frame period Pb1 and the third frame period Pb3, and the moving object Ara1, i.e. the vehicle, is displayed as a black area during the second frame period Pb2 and the fourth frame period Pb4.

Even in the method of FIG. 19C, however, overall luminance of the image may be lowered due to turn off of the light source during second frame period Pb2 and the fourth frame period Pb4. That is, luminance is higher than in FIG. 8C, but overall luminance of the image may be lowered.

In the present disclosure, therefore, the turn on duty of the light source located at the position corresponding to the moving object Ara1, i.e. the vehicle, and the level of current flowing in the light source are changed during the first frame period Pb1 and the third frame period Pb3 in consideration of turn off of the light source during second frame period Pb2 and the fourth frame period Pb4.

For example, in the case in which the movement of the object area Ara1 in the input image is equal to or greater than a first reference value, a processor 270*b* according to an embodiment of the present disclosure may decrease the turn on duty of the light source and may increase the level of current flowing in the light source. In particular, definition is improved due to a decrease in turn on duty, and luminance is improved due to an increase in the level of current.

Figure 19D:
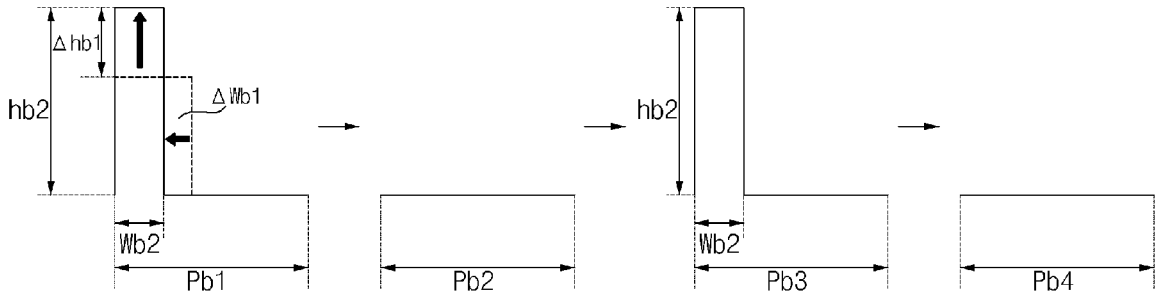

Specifically, in the case in which the turn on duty of the light source corresponding to the object area Ara1 in the input image is set to a first duty Wb1 and the level of current flowing in the light source is set to a first level hb1, a processor 270*b* according to an embodiment of the present disclosure may adjust the turn on duty of the light source corresponding to the object area Ara1 in the input image as a second duty Wb2, which is less than the first duty Wb1, and the level of current flowing in the light source as a second level hb2, which is higher than the first level hb1, during the first frame period Pb1 and the third frame period Pb3, as shown in FIG. 19D. Consequently, the definition and luminance of an image including a moving object may be improved.

More specifically, in the case in which the movement Ma of the object area Ara1 in the input image is equal to or greater than a first reference value in the state in which the turn on duty of the light source corresponding to the object area Ara1 in the input image is set to a first duty Wb1 and the level of current flowing in the light source is set to a first level hb1, a processor 270*b* according to an embodiment of the present disclosure may adjust the turn on duty of the light source corresponding to the object area Ara1 in the input image as a second duty Wb2, which is less than the first duty Wb1, and the level of current flowing in the light source as a second level hb2, which is higher than the first level hb1, during the first frame period Pb1 and the third frame period Pb3, as shown in FIG. 19D. Consequently, the definition and luminance of an image including a moving object may be improved.

FIG. 19D illustrates that the turn on duty of the light source corresponding to the object area Ara1 is a second duty Wb2, which is less than the first duty Wb1, and the level of current flowing in the light source as a second level hb2, which is higher than the first level hb1, during the first frame period Pb1 and the third frame period Pb3.

At this time, the difference between the first duty Wb1 and the second duty Wb2 is ΔWb1, and the difference between the second level hb2 and the first level hb1 is Δhb1.

Meanwhile, a processor 270*b* according to an embodiment of the present disclosure may perform control such that, as the movement of the object in the input image increases, the second duty Wb2 decreases and the second level hb2 increases. That is, definition and luminance may be improved depending on the extent of movement of the object.

Meanwhile, the processor 270*b* may adjust the turn on duty of the light source corresponding to the object area Ara1 in the input image as zero or as a value equal to or less than the lowest limit value and the level of current flowing in the light source as zero or as a value equal to or less than the lowest limit value during the second frame period Pb2 and the fourth frame period Pb4, which follow the first frame period Pb1 and the third frame period Pb3, respectively, as shown in FIG. 19D.

Figure 19E:
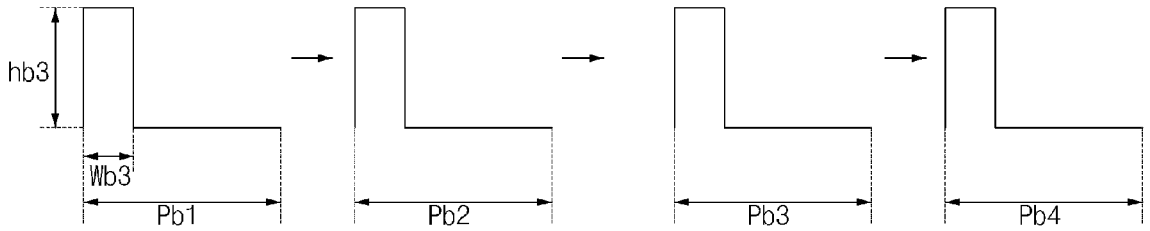

FIG. 19E illustrates that the light source located at the position corresponding to a background area Ara2 is continuously turned on during the first frame period Pb1 to the fourth frame period Pb4.

In particular, the light source is also turned on during the second frame period Pb2 and the fourth frame period Pb4, unlike FIG. 19C.

Meanwhile, FIG. 19E illustrates that the turn on duty of the light source located at the position corresponding to the background area Ara2 is a third duty Wb3, which is less than the first duty Wb1, and the level of current flowing in the light source located at the position corresponding to the background area Ara2 is a third level hb3, which is lower than the first level hb1.

Meanwhile, since the turn on duty of the light source corresponding to the object area Ara1 in the input image and the level of current flowing in the light source are changed in order to improve the definition and luminance of the image, as shown in FIG. 19D, control may be performed such that the turn on duty of the light source located at the position corresponding to the background area Ara2 and the level of current flowing in the light source are changed.

The turn on duty of the light source located at the position corresponding to the background area Ara2 may be adjusted in response to a variation in turn on duty of the light source corresponding to the object area Ara1 in the input image, and the level of current flowing in the light source located at the position corresponding to the background area Ara2 may be adjusted in response to a variation in the current flowing in the light source corresponding to the object area Ara1 in the input image.

Figure 19F:
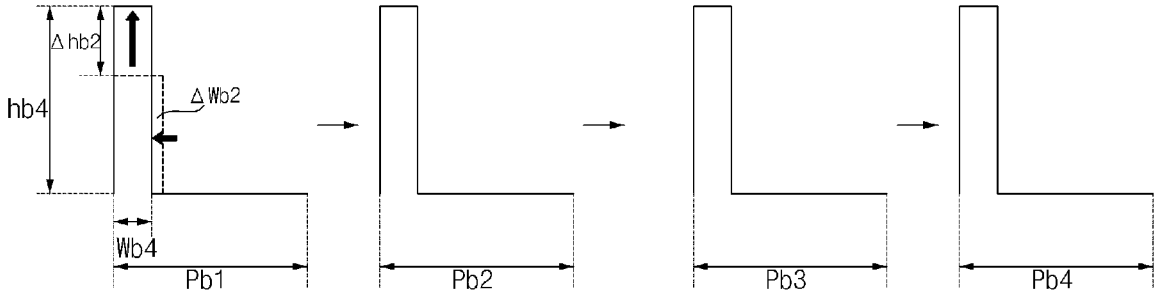

FIG. 19F illustrates that the turn on duty of the light source corresponding to the background area Ara2 is a fourth duty Wb4, which is less than the third duty Wb3, and adjust the level of current flowing in the light source as a fourth level hb4, which is higher than the third level hb3, during the first frame period Pb1 to the fourth frame period Pb4.

In the case in which the turn on duty of the light source corresponding to the background area Ara2 in the input image is set to a third duty Wb3, which is less than the first duty Wb1, and the level of current flowing in the light source is set to a third level hb3, which is lower than the first level hb1, a processor 270*b* according to an embodiment of the present disclosure may adjust the turn on duty of the light source corresponding to the background area Ara2 in the input image as a fourth duty Wb4, which is less than the third duty Wb3, and adjust the level of current flowing in the light source as a fourth level hb4, which is higher than the third level hb3, during the first frame period. Consequently, the definition and luminance of the background area Ara2 may be improved in a manner similar to the object.

At this time, the difference between the third duty Wb3 and the fourth duty Wb4 is ΔWb2, and the difference between the third level hb3 and the fourth level hb4 is Δhb2.

Meanwhile, a processor 270*b* according to an embodiment of the present disclosure may perform control such that, as the movement of the object in the input image increases, the fourth duty Wb4 decreases and the fourth level hb4 increases. That is, definition and luminance may be improved depending on the extent of movement of the object.

As is apparent from the above description, an image display apparatus according to an embodiment of the present disclosure includes a panel configured to display an image, a backlight including a plurality of light sources configured to output light to the panel, a light source driver configured to drive the plurality of light sources, and a processor configured to control the light source driver, wherein the processor changes the turn on duty of a light source corresponding to a moving object area in an input image and changes the level of current flowing in the light source. Consequently, the definition and luminance of an image including a moving object may be improved.

Meanwhile, in the case in which the movement of the object area in the input image is equal to or greater than a first reference value, a processor according to an embodiment of the present disclosure may decrease the turn on duty of the light source and may increase the level of current flowing in the light source. In particular, definition is improved due to a decrease in turn on duty, and luminance is improved due to an increase in the level of current.

Meanwhile, in the case in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a second duty, which is less than the first duty, and adjust the level of current flowing in the light source as a second level, which is higher than the first level, during a first frame period. Consequently, the definition and luminance of an image including a moving object may be improved.

Meanwhile, a processor according to an embodiment of the present disclosure may perform control such that, as the movement of the object in the input image increases, the second duty decreases and the second level increases. That is, definition and luminance may be improved depending on the extent of movement of the object.

Meanwhile, in the case in which the turn on duty of a light source corresponding to a background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period. Consequently, the definition and luminance of the background area may be improved in a manner similar to the object.

Meanwhile, in the case in which the movement of the object area in the input image is equal to or greater than a first reference value in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a second duty, which is less than the first duty, and adjust the level of current flowing in the light source as a second level, which is higher than the first level, during the first frame period. Consequently, the definition and luminance of an image including a greatly moving object may be improved.

Meanwhile, in the case in which the movement of the object area in the input image is less than a first reference value in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period. Consequently, the definition and luminance of an image including a slightly moving object may be improved.

Meanwhile, a processor according to an embodiment of the present disclosure may increase the fifth duty and decrease the fifth level, as the movement of the object in the input image decreases. Consequently, the definition and luminance of an image including a slightly moving object may be improved.

Meanwhile, in the case in which the movement of the object area in the input image is less than a first reference value in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period. Consequently, the definition and luminance of the background area may be improved in a manner similar to the object area.

Meanwhile, in the case in which the movement of the object area in the input image is equal to or greater than a first reference value and the vertical synchronization frequency is a first frequency in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a second duty, which is less than the first duty, and adjust the level of current flowing in the light source as a second level, which is higher than the first level, during the first frame period. Consequently, the definition and luminance of an image including a moving object may be improved.

Meanwhile, in the case in which the movement of the object area in the input image is equal to or greater than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a seventh duty, which is less than the second duty, and adjust the level of current flowing in the light source as a seventh level, which is higher than the second level, during the first frame period. Consequently, the definition and luminance of an image including a moving object may be improved while the vertical synchronization frequency of the image is increased.

Meanwhile, in the case in which the movement of the object area in the input image is equal to or greater than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period. Consequently, the definition and luminance of the background area may be improved in a manner similar to the object.

Meanwhile, in the case in which the movement of the object area in the input image is equal to or greater than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as an eighth duty, which is less than the fourth duty, and adjust the level of current flowing in the light source as an eighth level, which is higher than the fourth level, during the first frame period. Consequently, the definition and luminance of an image including a moving object may be improved while the vertical synchronization frequency of the image is increased.

Meanwhile, in the case in which the movement of the object area in the input image is less than a first reference value and the vertical synchronization frequency is a first frequency in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period. Consequently, the definition and luminance of an image including a slightly moving object may be improved.

Meanwhile, in the case in which the movement of the object area in the input image is less than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to an embodiment of the present disclosure may adjust the turn on duty of the light source corresponding to the object area in the input image as a ninth duty, which is less than the fifth duty, and adjust the level of current flowing in the light source as a ninth level, which is higher than the fifth level, during the first frame period. Consequently, the definition and luminance of an image including a slightly moving object may be improved while the vertical synchronization frequency of the image is increased.

Meanwhile, in the case in which the movement of the object area in the input image is less than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period. Consequently, the definition and luminance of a background area of an image including a slightly moving object may be improved in a manner similar to the object.

Meanwhile, in the case in which the movement of the object area in the input image is less than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to an embodiment of the present disclosure may adjust the turn on duty of the light source corresponding to the background area in the input image as a tenth duty, which is less than the sixth duty, and adjust the level of current flowing in the light source as a tenth level, which is higher than the sixth level, during the first frame period. Consequently, the definition and luminance of an image including a moving object may be improved while the vertical synchronization frequency of the image is increased.

Meanwhile, a processor according to an embodiment of the present disclosure may adjust the turn on duty of the light source corresponding to the background area decreases as the distance from the moving object area in the input image increases. Consequently, the definition and luminance of the background area may be improved.

Meanwhile, an image display apparatus according to another embodiment of the present disclosure includes an organic light emitting diode panel including a plurality of light sources, a light source driver configured to drive the organic light emitting diode panel, and a processor configured to control the light source driver, wherein the processor changes the turn on duty of a light source corresponding to a moving object area in an input image and changes the level of current flowing in the light source. Consequently, the definition and luminance of an image including a moving object may be improved.

Meanwhile, in the case in which the movement of the object area in the input image is equal to or greater than a first reference value, a processor according to another embodiment of the present disclosure may decrease the turn on duty of the light source and may increase the level of current flowing in the light source. In particular, definition is improved due to a decrease in turn on duty, and luminance is improved due to an increase in the level of current.

Meanwhile, in the case in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a second duty, which is less than the first duty, and adjust the level of current flowing in the light source as a second level, which is higher than the first level, during a first frame period. Consequently, the definition and luminance of an image including a moving object may be improved.

Meanwhile, a processor according to another embodiment of the present disclosure may perform control such that, as the movement of the object in the input image increases, the second duty decreases and the second level increases. That is, definition and luminance may be improved depending on the extent of movement of the object.

Meanwhile, in the case in which the turn on duty of a light source corresponding to a background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period. Consequently, the definition and luminance of the background area may be improved in a manner similar to the object.

Meanwhile, in the case in which the movement of the object area in the input image is equal to or greater than a first reference value in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a second duty, which is less than the first duty, and adjust the level of current flowing in the light source as a second level, which is higher than the first level, during the first frame period. Consequently, the definition and luminance of an image including a greatly moving object may be improved.

Meanwhile, in the case in which the movement of the object area in the input image is less than a first reference value in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period. Consequently, the definition and luminance of an image including a slightly moving object may be improved.

Meanwhile, a processor according to another embodiment of the present disclosure may increases the fifth duty and decrease the fifth level, as the movement of the object in the input image decreases. Consequently, the definition and luminance of an image including a slightly moving object may be improved.

Meanwhile, in the case in which the movement of the object area in the input image is less than a first reference value in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period. Consequently, the definition and luminance of an image including a slightly moving object may be improved.

Meanwhile, in the case in which the movement of the object area in the input image is equal to or greater than a first reference value and the vertical synchronization frequency is a first frequency in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a second duty, which is less than the first duty, and adjust the level of current flowing in the light source as a second level, which is higher than the first level, during the first frame period. Consequently, the definition and luminance of an image including a moving object may be improved.

Meanwhile, in the case in which the movement of the object area in the input image is equal to or greater than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a seventh duty, which is less than the second duty, and adjust the level of current flowing in the light source as a seventh level, which is higher than the second level, during the first frame period. Consequently, the definition and luminance of an image including a moving object may be improved while the vertical synchronization frequency of the image is increased.

Meanwhile, in the case in which the movement of the object area in the input image is equal to or greater than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a fourth duty, which is less than the third duty, and adjust the level of current flowing in the light source as a fourth level, which is higher than the third level, during the first frame period. Consequently, the definition and luminance of the background area may be improved in a manner similar to the object.

Meanwhile, in the case in which the movement of the object area in the input image is equal to or greater than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as an eighth duty, which is less than the fourth duty, and adjust the level of current flowing in the light source as an eighth level, which is higher than the fourth level, during the first frame period. Consequently, the definition and luminance of an image including a moving object may be improved while the vertical synchronization frequency of the image is increased.

Meanwhile, in the case in which the movement of the object area in the input image is less than a first reference value and the vertical synchronization frequency is a first frequency in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a fifth duty, which is greater than the first duty, and adjust the level of current flowing in the light source as a fifth level, which is lower than the first level, during the first frame period. Consequently, the definition and luminance of an image including a slightly moving object may be improved.

Meanwhile, in the case in which the movement of the object area in the input image is less than a first reference value and the vertical synchronization frequency is a second frequency, which is higher than the first frequency, in the state in which the turn on duty of the light source corresponding to the object area in the input image is set to a first duty and the level of current flowing in the light source is set to a first level, a processor according to another embodiment of the present disclosure may adjust the turn on duty of the light source corresponding to the object area in the input image as a ninth duty, which is less than the fifth duty, and adjust the level of current flowing in the light source as a ninth level, which is higher than the fifth level, during the first frame period. Consequently, the definition and luminance of an image including a slightly moving object may be improved while the vertical synchronization frequency of the image is increased.

Meanwhile, in the case in which the movement of the object area in the input image is less than a first reference value and the vertical synchronization frequency is a first frequency in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a sixth duty, which is greater than the third duty, and adjust the level of current flowing in the light source as a sixth level, which is lower than the third level, during the first frame period. Consequently, the definition and luminance of a background area of an image including a slightly moving object may be improved in a manner similar to the object.

Meanwhile, in the case in which the movement of the object area in the input image is less than a first reference value and the vertical synchronization frequency is a second frequency, which is higher than the first frequency, in the state in which the turn on duty of the light source corresponding to the background area in the input image is set to a third duty, which is less than the first duty, and the level of current flowing in the light source is set to a third level, which is lower than the first level, a processor according to another embodiment of the present disclosure may adjust the turn on duty of the light source corresponding to the background area in the input image as a tenth duty, which is less than the sixth duty, and adjust the level of current flowing in the light source as a tenth level, which is higher than the sixth level, during the first frame period. Consequently, the definition and luminance of an image including a moving object may be improved while the vertical synchronization frequency of the image is increased.

Meanwhile, a processor according to another embodiment of the present disclosure may adjust the turn on duty of the light source corresponding to the background area decreases as the distance from the moving object area in the input image increases. Consequently, the definition and luminance of the background area may be improved.

While the present disclosure has been particularly shown and described with reference to exemplary embodiments thereof, it is clearly understood that the same is by way of illustration and example only and is not to be taken in conjunction with the present disclosure. It will be understood by those skilled in the art that various changes in form and details may be made therein without departing from the subject matter and scope of the present disclosure.

What is claimed is:

1. An image display apparatus comprising:

a panel configured to display an image;

a backlight comprising a plurality of light sources configured to output light to the panel;

a light source driver configured to drive the plurality of light sources; and a processor configured to control the light source driver, wherein the processor is further configured to:

change a turn on duty of a first light source corresponding to a moving object area in an input image, change a level of current flowing to the first light source, based at least in part on a movement of the moving object area in the input image being greater than or equal to a first reference value, decrease the turn on duty of the first light source and increase the level of current flowing in the first light source, and based at least in part on the movement of the moving object area in the input image being less than the first reference value, increase the turn on duty of the first light source and decrease the level of current flowing in the first light source.

2. The image display apparatus of claim 1, wherein the processor is further configured to:

adjust the turn on duty of the first light source corresponding to the moving object area in the input image to a second turn on duty based at least in part on the turn on duty of the first light source being set to a first turn on duty and the level of current flowing in the first light source being set to a first level, wherein the second turn on duty is less than the first turn on duty, and adjust the level of current flowing in the first light source to a second level during a first frame period, wherein the second level is higher than the first level.

3. The image display apparatus of claim 2, wherein the processor is further configured to decrease the second turn on duty and to increase the level of current from the second level as movement of the object in the input image increases.

4. The image display apparatus of claim 2, wherein the processor is further configured to:

adjust the turn on duty of a second light source corresponding to a background area in the input image to a fourth duty based at least in part on the turn on duty of the second light source being set to a third duty and a level of current flowing in the second light source is set to a third level, wherein the third duty is less than a first duty, wherein the third level is lower than the first level, wherein the fourth duty is less than the third duty, and adjust the level of current flowing in the first light source to a fourth level during the first frame period, wherein the fourth level is higher than the third level.

5. The image display apparatus of claim 1, wherein the processor is further configured to:

adjust the turn on duty of the first light source corresponding to the moving object area in the input image to a second duty based at least in part on movement of the object area in the input image being greater than or equal to a first references value in a state in which the turn on duty of the first light source is set to a first duty and the level of current flowing in the first light source is set to a first level, wherein the second duty is less than the first duty, and adjust the level of current flowing in the first light source to a second level during a first frame period, wherein the second level is higher than the first level.

6. The image display apparatus of claim 1, wherein the processor is further configured to:

adjust the turn on duty of a first light source corresponding to the moving object area in the input image to a fifth duty based at least in part on movement of the object area in the input image being less than a first reference value in a state in which the turn on duty of the first light source in the input image is set to a first duty and the level of current flowing in the first light source is set to a first level, wherein the fifth duty is greater than the first duty, and adjust the level of current flowing in the first light source to a fifth level during a first frame period, wherein the fifth level is lower than the first level.

7. The image display apparatus of claim 6, wherein the processor is further configured to increase the fifth duty and to decrease the fifth level as the movement of the object in the input image decreases.

8. The image display apparatus of claim 6, wherein the processor is further configured to:

adjust the turn on duty of a second light source corresponding to a background area in the input image to a sixth duty based at least in part on the movement of the object area in the input image being less than a first reference value in the state in which the turn on duty of the second light source is set to a third duty, and the level of current flowing in the second light source is set to a third level, wherein the third duty is less than the first duty, wherein the third level is lower than the first level, wherein the sixth duty is greater than the third duty, and adjust the level of current flowing in the second light source to a sixth level during the first frame period, wherein the sixth level is lower than the third level.

9. The image display apparatus of claim 1, wherein the processor is further configured to:

adjust the turn on duty of the first light source corresponding to the moving object area in the input image to a second duty based at least in part on movement of the object area in the input image being greater than or equal to a first reference value and a vertical synchronization frequency being a first frequency in a state in which the turn on duty of the first light source is set to a first duty and the level of current flowing in the first light source is set to a first level, wherein the second duty is less than the first duty, and adjust the level of current flowing in the first light source to a second level during a first frame period, wherein the second level is higher than the first level.

10. The image display apparatus of claim 9, wherein the processor is further configured to:

adjust the turn on duty of the first light source to a seventh duty based at least in part on the movement of the object area in the input image being greater than or equal to a first reference value and the vertical synchronization frequency being a second frequency in a state in which the turn on duty of the first light source is set to a first duty and the level of current flowing in the first light source is set to a first level, wherein the second frequency is higher than the first frequency, wherein the seventh duty is less than the second duty, and adjust the level of current flowing in the first light source to a seventh level during the first frame period, wherein the seventh level is higher than the second level.

11. The image display apparatus of claim 1, wherein the processor is further configured to:

adjust the turn on duty of a second light source corresponding to a background area in the input image to a fourth duty based at least in part on movement of the object area in the input image being greater than or equal to a first reference value and a vertical synchronization frequency being a first frequency in a state in which the turn on duty of the second light source is set to a third duty and the level of current flowing in the second light source is set to a third level, wherein the third duty is less than the first duty, wherein the fourth duty is less than the third duty, wherein the third level is lower than the first level, and adjust the level of current flowing in the second light source to a fourth level during a first frame period, wherein the fourth level is higher than the third level.

12. The image display apparatus of claim 11, wherein the processor is further configured to:

adjust the turn on duty of the second light source to an eighth duty based at least in part on the movement of the object area in the input image being greater than or equal to a first reference value and the vertical synchronization frequency being a second frequency in a state in which the turn on duty of the second light source is set to a third duty and the level of current flowing in the second light source is set to a third level, wherein the second frequency is higher than the first frequency, wherein the third duty is less than the first duty, wherein the third level is lower than the first level, wherein the eighth duty is less than the fourth duty, and adjust the level of current flowing in the second light source to an eighth level during the first frame period, wherein the eighth level is higher than the fourth level.

13. The image display apparatus of claim 1, wherein the processor is further configured to:

adjust the turn on duty of the first light source corresponding to the moving object area in the input image to a fifth duty based at least in part on movement of the object area in the input image being less than a first reference value and a vertical synchronization frequency being a first frequency in a state in which the turn on duty of the first light source is set to the first duty and the level of current flowing in the first light source is set to a first level, wherein the fifth duty is greater than a first duty, and adjust the level of current flowing in the first light source to a fifth level during a first frame period, wherein the fifth level is lower than the first level.

14. The image display apparatus of claim 13, wherein the processor is further configured to:

adjust the turn on duty of the first light source to a ninth duty based at least in part on the movement of the object area in the input image being less than a first reference value and the vertical synchronization frequency being a second frequency in a state in which the turn on duty of the first light source is set to a first duty and the level of current flowing in the first light source is set to a first level, wherein the second frequency is higher than the first frequency, wherein the ninth duty is less than the fifth duty, and adjust the level of current flowing in the first light source to a ninth level during the first frame period, wherein the ninth level is higher than the fifth level.

15. The image display apparatus of claim 13, wherein the processor is further configured to:

adjust the turn on duty of a second light source corresponding to a background area in the input image to a sixth duty based at least in part on the movement of the object area in the input image being less than a first reference value and the vertical synchronization frequency being a first frequency in a state in which the turn on duty of the second light source is set to a third duty and the level of current flowing in the second light source is set to a third level, wherein the third level is lower than the first level, wherein the third duty is less than the first duty, wherein the sixth duty is greater than the third duty, and adjust the level of current flowing in the second light source to a sixth level during the first frame period, wherein the sixth level is lower than the third level.

16. The image display apparatus of claim 15, wherein the processor is further configured to:

adjust the turn on duty of the second light source to a tenth duty based at least in part on the movement of the object area in the input image being less than a first reference value and the vertical synchronization frequency being a second frequency in a state in which the turn on duty of the second light is set to a third duty and the level of current flowing in the second light source is set to a third level, wherein the second frequency is higher than the first frequency, wherein the third duty is less than the first duty, wherein the third level is lower than the first level, wherein the tenth duty is less than the sixth duty, and adjust the level of current flowing in the second light source to a tenth level during the first frame period, wherein the tenth level is higher than the sixth level.

17. The image display apparatus of claim 1, wherein the processor is further configured to decrease the turn on duty of a second light source corresponding to a background area in the input image as a distance between the first light source and the moving object area in the input image increases.

18. An image display apparatus comprising:

an organic light emitting diode panel comprising a plurality of light sources;

a light source driver configured to drive the organic light emitting diode panel; and a processor configured to control the light source driver, wherein the processor is further configured to:

change a turn on duty of a first light source corresponding to a moving object area in an input image, change a level of current flowing in the first light source, based at least in part on a movement of the moving object area in the input image being greater than or equal to a first reference value, decrease the turn on duty of the first light source and increase the level of current flowing in the first light source, and based at least in part on the movement of the moving object area in the input image being less than the first reference value, increase the turn on duty of the first light source, and decrease the level of current flowing in the first light source.

19. The image display apparatus of claim 18, wherein the processor is further configured to adjust the turn on duty of the first light source corresponding to the moving object area in the input image to a second duty based at least in part on the turn on duty of the first light source being set to a first duty and the level of current flowing in the first light source being set to a first level, wherein the second duty is less than the first duty, and to adjust the level of current flowing in the first light source to a second level during a first frame period, wherein the second level is higher than the first level.

* * * * *